US005139110A

United States Patent [19]

Kishi

[11] Patent Number: 5,139,110

[45] Date of Patent: Aug. 18, 1992

[54] LIFTING APPARATUS

[75] Inventor: Mitsuhiro Kishi, Ashikaga, Japan

[73] Assignee: Japanic Corporation, Ashikaga, Japan

[21] Appl. No.: 648,218

[22] Filed: Jan. 31, 1991

[30] Foreign Application Priority Data

| | | | |
|---|---|---|---|
| Feb. 2, 1990 | [JP] | Japan | 2-24211 |
| Mar. 27, 1990 | [JP] | Japan | 2-77699 |
| Sep. 27, 1990 | [JP] | Japan | 2-257700 |
| Nov. 5, 1990 | [JP] | Japan | 2-299539 |

[51] Int. Cl.[5] ..... B66B 11/04

[52] U.S. Cl. ..... 187/18; 182/141

[58] Field of Search ..... 187/18, 8.71, 8.72; 182/141, 63, 148, 69; 254/122, 126, 9 C

[56] References Cited

U.S. PATENT DOCUMENTS

| | | | |
|---|---|---|---|
| 3,820,631 | 6/1974 | King et al. | 182/141 |
| 4,343,379 | 8/1982 | Haulotte | 187/18 |
| 4,466,509 | 8/1984 | Kishi | 182/141 |

FOREIGN PATENT DOCUMENTS

| | | |
|---|---|---|
| 53-119556 | 10/1978 | Japan . |
| 58-95100 | 6/1983 | Japan . |

*Primary Examiner*—Robert P. Olszewski
*Assistant Examiner*—Kenneth Noland
*Attorney, Agent, or Firm*—Flynn, Thiel, Boutell & Tanis

[57] ABSTRACT

A lifting apparatus capable of eliminating a synchronous mechanism or an additional hydraulic cylinder with simple structure. The lifting apparatus comprises a mobile chassis, a platform disposed over the mobile chassis and capable of raising and lowering vertrically, and a lifting mechanism disposed between the mobile chassis and the platform and including a pair of hydraulic stretchable mechanisms connected to each other at the central portions thereof and capable of turning in an X-shape about the central portions thereof and stretchable in three stages.

19 Claims, 35 Drawing Sheets

LIFTING APPARATUS

BACKGROUND OF THE INVENTION

1. Field of the Invention

The present invention relates to a lifting apparatus for use in assembling a building at an elevated spot, painting and the like at the elevated spot, lifting operators or materials upward for operation at the elevated spot or loading and unloading disused building materials at the building work, particularly to the lifting apparatus having a lifting mechanism for raising and lowering a platform which mechanism resembles hydraulic cylinders as a whole.

2. Prior Art

There has been employed a lifting apparatus provided with a platform for assembling, painting, repairing a building, and the like at an elevated spot, which platform is capable of lifting or lowering for loading operators or building materials and the like thereon or unloading the disused materials therefrom.

There has been employed a pantograph type telescopical mechanism, i.e. scissors type comprising a first pair of arms pivotally connected with each other at the central portion thereof and plural pairs of arms connected with the first pair of arms. In this apparatus, it was necessary to lengthen the length of the pairs of arms or increase the number of arms to be connected to the first pair of arms for increasing the height of the platform at maximum. Hence, if a lifting mechanism capable of lifting upward as high as possible is designed, it was necessary to employ a plurality of paired pantographs, which entails increasing the height of the lifting mechanism when folded and making it more troublesome for getting thereon or thereoff or loading the materials thereon or unloading the materials therefrom.

There have been various proposals to solve the problems set forth above, for example the one as disclosed in U.S. Pat. No. 3,820,631. In a mechanism as proposed by this patent, a lower boom and an upper boom are respectively capable of moving linearly into a middle boom and the lower boom is pivotally mounted on a chassis at the end thereof and the upper boom is pivotally mounted on a platform at the end thereof, and these booms are assembled to form an X-shape. In this mechanism, inasmuch as the length of the boom per se becomes long, the height of the platform when folded can be decreased and the platform can be raised at the elevated spot.

However, according to this invention, inasmuch as the mechanism for extending the lower boom and upper boom from the middle boom comprises a screw and a thread for engaging with this screw, the telescopic moving speed of the lower and upper booms relative to the middle boom is slow, hence the platform can not be moved quickly. Furthermore, since the sliding motion of the lower boom and the upper boom is made by a bevel gear provided at the central portion of the middle boom, the entire length of the combination of the lower boom and the upper boom extending from the middle boom reaches the length only half as long as the middle boom, hence the mechanism has such a structure that the platform can not be raised as high as possible.

There has been proposed such a mechanism that another boom is inserted into a boom to extend the length thereof so that the entire length thereof is lengthened.

For example, in FIG. 4 of Japanese Patent Laid-Open Publication No. 53-119556 lower and upper booms respectively having small diameters are inserted into a middle boom having a large diameter wherein the lower and upper booms inserted into the middle boom are pulled out to lengthen the entire length of the booms, whereby the platform is raised high.

However, according to this mechanism, there is no mechanism for synchronizing the amount of extension and contraction of the lower boom pulled out from the middle boom with that of the upper boom pulled out from the middle boom. The lower and the upper boom move individually relative to the middle boom. The amount of extension and contraction is restricted by a link mechanism comprising bars, hence the complete synchronization of the lower and upper boom relative to the middle boom can not be achieved. Accordingly, the lower and upper booms can not be connected to the platform by a pin and the like, and non-synchronized error of the amount of the extension and contraction between the lower and upper booms relative to the middle boom can be absorbed by rollers contacting the chassis and the platform. Hence, the platform is liable to swing because of accumulation of jolt caused by many supporting fulcrums and reception of the rolling motion by the roller. As a result, the mechanism is liable to swing by the wind and the like and is unstable, thereby permitting the operator to feel anxious.

In FIG. 4 of aforesaid No. 53-119556, the X-shaped middle boom can be turned by a hydraulic cylinder attached externally wherein the upper and lower booms are pulled out from the middle boom when the middle boom is turned. Although the amount of movement of the upper and lower booms from the middle boom when pulled out is restricted by a link mechanism, each length of the upper and lower booms when pulled out at maximum by the maximum extension of the hydraulic cylinder, which affects directly the upper and lower booms, does not exceed the entire length of the middle boom. Accordingly, it was impossible to extend the entire lengths of the booms at their maximum length.

There have been proposed many lifting mechanisms having a plurality of booms telescopically interfit into an arm which arm can be extended in the longitudinal direction thereof such as those as disclosed in Japanese Patent Application Nos. 56-134487 and 56-191065 (now Laid-Open Publication No. 58-95100). In these mechanisms, the booms composed of three stages are extendable in the longitudinal directions thereof and middle booms assembled in an X-shape can be turned at the central portions thereof wherein a chassis and a platform are structured to be the X-shape as viewed from the side view and the platform can be raised at the higher position. Furthermore, inasmuch as a lower boom and an upper boom are connected to the mobile chassis and the platform at the tip ends thereof by pins, there occurred less jolt, hence the structure can resist strong against the vibration. In the lifting mechanism having stretchable boom assemblies capable of stretching in several stages, the middle boom per se can be raised by a hydraulic cylinder intervened between the mobile chassis and the center of the middle boom and the lower boom or the upper boom are pulled out by the hydraulic cylinder inserted into the middle boom in order to telescopically move the lower boom or the upper boom from the middle boom. In this arrangement, inasmuch as the hydraulic cylinder can be used, it was necessary to synchronize the upper and lower boom relative to the middle boom, which entails necessity of a synchronous mechanism composed of chains or wires an the like. As a result, there was occurred such a problem that the arrangement was complex and the weight of the lifting mechanism was increased.

SUMMARY OF THE INVENTION

It is therefor an object of the first and second aspects of the present invention to provide a lifting apparatus capable of eliminating a synchronous mechanism or an additional hydraulic cylinder with simple structure which comprises conventional middle booms composed of hydraulic cylinders and upper and lower rods having different diameters respectively telescopically movable from the upper and lower ends of the middle booms.

It is an object of the third aspect of the present invention to provide a lifting apparatus employing two pairs of operation units each unit including X-shaped parallel coupled cylinder bodies corresponding to conventional middle booms. Two pairs of operations units can turn at the central portion thereof so as to form the stretchable mechanism. Cylinder rods are disposed in the cylinder bodies in the opposite direction wherein each of one rod is connected to a mobile chassis at the tip end thereof and each of the other rod is connected to a platform at the tip end thereof.

It is an object of the fourth aspect of the present invention to provide a lifting apparatus having at least three hydraulic stretchable mechanisms capable of reducing the manufacturing cost of the apparatus as a whole. A further object of the fourth aspect of the present invention is to provide the lifting apparatus having a synchronous mechanism capable of synchronizing the speed of the stretchable movement of the three hydraulic stretchable mechanisms at all times with simple structure and stable operation.

To achieve the first aspect of the present invention, the lifting apparatus comprises a mobile chassis, a platform disposed over the mobile chassis and capable of raising and lowering vertically, a lifting mechanism disposed between the mobile chassis and the platform and composed of an assembly of a pair of hydraulic stretchable mechanisms connected to each other at the central portions thereof and capable of turning in an X-shape about the central portions thereof and stretchable in three stages characterized in that the pair of hydraulic stretchable mechanisms are composed of hydraulic cylinder bodies having both open ends, lower rods being inserted into and stretchable from one open ends and connected to the mobile chassis, upper rods being inserted into and stretchable from the other open ends and connected to the platform, airtight spaces defined in the hydraulic cylinder bodies through which oil under pressure is supplied to operate the upper and lower rods wherein the cross sectional area to which oil under pressure operating to the lower rods is equal to that to which oil under pressure operating to the upper rods.

To achieve the second aspect of the present invention, the lifting apparatus comprises a mobile chassis, a platform disposed over the mobile chassis and capable of raising and lowering vertically, a lifting mechanism disposed between the mobile chassis and the platform and composed of an assembly of a pair of hydraulic stretchable mechanisms connected to each other at the central portions thereof and capable of turning in an X-shape about the central portions thereof and stretchable in three stages characterized in that one pair of hydraulic stretchable mechanisms are composed of hydraulic cylinder bodies having large diameters, large rods to be inserted into the hydraulic cylinder bodies and connected to the mobile chassis, small rods to be inserted into the hydraulic cylinder bodies and connected to the platform, another pair of hydraulic stretchable mechanisms are composed of hydraulic cylinder bodies having large diameters, large rods to be inserted into the hydraulic cylinder bodies and connected to the platform, small rods to be inserted into the hydraulic cylinder bodies and connected to the mobile chassis, wherein the small rods are extendable by the oil under pressure to be discharged when the large rods are extended so that the amount of the extension of the large rods is equal to that of the small rods relative to the hydraulic cylinder bodies.

To achieve the third aspect of the present invention, the lifting apparatus comprises a mobile chassis, a platform disposed over the mobile chassis and capable of raising and lowering vertically, a lifting mechanism disposed between the mobile chassis and the platform and composed of an assembly of a pair of hydraulic stretchable mechanisms connected to each other at the central portions thereof and capable of turning in an X-shape about the central portions thereof and stretchable in three stages characterized in that each of one pair of hydraulic stretchable mechanisms forming an operation unit is composed of two parallelly arranged coupled hydraulic cylinder bodies having open ends arranged alternately, i.e. opposite direction, one cylinder rod stretchable from one open end of the hydraulic cylinder bodies and connected to the mobile chassis and another cylinder rod stretchable from another open end of another hydraulic cylinder body and connected to the platform.

To achieve the fourth aspect of the present invention, the lifting apparatus comprises a mobile chassis, a platform disposed over the mobile chassis and capable of raising and lowering vertically, a lifting mechanism disposed between the mobile chassis and the platform and composed of three hydraulic stretchable mechanisms capable of stretchable in three stages and connected to each other at the central portions thereof so as to be turned in an X-shape, characterized in that each hydraulic stretchable mechanism is composed of hydraulic cylinder body having a large diameter, a large rod to be inserted into the hydraulic cylinder body and a small rod to be inserted into the hydraulic cylinder body wherein a central stretchable mechanism has a large rod connected to one end of the surface of the mobile chassis and a small rod connected to another end of the lower surface of the platform while side stretchable mechanisms intervening the central stretchable mechanism have large rods connected to other ends of the surface of the mobile chassis and small rods connected to one end of the lower surface of the platform.

The above and other objects, features and advantages of the present invention will become more apparent from the following description taken in conjunction with the accompanying drawings.

DESCRIPTION OF THE PREFERRED EMBODIMENT

First Embodiment (FIGS. 1 to 9)

Figure 1:
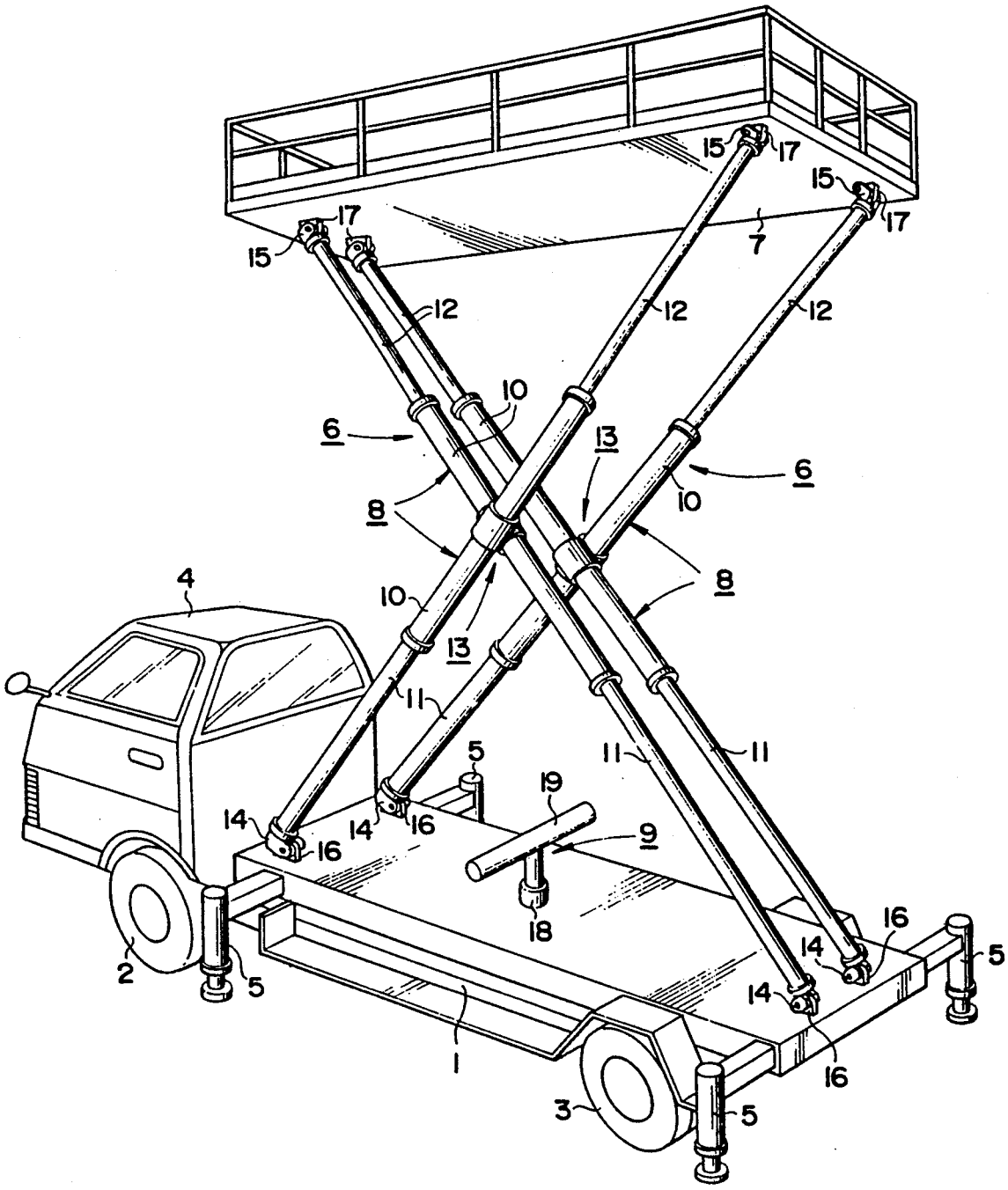
FIG. 1 is a perspective view showing a lifting apparatus according to a first embodiment of the present invention, wherein a platform, a constituent of the first embodiment of the present invention, is raised at its uppermost position.
Figure 2:
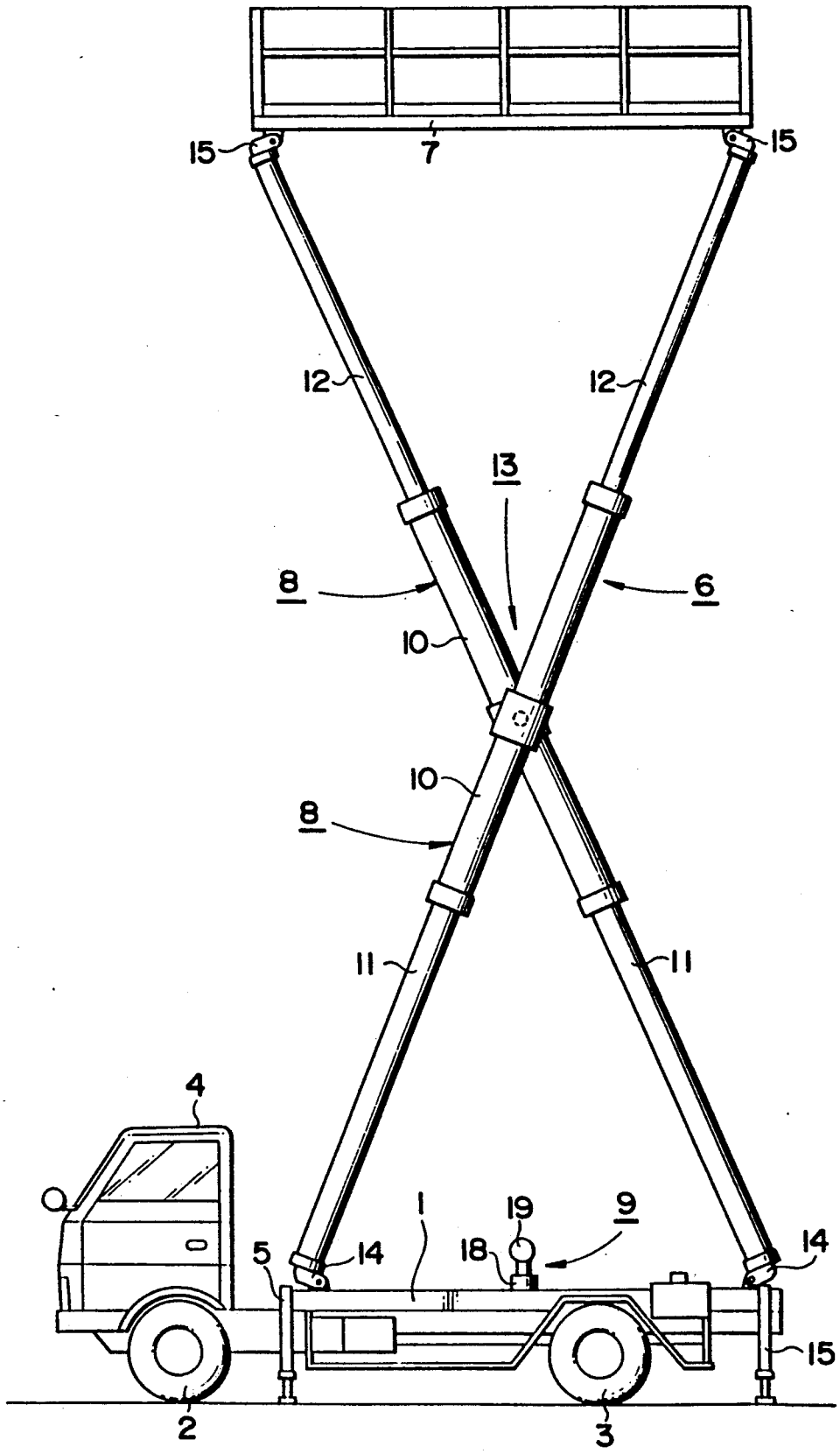
FIG. 2 is a side view of the lifting apparatus of FIG. 1.
Figure 3:
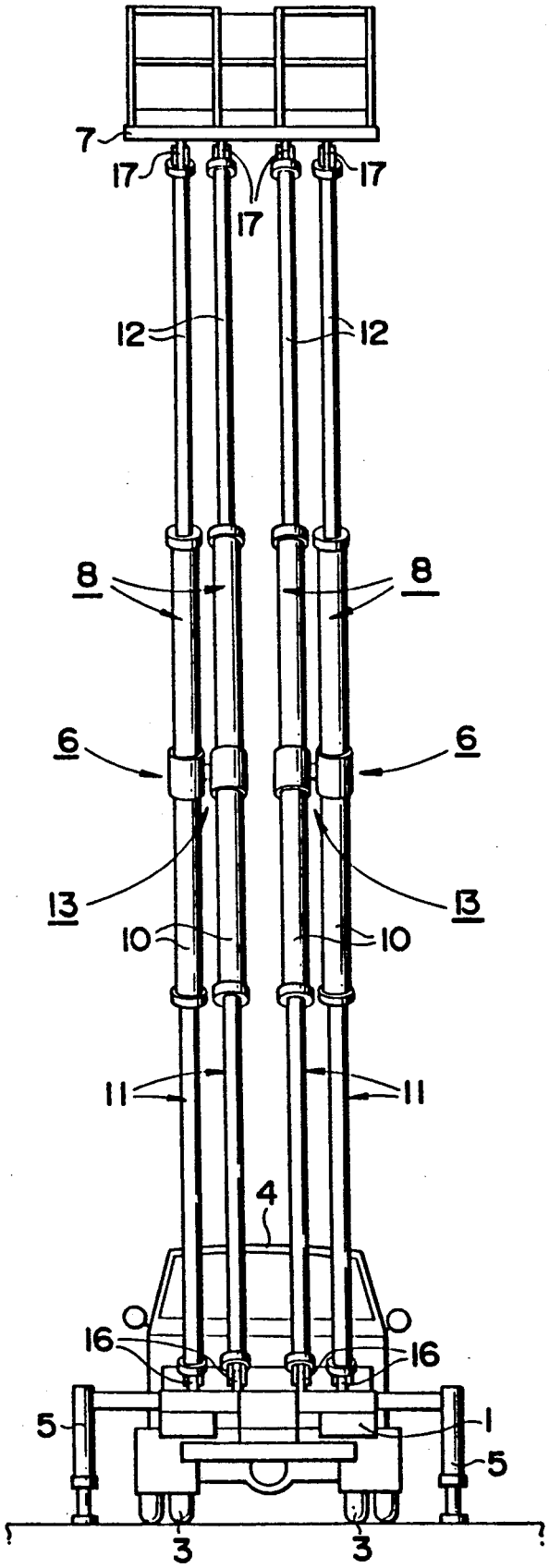
FIG. 3 is a rear view of the lifting apparatus of FIG. 1.

A lifting apparatus according to a first embodiment of the present invention will be described with reference to FIGS. 1 to 9.

The lifting apparatus comprises a mobile chassis 1 having front wheels 2 and rear wheels 3 supported thereon, a cabin 4 over the front wheels 2 for accommodating a driver's seat therein, outriggers 5 fixed to the central and rear portions of the chassis 1 at the right and left sides thereof for fixing the chassis 1 to the ground. A lifting mechanism 6 is placed on the upper surface of the chassis 1 and a platform 7 which is movable vertically is positioned over the lifting mechanism 6 and a kick mechanism 9 is attached to the central upper portion of the lifting mechanism.

Two paired lifting mechanisms are provided according to the first embodiment of the present invention. Each of the lifting mechanisms comprises a pair of hydraulic stretchable mechanisms 8 which define two cylinder bodies 10, lower rods 11 inserted from the lower rods of the cylinder bodies 10, upper rods 12 inserted from the upper ends of the cylinder bodies 10 and a connection mechanism 13 for connecting the central portions of the cylinder bodies 10 so as to be turned freely. Inner side surfaces of a pair of cylinder bodies 10 are pivoted in X-shape at the central portions thereof to be turned freely by the connection mechanism 13. The lower rods 11 have connection pieces 14 at the lower ends thereof while the upper rods 12 have connection pieces 15 at the upper ends thereof. The connection pieces 14 of the lower rods 11 are pivotally connected to four fixed pieces 16 fixed to the front and rear portions of the mobile chassis 1 at right and left sides of the upper surface thereof while the connection pieces 15 are pivotally connected to four fixed pieces 17 fixed to front and rear portions of the platform 7 at right and left sides of the lower surface thereof. Intervals between the fixed pieces 16 and 16 are same as those of the fixed pieces 17 and 17 so that the mobile chassis 1 and the platform 7 are kept parallel with portion of the upper surface of the chassis 1 and at the middle portion between the fixed pieces 16 and 16. The kick mechanism 9 comprises a hydraulic cylinder 18 capable of vertically extending and a pushing body 19 fixed at the upper end of the hydraulic cylinder 18 and extending at a right angle relative to the longitudinal direction of the hydraulic cylinder bodies 10 so as to contact the central lower surfaces of the cylinder bodies 10.

The cylinder body 10 will be described more in detail with reference to FIGS. 5 and 6.

The cylinder body 10 comprises an outer case 21, a middle case 22 and an inner case 23. The outer case 21 has an inner diameter greater than an outer diameter of the lower rod 11 while the middle case 22 has an outer diameter less than an inner diameter of the lower rod 11. The upper rod 12 has an outer diameter slightly less than an inner diameter of the middle case 22 while the inner case 23 has an outer diameter less than an inner diameter of the upper rod 12. Accordingly, as shown in FIG. 6, the outer case 21, the lower rod 11, the middle case 22, the upper rod 12 and the inner case 23 are arranged concentrically and the outer and inner diameters thereof can be varied little by little. There are defined gaps between the intervals between the elements.

A disk shaped end ring 24 is fixed to a lower portion of the outer case 21 (left side in FIG. 5) and a slide ring 25 is brought into contact with the left side of the end ring 24 and both the end ring 24 and the slide ring 25 are fixed to each other by screws 26. The end ring 24 has an inner diameter substantially same as that of the outer case 21 while the slide ring 25 has an inner diameter substantially same as the outer diameter of the lower rod 11. The lower rod 11 can slide while it is brought into contact airtightly with an inner peripheral surface of the slide ring 25. A disk shaped end ring 27 is fixed to an upper portion of the outer case 21 (right side in FIG. 5) and a slide ring 28 is brought into contact with the right side of the end ring 27 and both the end ring 24 and the slide ring 25 are brought into contact with and fixed to each other. The end ring 27 has an inner diameter substantially same as that of the middle case 22 while the slide ring 28 has an inner diameter substantially same as the outer diameter of the upper rod 12. The upper rod 12 can slide while it is brought into contact airtightly with an inner peripheral surface of the slide ring 28. An end ring 29 having an outer diameter substantially same as that of the middle case 22 and an inner diameter substantially same as that of the inner case 23 is brought into contact airtightly with the left end of the middle case 22. A slide ring 30 is fixed to the left end of the end ring 29 by a screw 31. The slide ring 30 has an outer diameter substantially same as the inner diameter of the lower rod 11. The lower rod 11 can slide while it is brought into airtightly contact with the outer peripheral surface of the slide ring 30. An end ring 32 having an outer diameter substantially same as the outer diameter of the inner case 23 is fixed to the right end of the inner case 23. A slide ring 33 is brought into contact with the right side of the end ring 32. The end ring 32 and the slide ring 33 are fixed to each other by screws 34. The slide ring 33 has an outer diameter substantially same as the inner diameter of the upper rod 12. The upper rod 12 can slide while it is brought into airtight contact with the slide ring 33.

With such an arrangement, there are defined two spaces concentrically in the cylinder body 10 by the outer case 21, the middle case 22 and the inner case 23. A ring shaped piston ring 35 is inserted into the space between the outer case 21 and the middle case 22 while it can slide airtightly into a cylindrical space defined by the outer case 21 and the middle case 22. The lower rod 11 is fixed to the left side of the piston ring 35 at the upper end thereof. A ring shaped piston ring 36 is inserted into the space between the middle case 22 and the inner case 23 while it can slide airtightly into a cylindrical space defined by the middle case 22 and the inner case 23. The upper rod 12 is fixed to the right side of the piston ring 36 at the lower end thereof.

There are defined a plurality of communication holes 37 around the upper end periphery of the lower rod 11 for flowing the oil under pressure therethrough while there are defined a plurality of communication holes 38 around the lower end periphery of the upper rod 12 for flowing the oil under pressure therethrough. There are defined a plurality of fluid holes 39 around the left end periphery of the middle case 22 for communicating with the spaces between the outer case 21 and the middle case 22 and between the inner case 23 and the middle case 22. There are defined two oil passage holes 40 and 41 around the outer peripheral surface of the end ring 27. One oil passage hole 40 communicates with a space defined between the outer case 21 and middle case 22 while the other oil passage 41 communicates with a space defined between the middle case 22 and the inner case 23.

Figure 6:
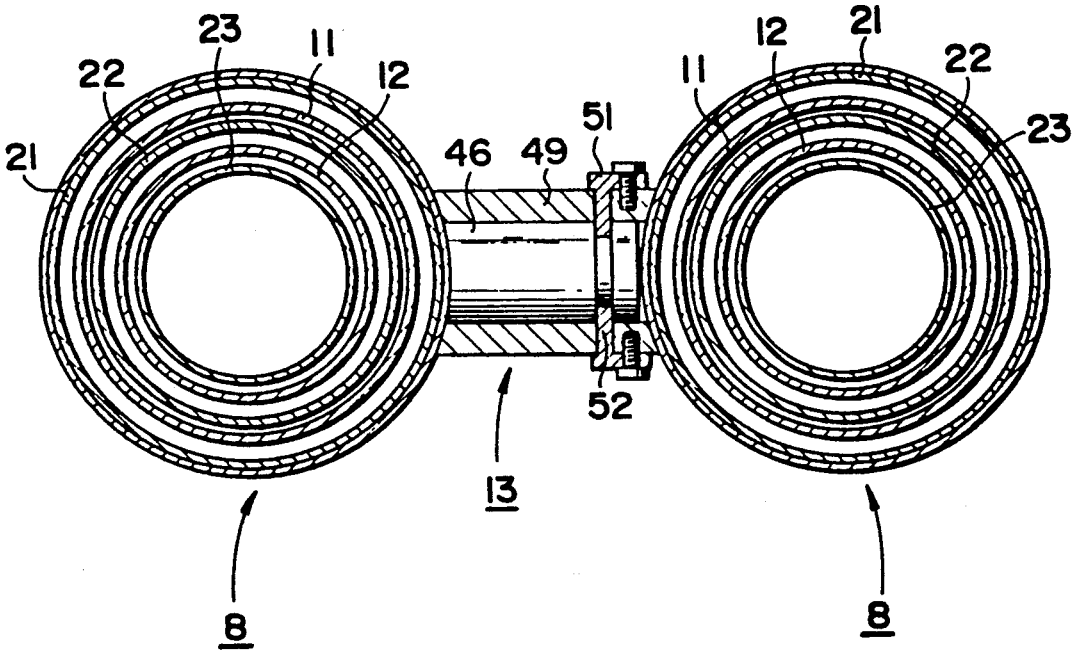
FIG. 6 is a longitudinal sectional view of the internal structure of FIG. 5.
Figure 7:
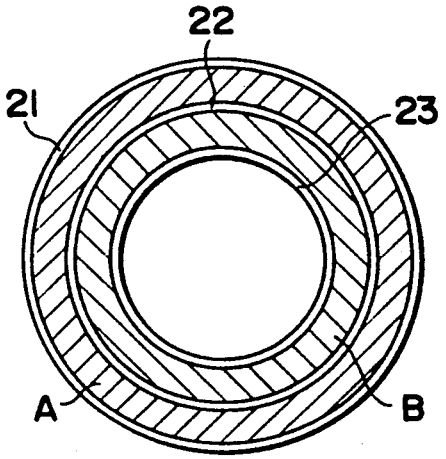
FIG. 7 is a cross sectional view of assistance in explaining internal structure of cylinder chambers defined in the bodies, constituents of the first embodiment of the present invention.

As set forth above, there are airtight spaces in the cylinder body 10 partitioned in two layers defined between the outer and inner peripheral surfaces of the outer case 21, the middle case 22 and the inner case 23, i.e. one defined between the outer case 21 and the middle case 22 and the other defined between the middle case 22 and the inner case 23 cross sectional of which are illustrated in FIG. 6. FIG. 7 shows the relationship between a cross section A defined by the outer case 21 and the middle case 22 and a cross section B defined between the middle case 22 and the inner case 23.

The outer case 21, the middle case 22 and the inner case 23 are arranged concentrically. The cross section A defined between the outer case 21 and the middle case 22 is adjustable to be same as the cross section B defined between the middle case 22 and the inner case 23.

Figure 8:
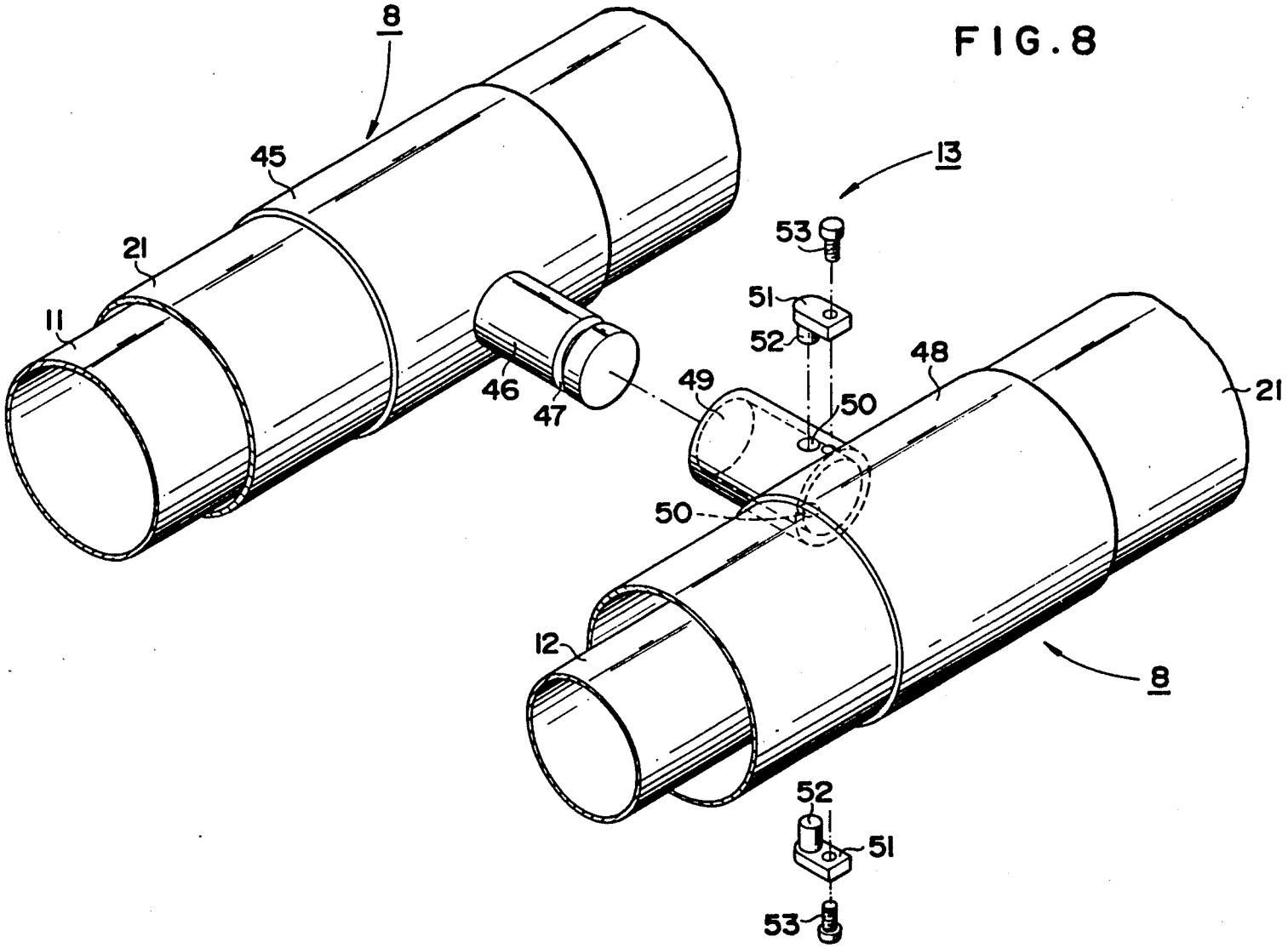
FIG. 8 is an exploded perspective view showing a connection mechanism for connecting two cylinder bodies.

The connection mechanism 13 will be described more in detail with reference to FIG. 8.

The connection mechanism 13 can connect two hydraulic cylinder bodies 10 at the central portions thereof in order to turn them freely and comprises two mechanisms which are paired and opposed with each other.

One connection mechanism comprises a fixing band 45 wound around a central portion of one cylinder body 10 like a belt and a cylindrical rotary shaft 46 fixed at the side surface of the fixing band 45 which protrudes from the fixing band 45 and extends at a right angle relative to the axial direction of the cylinder body 10.

The rotary shaft 46 has an engaging groove 47 defined by cutting and encircling a tip end of the rotary shaft 46. Another connection mechanism comprises a fixing band 48 wound around a central portion of another cylinder body 10 so as to encircle thereof and a cylindrical rotary shaft 49 fixed at the side surface of the fixing band 48 which protrudes from the fixing band 49 and extends at a right angle relative to the axial direction of the cylinder body 10. The rotary shaft 49 has an inner diameter substantially same as an outer diameter of the rotary shaft 46 and the rotary shaft 46 is inserted into the rotary shaft 49 so that two cylinder bodies 10 can turn relative to each other. The rotary shaft 49 has pin holes 50 at the upper and lower portions adjacent to the root thereof. Pins 52 fixed to engaging bodies 51 are inserted into the pin holes 50 and engageable in the engaging groove 47 of the rotary shaft 46. The engaging bodies 51 are fixed to the rotary shaft 49 by screws 53.

Figure 9:
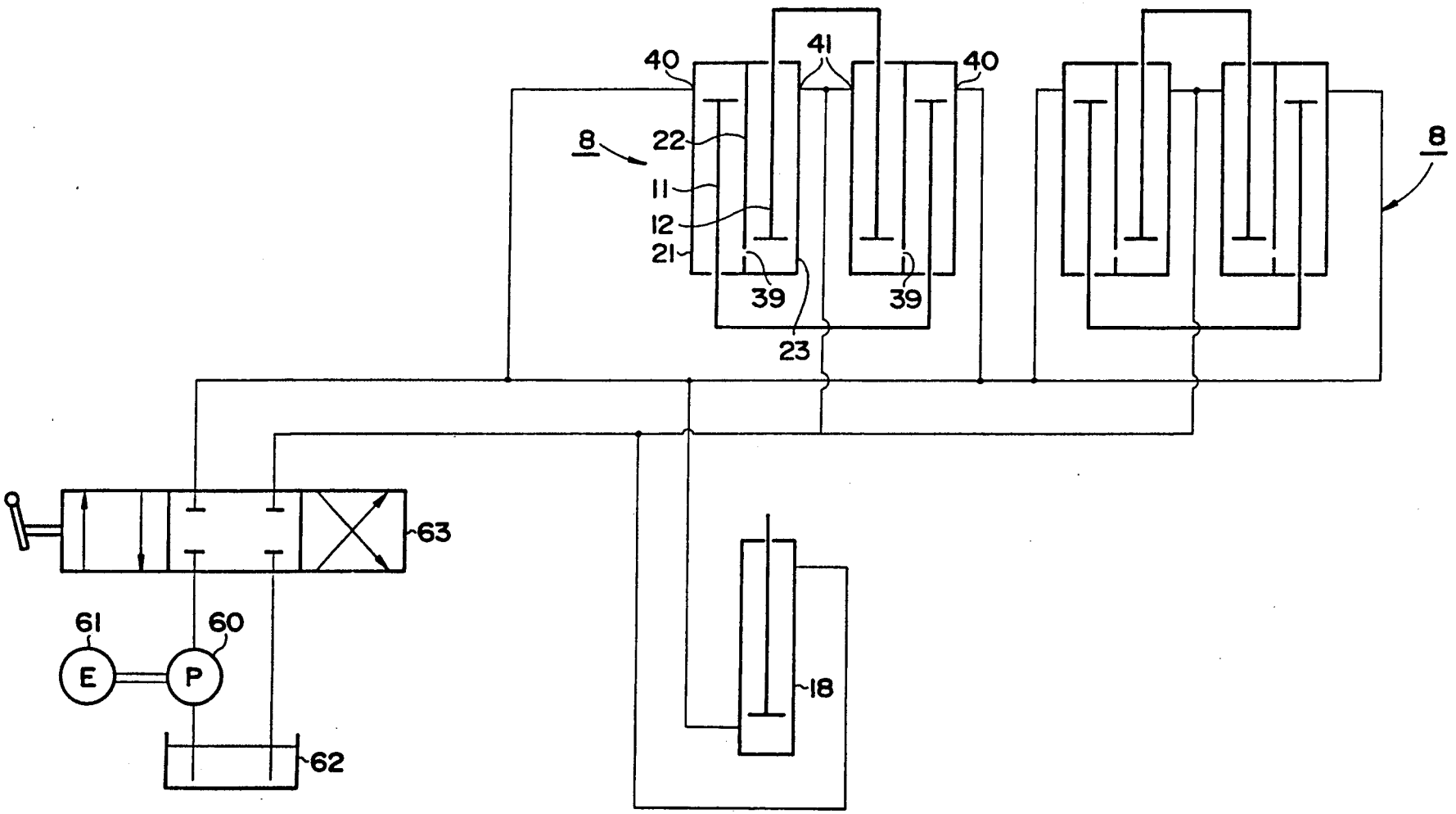
FIG. 9 is a piping diagram showing a hydraulic circuit according to the first embodiment of the present invention.

The hydraulic circuit will be described with reference to FIG. 9.

A hydraulic pump 60 is driven by an engine 61 and has a suction side communicating with an oil tank 62 and a discharge side connected to a three-directional selector valve 63. The selector valve 62 is connected to one oil passage hole 40 and to the hydraulic cylinder 18 at one side thereof while the selector valve 62 is connected to another oil passage hole 41 and to the discharge side of the hydraulic cylinder 18 at the other side thereof.

An operation of the lifting apparatus according to the first embodiment of the present invention will be described hereinafter.

Figure 4:
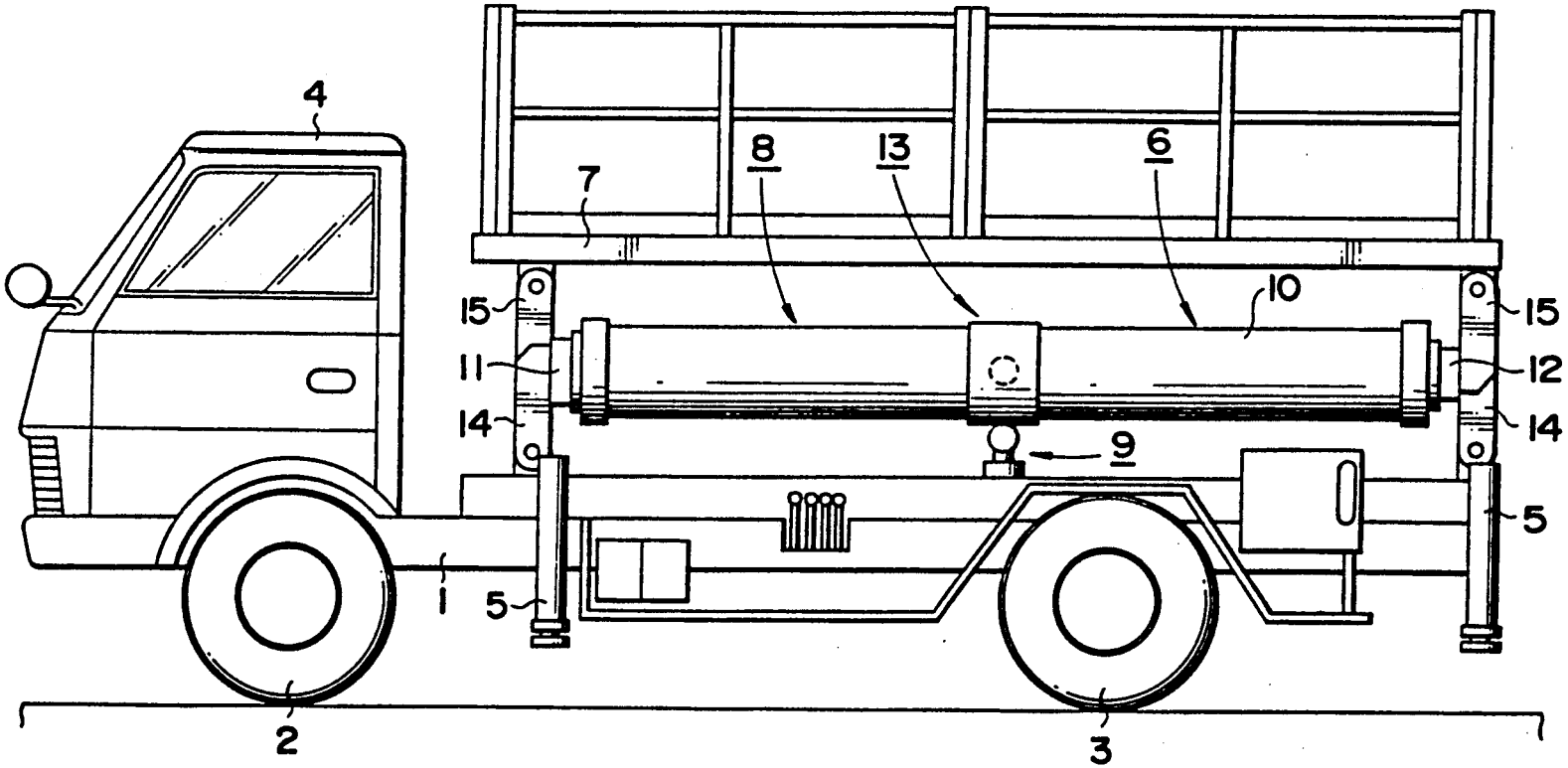
FIG. 4 is a side view showing the lifting apparatus wherein the platform is lowered at its lowermost position.

An engine 61 attached to the chassis 1 is actuated so as to raise the platform 7 so that the oil pump 62 is driven to suck the oil for generating oil under pressure. Thereafter, the selector valve 63 is operated for supplying the oil under pressure to the oil passage hole 40. The oil under pressure supplied to the oil passage hole 40 is then supplied to a ring shaped cylinder chamber C defined between the outer case 21 and the middle case 22. The oil under pressure supplied to the cylinder chamber C increases the pressure in the cylinder chamber C so that the piston ring 35 is pulled out leftward in FIG. 5 and the lower rod 11 is pulled out leftward from the cylinder body 10. However, when the platform 7 is positioned at the lowermost position as illustrated in FIG. 4, the cylinder body 10, the lower rod 11 and the upper rod 12 are respectively arranged in parallel with each other, hence no component force is generated in the direction to turn in the X-shape about the connection mechanism 13 whereby the platform 7 is not raised. Since the oil under pressure is also supplied to the hydraulic cylinder 18 by the operation of the selector valve 63 so that the hydraulic cylinder 18 is operated to raise the pushing body 19 upward. The pushing body 19 contacts the central lower surfaces of the cylinder bodies 10 and raises the cylinder bodies 10 to cause them to be formed slightly in the X-shape. With the operation of the kick mechanism 9, the lifting mechanism 6 is varied from the state where the four cylinder bodies 10 are parallel with each other to the slightly collapsed X-shape.

In succession to the operations set forth above, the oil under pressure supplied from the oil passage 40 to the cylinder body 10 pushes the piston ring 35 for thereby pushing down the lower rod 11 from the left end of the slide ring 25 so that the length of the cylinder body 11 is gradually lengthened. Accompanied by the movement of the piston ring 35, the oil under pressure supplied to cylinder chamber D defined between the outer case 21 and the middle case 22 flows through the fluid hole 39 and enters into a cylinder chamber E defined between the inner case 23 and the middle case 22. When the oil under pressure is introduced into the cylinder chamber E, the piston ring 36 is pushed rightward in FIG. 5 and the upper rod 12 is pushed rightward accompanied by the movement of the piston ring 36 so that the upper rod 12 further moves rightward from the right end of the slide ring 28.

In such a manner, the upper and lower rods 12 and 11 are pulled out from the both ends of the cylinder body 10 rightward and leftward so that the distances between the connection pieces 14 and 15 are gradually increased. Accompanied by the rightward movement of the piston ring 36, the oil under pressure in a cylinder chamber F defined between the middle case 22 and the inner case 23 is discharged from the oil passage hole 41 and returned to the oil tank 62 through the selector valve 63.

Although the lifting mechanism 6 assembled in three stages by the extension of the lower rods 11 and the upper rods 13 is lengthened at the entire length thereof, when the entire length of the lifting mechanism 6 is lengthened the lengthened direction is decomposed in the upward direction since the tip ends of the lower rods 11 and the upper rods 12 are fixed to the fixing pieces 16 fixed to the mobile chassis 1 and the fixing pieces 17 fixed to the platform 7. As a result, the platform 7 is gradually raised upward. At this time, since the pair of cylinder bodies 10 and 10 are connected by the rotary shafts 46 and 49, the pair of cylinder bodies 10 and 10 are turned about the rotary shaft 46 to be formed in the X-shape so that the platform 7 is raised.

When the platform 7 is raised at a given position, the selector valve 63 is switched to "middle position" so that the oil under pressure is stopped to be supplied to the oil passage hole 40 and the piston rings 35 and 36 are kept positioned where the oil under pressure is stopped, hence the platform 7 is kept positioned at the same level.

Figure 5:
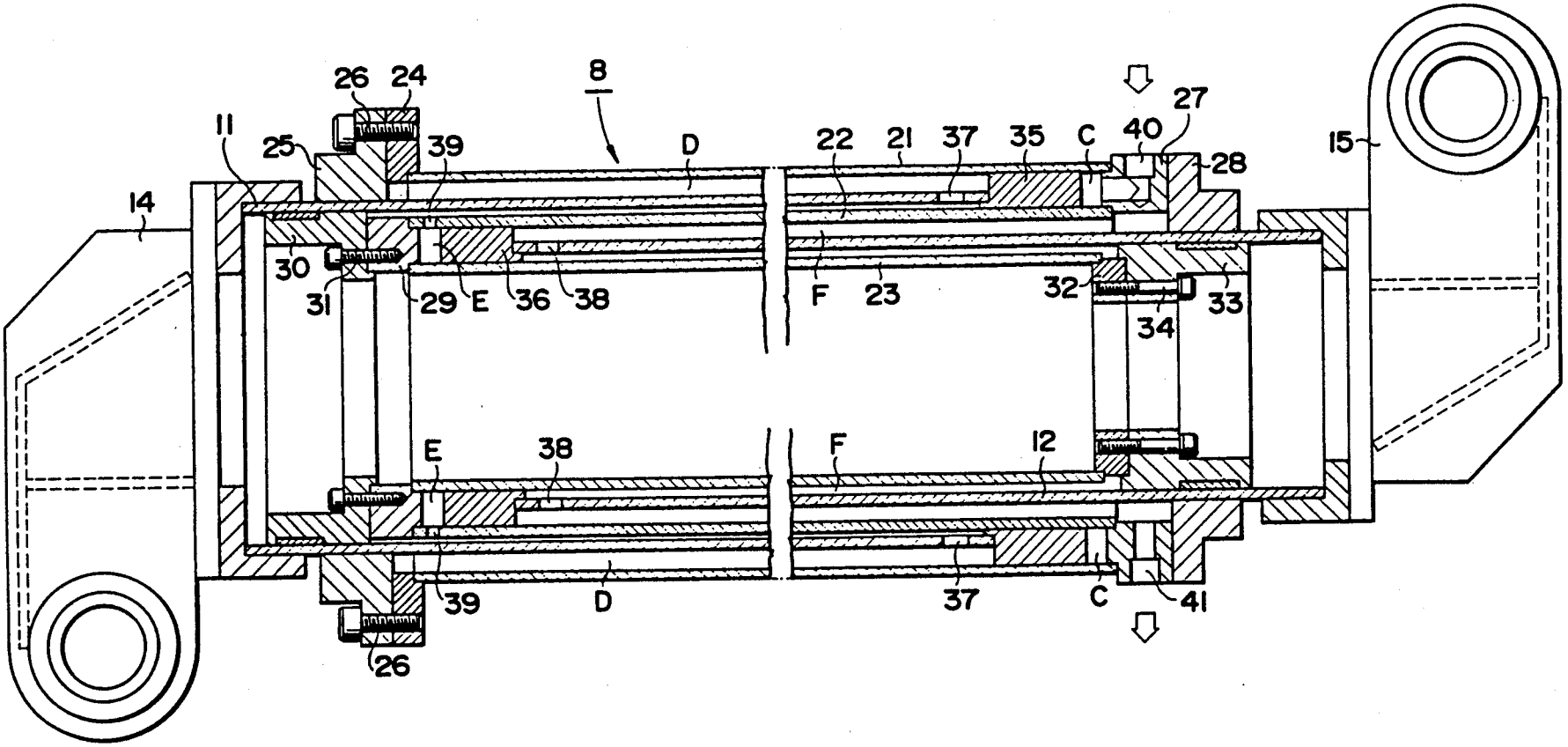
FIG. 5 is a side cross sectional view showing an internal structure of a lifting mechanism, a constituent of the first embodiment of the present invention.

When the platform is lowered, the selector valve is switched to "backward position" so that the oil under pressure is supplied to the oil passage hole 41, thereby moving the piston ring leftward in FIG. 5. Successively, the upper rod 12 is moved in the direction of the inside of the cylinder body 10 and at the same time the oil under pressure is introduced into the cylinder chamber D, thereby pushing the piston ring 35 rightward in FIG. 5 and pulling the lower rod 11 inside the cylinder body 10. As a result, the interval between the lower end of the lower rod 11 and the upper end of the upper rod 12 is decreased so that the platform 7 is gradually lowered.

The oil under pressure residue in the cylinder chamber D is discharged through the oil passage hole 40 and returned to the oil tank 62.

With the arrangement of the lifting apparatus according to the first embodiment of the present invention, the lifting mechanism can be composed of a plurality of hydraulic cylinder bodies which entails the very simple structure. Furthermore, it is possible to manufacture the lifting mechanism with ease and the maintenance thereof becomes very simple due to elimination of the synchronous mechanism such as the chains for synchronizing the lower rod with the upper rod relative to the cylinder body 10.

Second Embodiment (FIGS. 10 to 16)

A lifting apparatus according to a second embodiment of the present invention will be described with reference to FIGS. 10 to 16.

An arrangement of the lifting apparatus according to the second embodiment is substantially same as that of the first embodiment except the lifting mechanism. Hence, the arrangement of the lifting apparatus will be described mainly in respect of the lifting mechanism and a hydraulic circuit for operating the lifting mechanism.

Each lifting mechanism 206 comprises a pair of hydraulic stretchable mechanism s 208. The hydraulic stretchable mechanism 208 comprises a cylinder body 210 having a large diameter (hereinafter referred to as cylinder body), a large rod 211 inserted telescopically into and stretchable from the one end of the cylinder body 210 and a small rod 212 inserted telescopically into and stretchable from the other end of the cylinder body 210 and a connection mechanism 213 for connecting the central portions of the cylinder bodies 210.

Figure 10:
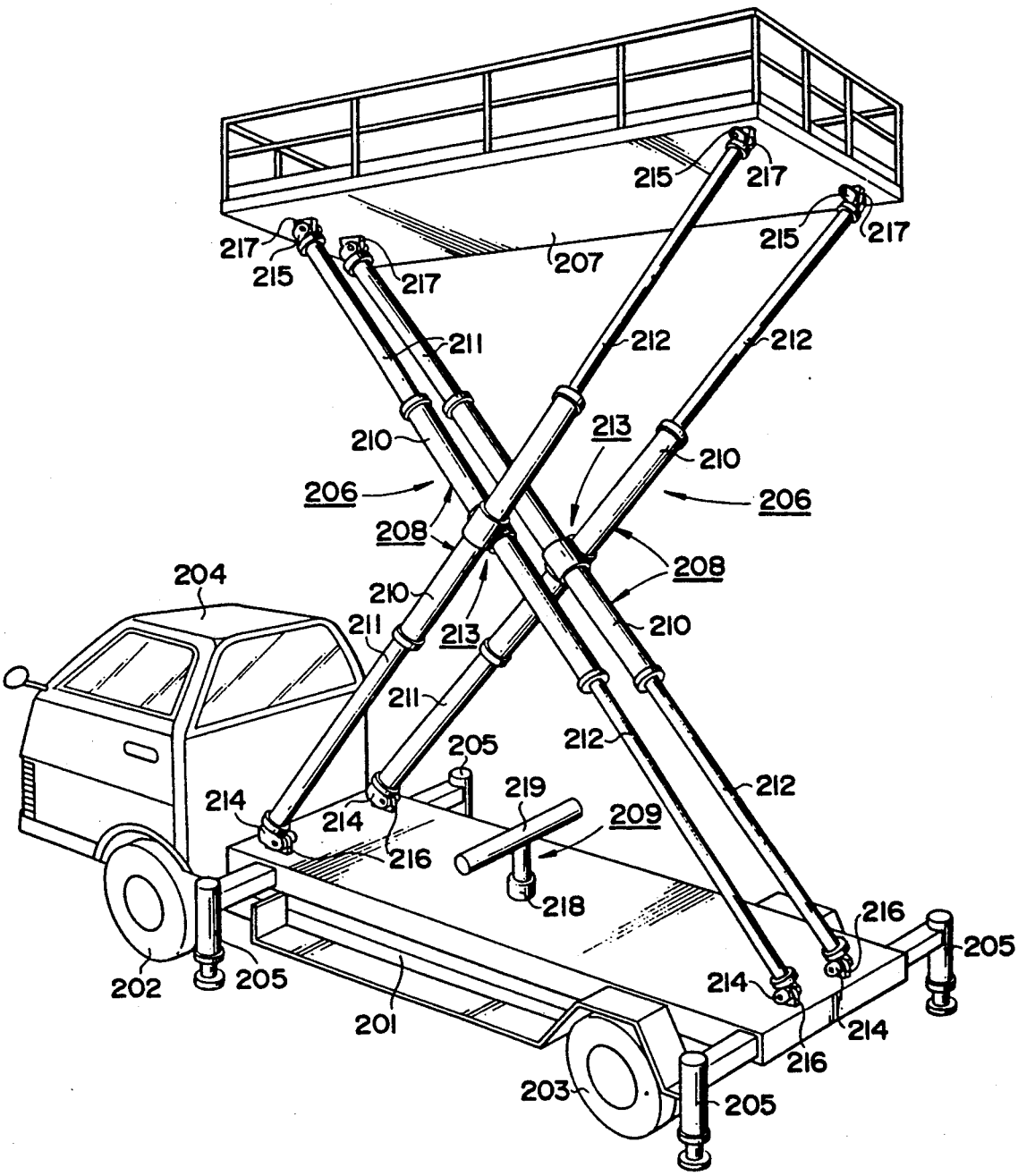
FIG. 10 is a perspective view showing a lifting apparatus according to a second embodiment of the present invention, wherein a platform, a constituent of the second embodiment of the present invention, is raised at its uppermost position.
Figure 11:
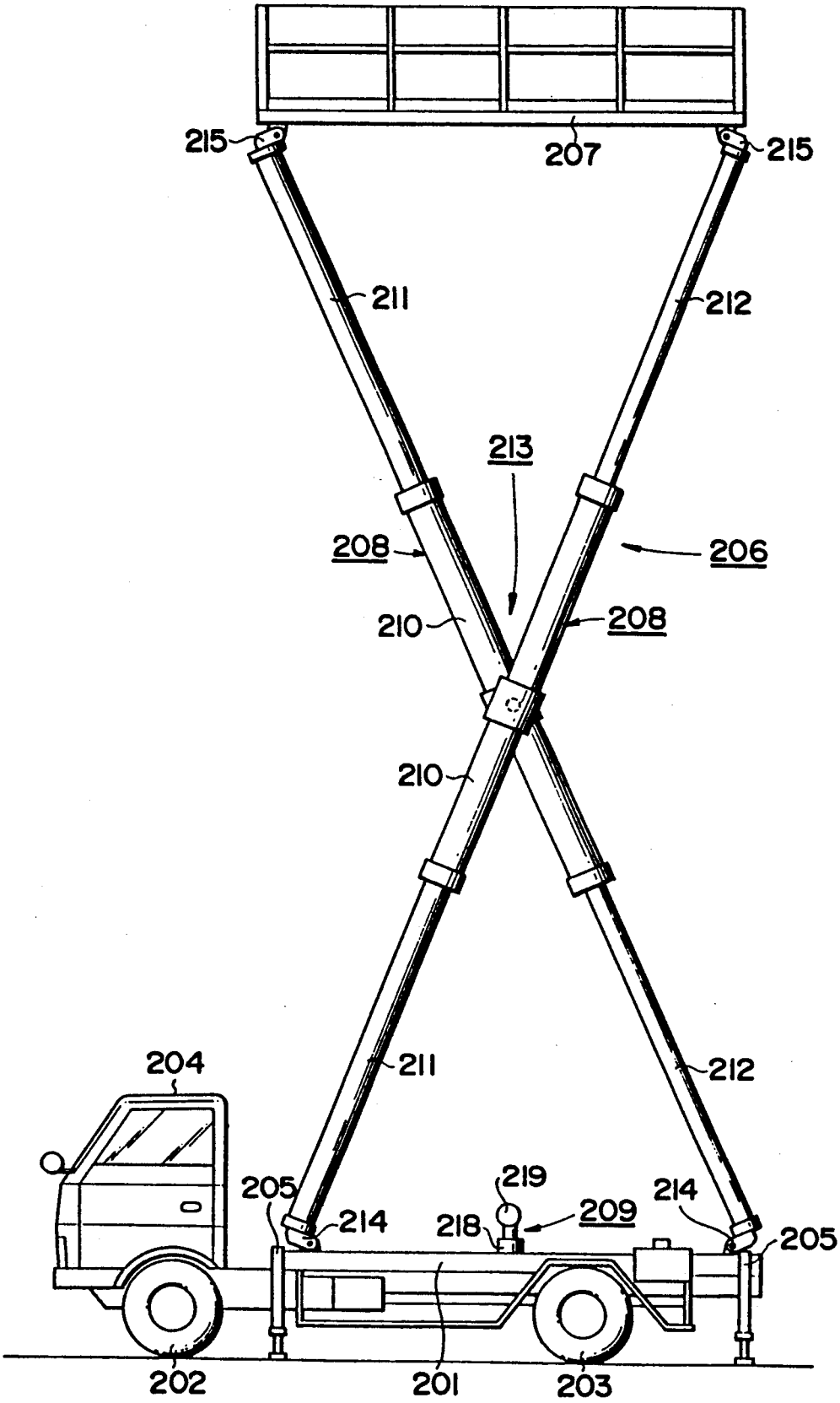
FIG. 11 is a side view of the lifting apparatus of FIG. 10.
Figure 12:
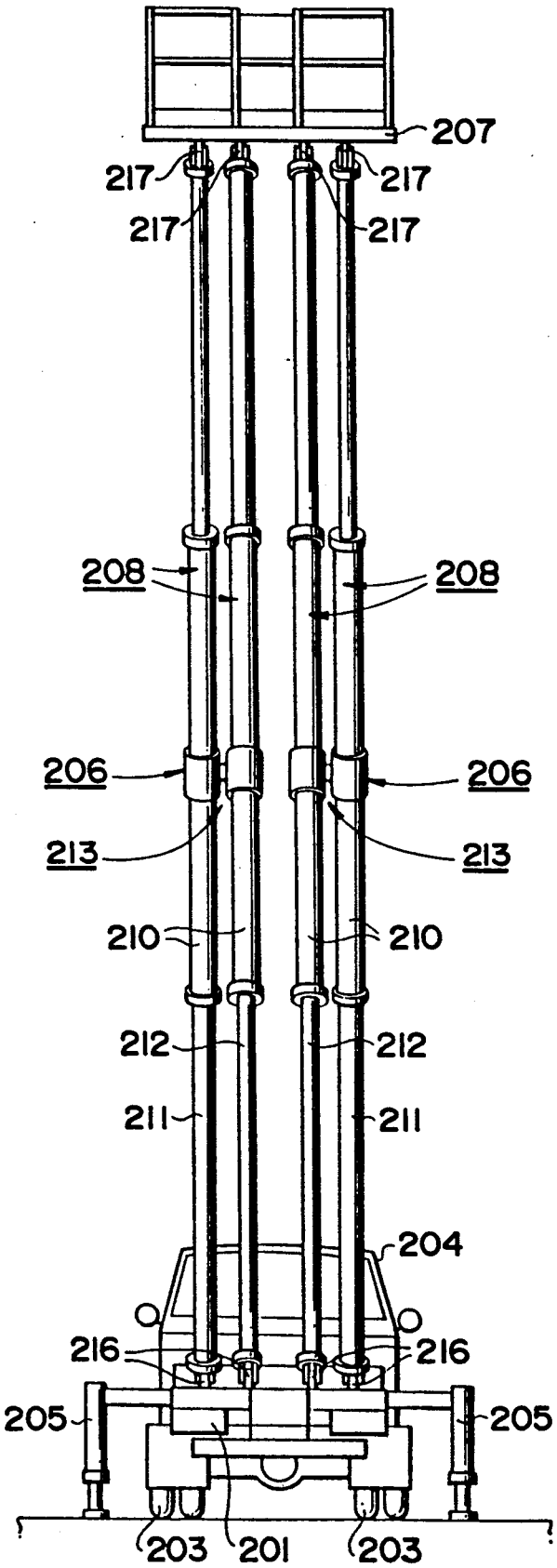
FIG. 12 is a rear view of the lifting apparatus of FIG. 10.

Although the cylinder body 210, the large rods 211 and the small rods 212 of one pair of hydraulic stretchable mechanisms 208 composed of a pair of lifting mechanisms 206 are same as those of another pair of hydraulic stretchable mechanisms 208 in the shapes and sizes thereof, the large rods 211 and the small rods 212 of one pair are connected to the chassis 201 and the platform 207 while those of the another pair are connected to the platform 207 and the chassis 201, i.e. the large rods 211 and the small rods 212 of one pair are connected to the chassis 201 and the platform 207 opposite to those of another pair, as illustrated in FIGS. 10 to 12.

Figure 13:
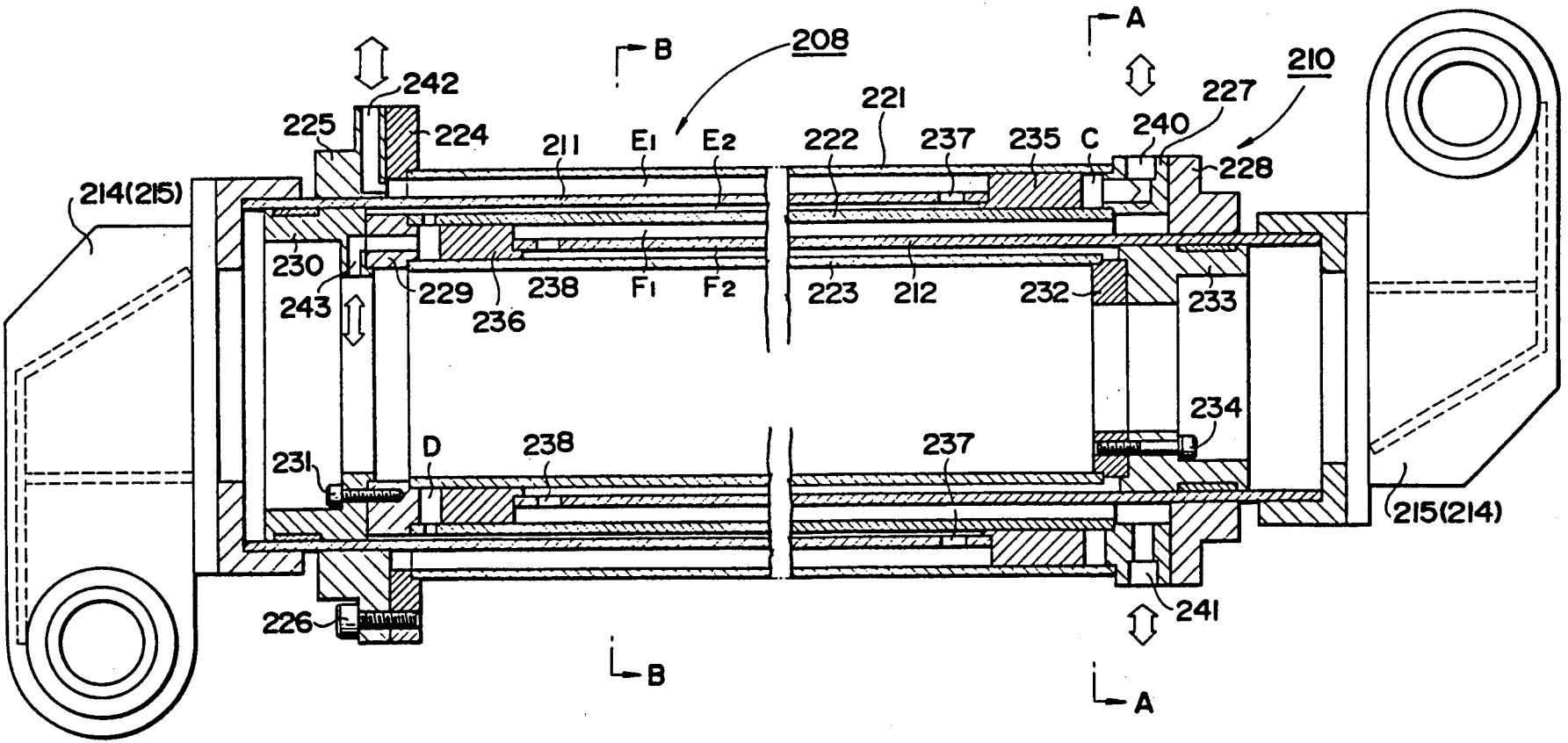
FIG. 13 is a side cross sectional view showing an internal structure of a lifting mechanism, a constituent of the second embodiment of the present invention.
Figure 14:
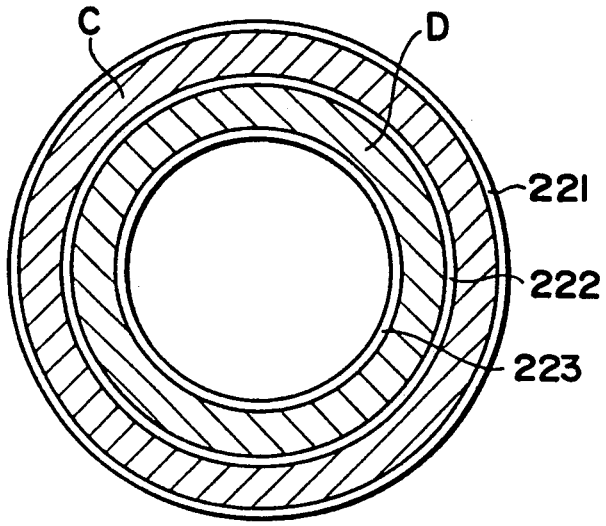
FIG. 14 is a cross sectional view taken along the arrows A—A of FIG. 13.
Figure 15:
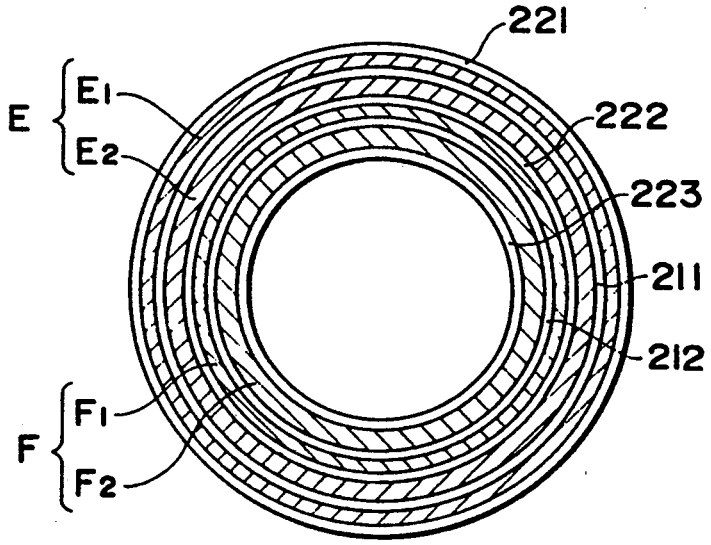
FIG. 15 is a cross sectional view taken along the arrows B—B of FIG. 13.

The hydraulic stretchable mechanism 208 will be described more in detail with reference to FIG. 13.

The cylinder body 210 in the stretchable mechanism 208 comprises an outer case 221, a middle case 222 and an inner case 223. The outer case 221 has an inner diameter greater than an outer diameter of the large rod 211 while the middle case 222 has an outer diameter less than an inner diameter of the large rod 211. The small rod 212 has an outer diameter slightly less than an inner diameter of the middle case 222 while the inner case 223 has an outer diameter less than an inner diameter of the small rod 212. Accordingly, the outer case 221, the large rod 211, the middle case 222, the small rod 212 and the inner case 223 are arranged concentrically and the outer and inner diameters thereof can be varied little by little. There are defined gaps between the intervals between the elements.

A disk shaped end ring 224 is fixed to a lower portion of the outer case 221 (left side in FIG. 13) and a slide ring 225 is brought into contact with the left side of the end ring 224 and both the end ring 224 and the slide ring 225 are fixed to each other by screws 226. The end ring 224 has an inner diameter substantially same as that of the outer case 221 while the slide ring 225 has an inner diameter substantially same as the outer diameter of the large rod 211. The large rod 211 can slide while it is brought into contact airtightly with an inner peripheral surface of the slide ring 225.

A disk shaped end ring 227 is fixed to an upper portion of the outer case 221 (right side in FIG. 13) and a slide ring 228 is brought into contact with the right side of the end ring 227 and both the slide ring 228 and the end ring 227 are brought into contact with and fixed to each other. The end ring 227 has an inner diameter substantially same as that of the middle case 222 while the slide ring 228 has an inner diameter substantially same as the outer diameter of the upper rod 212. The small rod 212 can slide while it is brought into contact airtightly with an inner peripheral surface of the slide ring 228.

An end ring 229 having an outer diameter substantially same as that of the middle case 222 and an inner diameter substantially same as that of the inner case 223 is brought into contact airtightly with the left end of the middle case 222. A slide ring 230 is fixed to the left end of the end ring 229 by a screw 231. The slide ring 230 has an outer diameter substantially same as the inner diameter of the lower rod 211. The large rod 211 can slide while an inner wall thereof is brought into airtight contact with the outer peripheral surface of the slide ring 230. An end ring 232 having an outer diameter substantially same as the outer diameter of the inner case 223 is fixed to the right end of the inner case 223. A slide ring 233 is brought into contact with the right side of the end ring 232. The end ring 232 and the slide ring 233 are fixed to each other by screws 234. The slide ring 233 has an outer diameter substantially same as the inner diameter of the small rod 212. The small rod 212 can slide while an inner wall thereof is brought into airtight contact with the slide ring 233.

With such an arrangement, there are defined two spaces concentrically in the cylinder body 210 by the outer case 221, the middle case 222 and the inner case 223. A ring shaped piston ring 235 is inserted into the space between the outer case 221 and the middle case 222 while it can slide airtightly into a cylindrical space defined by the outer case 221 and the middle case 222. The large rod 211 is fixed to the left side of the piston ring 235 at the right side thereof. A ring shaped piston ring 236 is inserted into the space between the middle case 222 and the inner case 223 while it can slide airtightly into a cylindrical space defined by the middle case 222 and the inner case 223. The small rod 212 is fixed to the right side of the piston ring 236 at the left side thereof.

There are defined a plurality of communication holes 237 at the right end of the large rod 211 for flowing oil under pressure therethrough while there are defined a plurality of communication holes 238 at the left end of the small rod 212 for flowing oil under pressure therethrough. There are defined two oil passage holes 240 and 241 around the outer peripheral surface of the end ring 227. One oil passage hole 240 communicates with a chamber at the right of a space defined between the outer case 221 and middle case 222 while the other oil passage 241 communicates with a chamber at the right of a space defined between the middle case 222 and the inner case 223. There are also defined two oil passage holes 242 and 243 around the outer peripheral surface of the slide rings 225 and 230. One oil passage hole 242 communicates with a chamber at the left side of a space defined between the outer case 221 and middle case 222 while the other oil passage 243 communicates with a chamber at the left side of a space defined between the middle case 222 and the inner case 223.

As set forth above, there are airtight spaces in the cylinder body 210 partitioned in two layers defined between the outer and inner peripheral surfaces of the outer case 221, the middle case 222 and the inner case 223. Furthermore, these airtight spaces are partitioned by the piston rings 235 and 236 for forming four pressure chambers in total. These pressure chambers are divided into a cylinder chamber C defined by the outer case 221, the middle case 222 and the piston ring 235, a cylinder chamber D defined by the middle case 222, the inner case 223 and the piston ring 236, a cylinder chamber E1 defined by the outer case 221, the large rod 211 and the piston ring 235, a cylinder chamber E2 defined by the large rod 11, the middle case 222 and the piston ring 235, a cylinder chamber F1 defined by the middle case 222, the small rod 212 and the piston ring 236 and a cylinder chamber F2 defined by the small rod 212, the inner case 223 and the piston ring 236. Described hereinafter is a relationship between cross sectional areas of the cylinder chambers partitioned by the large rod 211, the small rod 212, the outer case 221, the middle case 222 and the inner case 223 with reference to FIGS. 14 and 15.

Inasmuch as the cylinder chambers E1 and E2 are communicated with the communication holes 237, the area to which the oil under pressure is added becomes the sum of the cross sectional areas of both the cylinder chambers E1 and E2. Similarly, since the cylinder chambers F1 and F2 are communicated with the communication holes 238, the area to which the oil under pressure is added becomes the sum of the cross sectional areas of both the cylinder chambers F1 and F2. The cross sectional areas of the cylinder chamber E is set to be equal to that of the cylinder chamber D.

Figure 16:
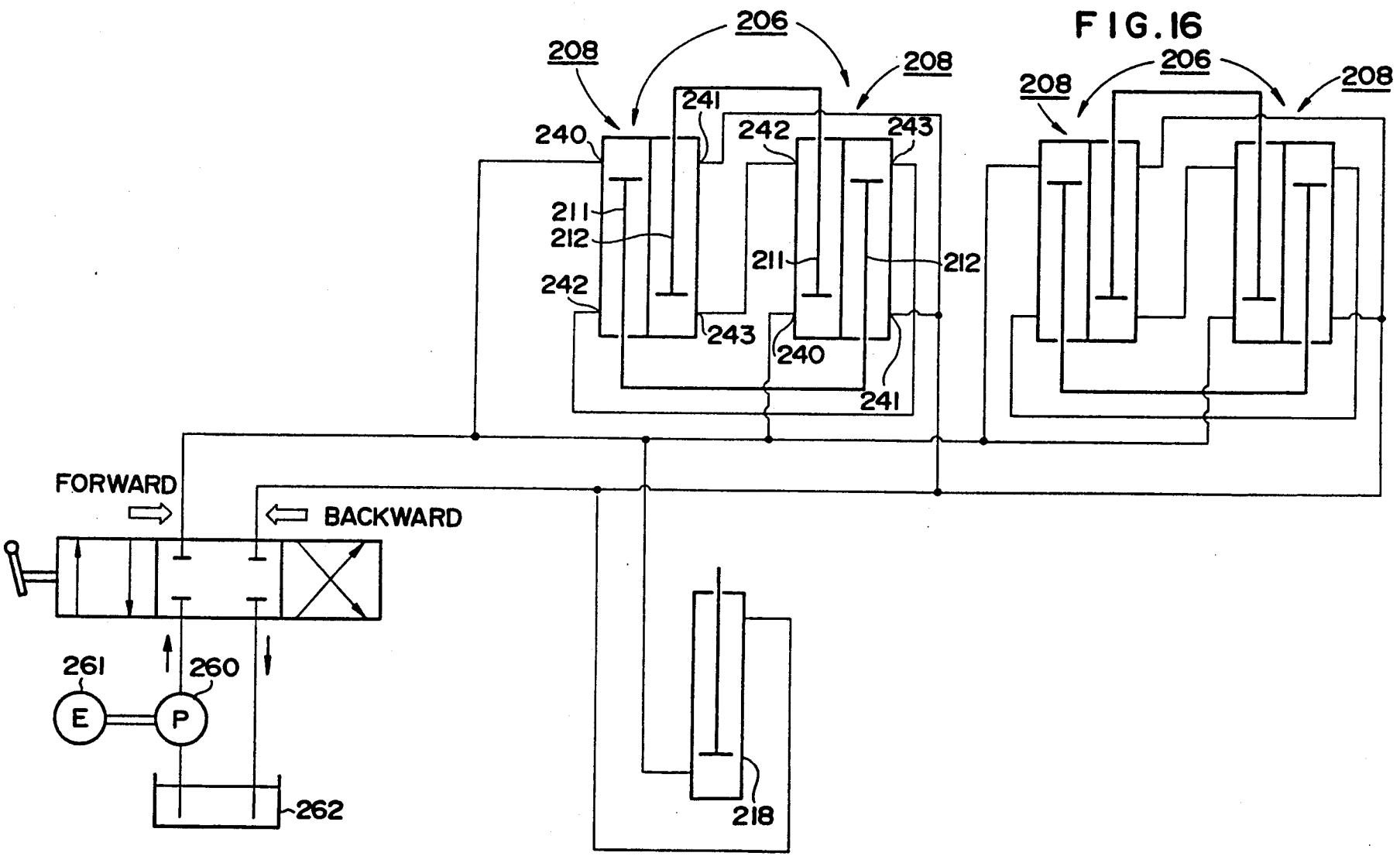
FIG. 16 is a piping diagram showing a hydraulic circuit according to the second embodiment of the present invention.
Figure 17:
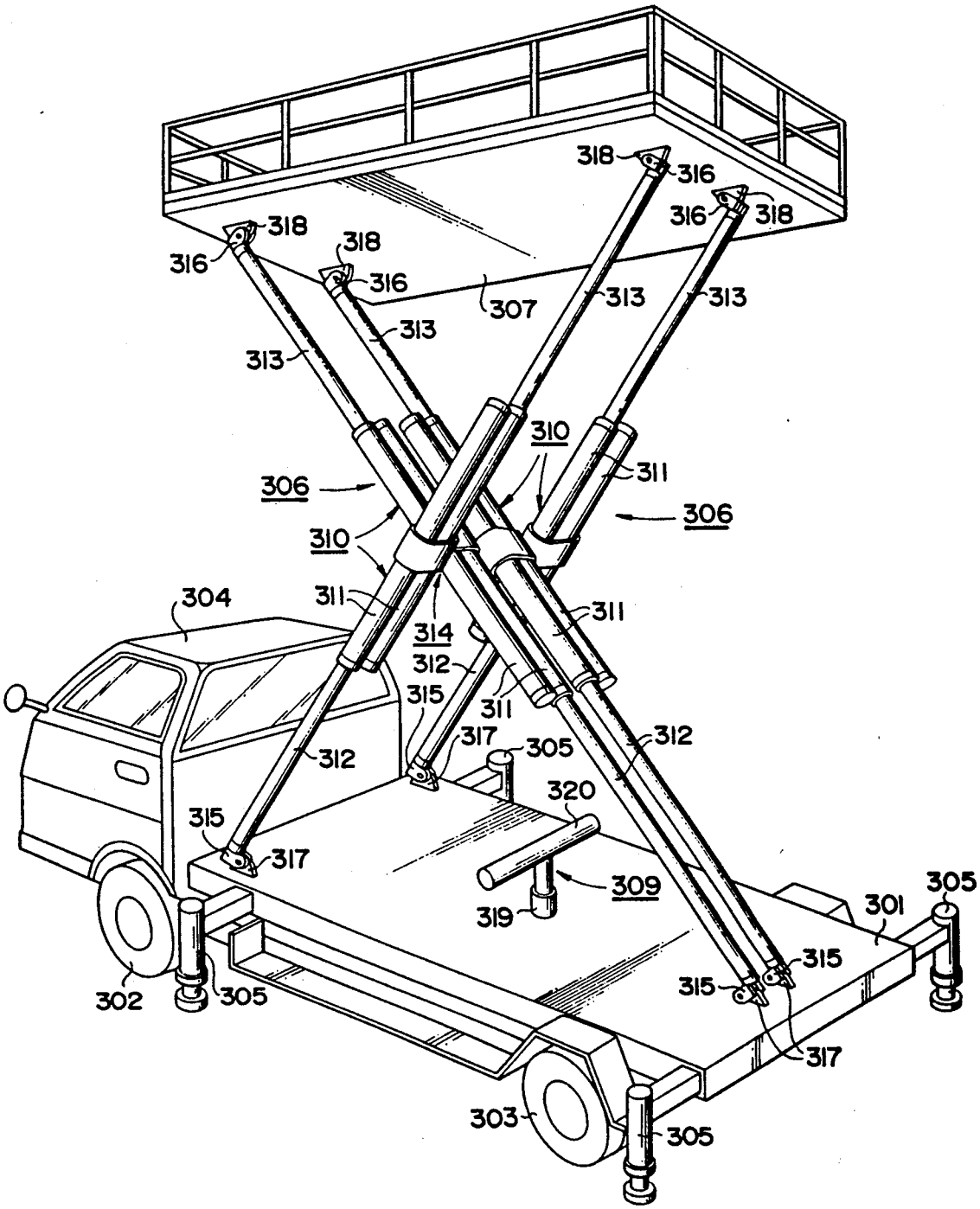
FIG. 17 is a perspective view showing a lifting apparatus according to a third embodiment of the present invention, wherein a platform, a constituent of the third embodiment of the present invention, is raised at its uppermost position.
Figure 18:
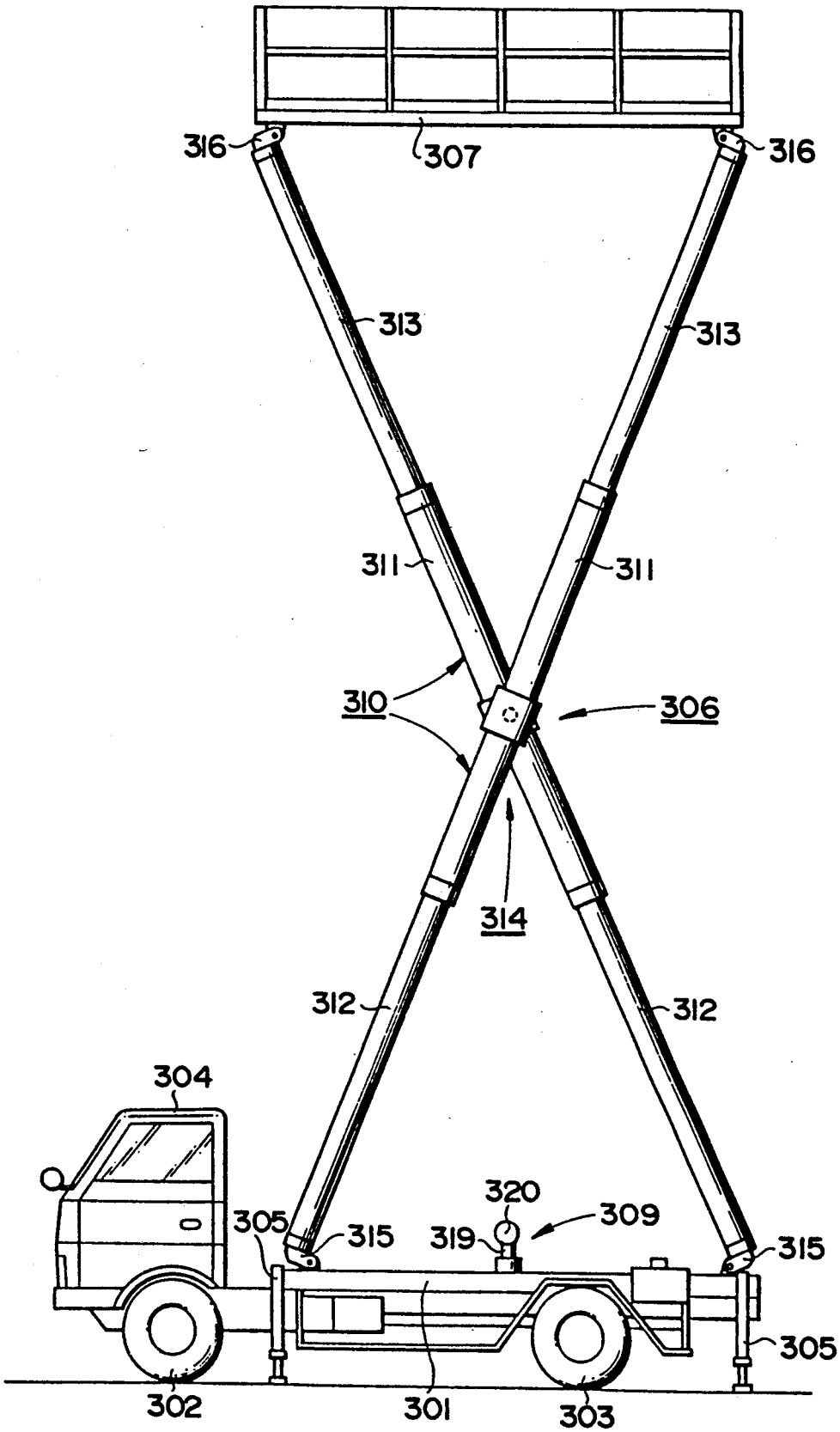
FIG. 18 is a side view of the lifting apparatus of FIG. 17.
Figure 19:
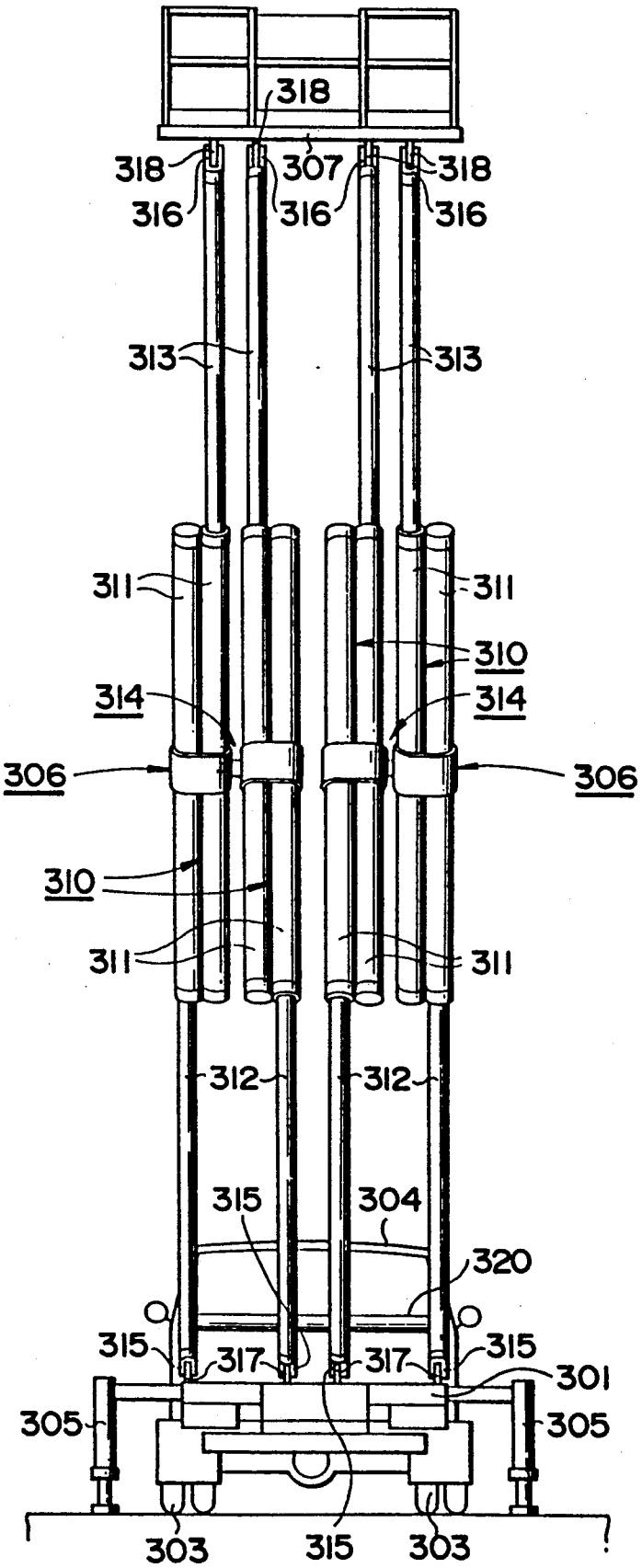
FIG. 19 is a rear view of the lifting apparatus of FIG. 17.

The hydraulic circuit of the lifting apparatus according to the second embodiment will be described with reference to FIG. 16.

A hydraulic pump 260 is driven by an engine 261 and has a suction side communicating with an oil tank 262 and a discharge side connected to a three-directional switchable selector valve 263. The selector valve 263 has an output connected to one oil passage hole 240 of one hydraulic stretchable mechanism 208 and to one oil passage hole 240 of another hydraulic stretchable mechanism 208 and a return passage connected to another oil passage 241 of one hydraulic stretchable mechanism 208 and to another oil passage hole 241 of another hydraulic stretchable mechanism 208. The oil passage hole 242 of one hydraulic stretchable mechanism 208 is connected to the oil passage hole 243 of another hydraulic stretchable mechanism 208 while the oil passage hole 242 of another hydraulic stretchable mechanism 208 is connected to the oil passage hole 243 of one hydraulic stretchable mechanism 208. At the same time, the selector valve 263 is connected to the hydraulic cylinder 218.

An operation of the lifting apparatus according to the second embodiment of the present invention will be described hereinafter.

An engine 261 attached to the chassis 201 is actuated to raise the platform 207 so that the oil pump 262 is driven to suck the oil for generating oil under pressure. Thereafter, the selector valve 263 is operated for supplying the oil under pressure to the oil passage hole 240. The oil under pressure supplied to the oil passage hole 240 is then supplied to the ring shaped cylinder chamber C defined between the outer case 221 and the middle case 222. The oil under pressure supplied to the cylinder chamber C increases the pressure in the cylinder chamber C so that the piston ring 235 is pulled out leftward in FIG. 13 and the large rod 211 is pulled out leftward from the cylinder body 210.

However, when the platform 207 is positioned at the lowermost position, the cylinder body 210, the large rod 211 and the small rod 212 are respectively arranged in parallel with each other in a straight line, hence no component force is generated in the direction to turn in the X-shape about the connection mechanism 213 whereby the platform 207 is not raised. Since the oil under pressure is also supplied to the hydraulic cylinder 218 by the operation of the selector valve 263 so that the hydraulic cylinder 218 is operated to raise the pushing body 219 upward. The pushing body 219 contacts the central lower surfaces of the cylinder bodies 210 and raise the cylinder bodies 210 to cause them to be formed slightly in the X-shape. With the operation of the kick mechanism 209, the lifting mechanism 206 is varied from the state where the four cylinder bodies 210 are parallel with each other to the slightly collapsed X-shape. With such a variation of the shape, the oil under pressure is supplied to the hydraulic cylinder 210, hence the component force is generated in the direction to be turned in the X-shape about the connection mechanism 213.

In succession to the operations set forth above, the oil under pressure supplied to the cylinder body 210 pushes the piston ring 235 for thereby pushing down the large rod 211 from the left end of the slide ring 225 so that the length of the hydraulic stretchable mechanism 208 is gradually lengthened. Accompanied by the movement of the piston ring 235, the oil under pressure residue in the cylinder chambers E1 and E2 defined by the outer case 221 and the middle case 222 flows out from the oil passage hole 242. The oil under pressure in the cylinder chamber E2 flows through the fluid hole 235 and enters into the cylinder chamber E1. The oil under pressure flown from the oil passage 242 is introduced into the oil passage hole 243 of the hydraulic stretchable mechanism 208 to thereby increase the pressure in the cylinder chamber D defined by the middle case 222 and the inner case 223. Accordingly, the piston ring 236 is pushed rightward in FIG. 13, thereby pushing the small rod 212 from the right sides of the slide rings 228 and 233 so that the entire length of the hydraulic stretchable mechanism 208 is gradually extended.

In such a manner, since the large rod 211 and the small rod 212 are extended from the right and left ends of the cylinder body 210, the entire length of the hydraulic stretchable mechanism 208 is lengthened. Furthermore, since the sum of the cross sectional areas of the cylinder chambers E1 and E2 is equal to the cross sectional area of the cylinder chamber D, the speed of extension of the large rod 211 from the cylinder body 210 is same as that of the small rod 212 since the amount of the oil under pressure to be introduced is same. The speed of extension of the large rod 211 of one hydraulic stretchable mechanism 208 accords with the speed of extension of the small rod 212 of another hydraulic stretchable mechanism 208 while the speed of extension of the large rod 211 of another hydraulic stretchable mechanism 208 accords with the speed of extension of the small rod 212 of one hydraulic stretchable mechanism 208. Inasmuch as two hydraulic stretchable mechanism 208 have the same shapes are employed wherein the cross sectional area of the cylinder chamber E is same as that of the cylinder D, the stretchable speed of two large rods 211 becomes same as that of two small rods 212. Hence, the hydraulic stretchable mechanisms 208 are turned in the X-shape so that the platform 207 are raised while it is kept horizontal.

In such a manner, the small and large rods 212 and 211 are extended rightward and leftward from the both ends of the cylinder body 210 rightward and leftward so that the distances between the connection pieces 214 and 215 are gradually increased. Accompanied by the rightward movement of the piston ring 235 and 236, the oil under pressure in the cylinder chambers F1 and F2 is discharged from the oil passage hole 241 and returned to the oil tank 262 through the selector valve 263.

Although the lifting mechanism 208 assembled in three stages by the extension of the large rods 211 and the small rods 212 is lengthened at the entire length thereof, when the entire length of the lifting mechanism 206 is lengthened the lengthened direction is decomposed in the upward direction since the tip ends of the large rods 211 and the small rods 212 are fixed to the fixing pieces 216 fixed to the mobile chassis 201 and the fixing pieces 217 fixed to the platform 207. As a result, the platform 207 is gradually raised upward. At this time, since the pair of cylinder bodies 210 and 210 are connected by the rotary shaft 246 and 249, the pair of cylinder bodies 210 and 210 are turned about the rotary shaft 246 to be formed in the X-shape so that the platform 207 is raised.

When the platform 207 is raised at a given position, the selector valve 263 is switched to "middle position" so that the oil under pressure is stopped to be supplied to the oil passage hole 240 and the piston rings 235 and 236 are kept positioned where the oil under pressure is stopped to be supplied, hence the platform 207 is kept positioned at the same level.

When the platform 207 is lowered, the selector valve 263 is switched to "backward position" so that the oil under pressure is supplied to the oil passage hole 241, thereby increasing the pressure in the cylinder chambers F1 and F2. Hence, the piston ring 236 is pushed leftward in FIG. 13 and the small rod 212 is pulled inside the cylinder body 210 and the oil under pressure in the cylinder chamber D flows outside from the oil passage hole 243. Then, the oil under pressure is introduced into the oil passage hole 242 to increase the pressure in the cylinder chambers E1 and E2, pushing the piston ring 35 rightward in FIG. 13 and pulling the large rod 211 inside the cylinder body 210. As a result, the interval between the lower end of the large rod 211 and the upper end of the small rod 212 is decreased so that the platform 207 is gradually lowered.

The oil under pressure residue in the cylinder chamber C is discharged through the oil passage hole 240 and returned to the oil tank 262 through the selector valve 263.

With the arrangement of the lifting apparatus according to the second embodiment of the present invention, the lifting mechanism can be composed of hydraulic stretchable mechanisms resembling a plurality of hydraulic cylinder bodies which entails the very simple structure. Since the stretchable speed of the large and small rods are equalized and the cross sectional areas to which the oil under pressure is applied are equalized, the large and the small rods can be synchronous with each other relative to the cylinder body so that the platform can be raised horizontally. Accordingly, the synchronous mechanism for synchronizing the large rods with small rods is eliminated, whereby the manufacture of the lifting mechanism is made with ease and the maintenance thereof becomes very simple.

Third Embodiment (FIGS. 17 to 25)

A lifting apparatus according to a third embodiment of the present invention will be described with reference to FIGS. 17 to 25.

An arrangement of the lifting apparatus according to the third embodiment is substantially same as those of the first and second embodiments except the lifting mechanism. Hence, the arrangement of the lifting apparatus will be described mainly in respect of the lifting mechanism and a hydraulic circuit for operating the lifting mechanism.

There are provided on a mobile chassis 301 two paired lifting mechanisms 306 at the right and left portions thereof. Each of the pair of lifting mechanism 306 comprises two operation units 310 and connected at the central portions thereof so as to be turned. The operation units 310 comprise two long cylinder bodies 311 which are coupled in parallel with each other and each having one open end to be arranged alternately, i.e. in opposite direction. A lower cylinder rod 312 is inserted into one open end of one of the cylinder bodies 311 while an upper cylinder rod 313 is inserted into another open end of the cylinder body 311. Two paired operation units 310 are connected in an X-shape at the central portions thereof by a connection mechanism, described later, so as to be turned freely. The lower cylinder rods 312 each has a connection piece 315 at its lower end while the upper cylinder rods 313 each has a connection piece 316 at its upper end. Each of the connection pieces 315 of the lower cylinder rods 312 is pivotally connected to each of the fixing pieces 317 fixed to the upper surface of the mobile chassis 301 at the front and rear and right and left thereof so as to be turned while each of the connection pieces 316 of the upper cylinder rods 313 is pivotally connected to each of the fixing pieces 318 fixed to the lower surface of a platform 307 at the front and rear and right and left thereof so as to be turned.

The operation unit 310 will be described more in detail with reference to FIGS. 21 and 22 constituting the lifting mechanism 306.

Two cylinder bodies 311 constituting each operation unit 310 comprises an outer case 325 and an inner case 326. The outer case 325 has an inner diameter slightly greater than an outer diameter of the lower cylinder rod 312 while the inner case 326 has an outer diameter slightly less than an inner diameter of the lower cylinder rod 312. Hence, the outer case 325, the lower cylinder 315 and the inner case 326 are concentrically arranged as illustrated in FIG. 22, wherein they are combined with each other by varying the outer and the inner diameters thereof and there are defined gaps between the elements.

A disk shaped end ring 327 is fixed to a lower portion of the outer case 325 (left side in FIG. 21) and a slide ring 328 is brought into contact with the left side of the end ring 327 and both the end ring 327 and the slide ring 328 are fixed to each other by screws 329. The end ring 327 has an inner diameter substantially same as that of the outer case 325 while the slide ring 328 has an inner diameter substantially same as the outer diameter of the lower cylinder rod 312. The lower cylinder rod 312 has an outer periphery which is brought into contact airtightly with an inner peripheral surface of the slide ring 328 and slides. A disk shaped end ring 330 is fixed to an upper portion of the outer case 325 (right side in FIG. 21) and a ring shaped closed plate 331 having an outer diameter substantially same as the outer periphery of the end ring 330 is brought into contact with the right side of the end ring 330. The closed plate 331 closes the outer case 325 for preventing dust and the like from entering inside the inner case 326.

Figure 21:
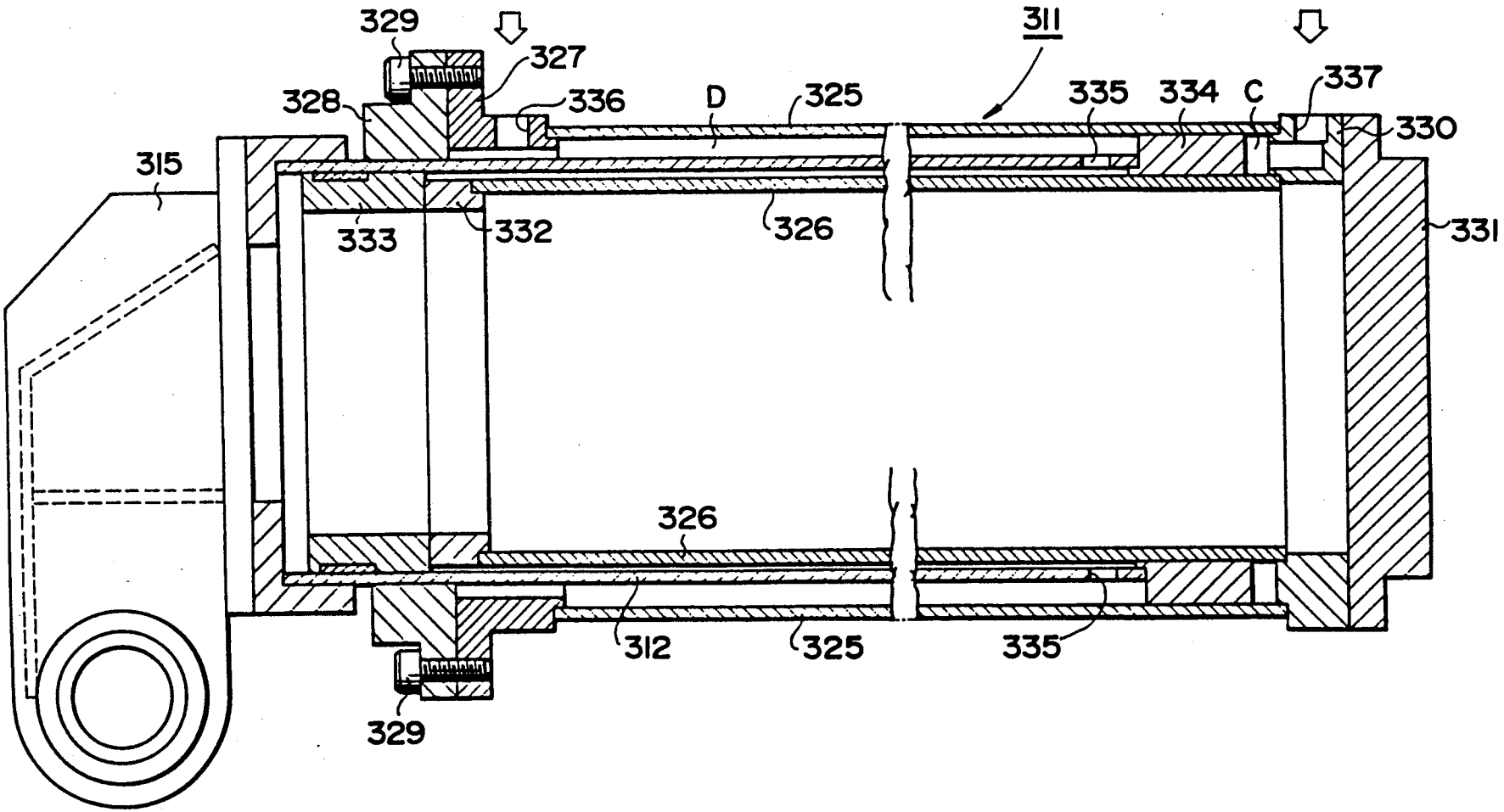
FIG. 21 is a side cross sectional view showing an internal structure of one cylinder body in an operation unit of a lifting mechanism, a constituent of the third embodiment of the present invention.
Figure 22:
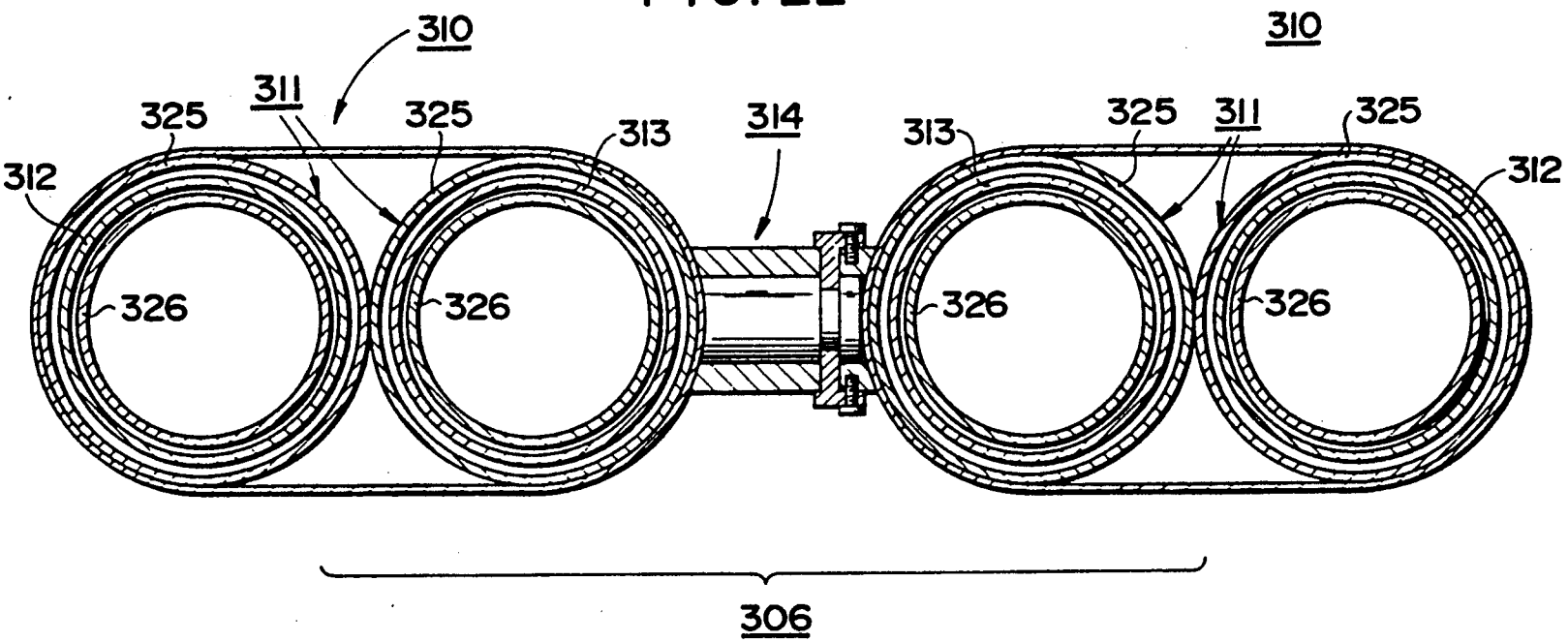
FIG. 22 is a longitudinal cross sectional view showing a state where two paired operation units are assembled.

An upper end of the inner case 326 is fixed to an inside of the end ring 330 (right side in FIG. 21). The outer case 325 and the inner case 326 are assembled to be incorporated with each other by the end ring 330. A ring shaped end ring 332 is fixed to a lower end of the inner case 326 (left side in FIG. 21) and a slide ring 333 is connected to the left side of the end ring 332. The end ring 332 has an outer periphery substantially same as that of the inner case 326 while the slide ring has an outer diameter having substantially same as the inner periphery of the lower cylinder rod 312, whereby the slide ring 333 slides airtightly in the lower cylinder rod 312 while it is brought into airtight contact with the inner periphery of the lower cylinder rod 312. With such an arrangement, the lower cylinder rod 312 is kept airtightly at the outer and inner peripheries thereof by the two slide rings 328 and 333.

In such a manner, the inside of the cylinder body 311 is airtight from the outside by the outer case 325, the inner case 326, the end ring 330, the slide rings 328 and 333, thereby forming the space therein which space operates as the hydraulic cylinder. A ring shaped piston ring 334 is inserted between the outer case 325 and the inner case 326 so as to be slideable in the longitudinal direction of the cylinder body 311 and movable airtightly in a cylindrical space defined by the outer case 325 and the inner case 326. The lower cylinder rod 312 is connected to the left side of the piston ring 334 at the upper end thereof so that both the piston ring 334 and the lower cylinder rod 312 are movable freely.

There are defined a plurality of communication holes 335 around the upper end periphery of the lower cylinder rod 312 so that the oil under pressure is flown in the spaces partitioned by the inner and outer walls of the lower cylinder rod 312. Oil passage holes 336 and 337 are penetrated into the end ring 330 and 327 for connecting with external hydraulic pipes wherein the oil passage 336 communicates with a left side space partitioned by the piston ring 334 between the outer case 325 and the inner case 326. The oil passage hole 337 communicates with a right side space partitioned by the piston ring 334 between the outer case 325 and the inner case 326.

The arrangement of the combination of the cylinder body 311 and the lower cylinder rod 312 is same as that of the combination of the cylinder body 311 and the upper cylinder rod 313. One operation unit 310 is formed by fixedly combining two cylinder bodies 311 in parallel while the directions of the extension of both the lower and upper cylinder rods 312, 313 are opposed with each other. FIG. 22 shows a cross sectional view showing the structure of the combination of the pair of operation units 310. Shapes of the cylinder body 311, the lower cylinder rod 312, and the upper cylinder rod 313 of one pair of operation unit 310 are same as those of another pair of operation unit 310. Hence, the cross sectional areas defined by the outer case 325 and the inner case 326 inside one cylinder body 311 are same as that inside another cylinder body 311.

Figure 23:
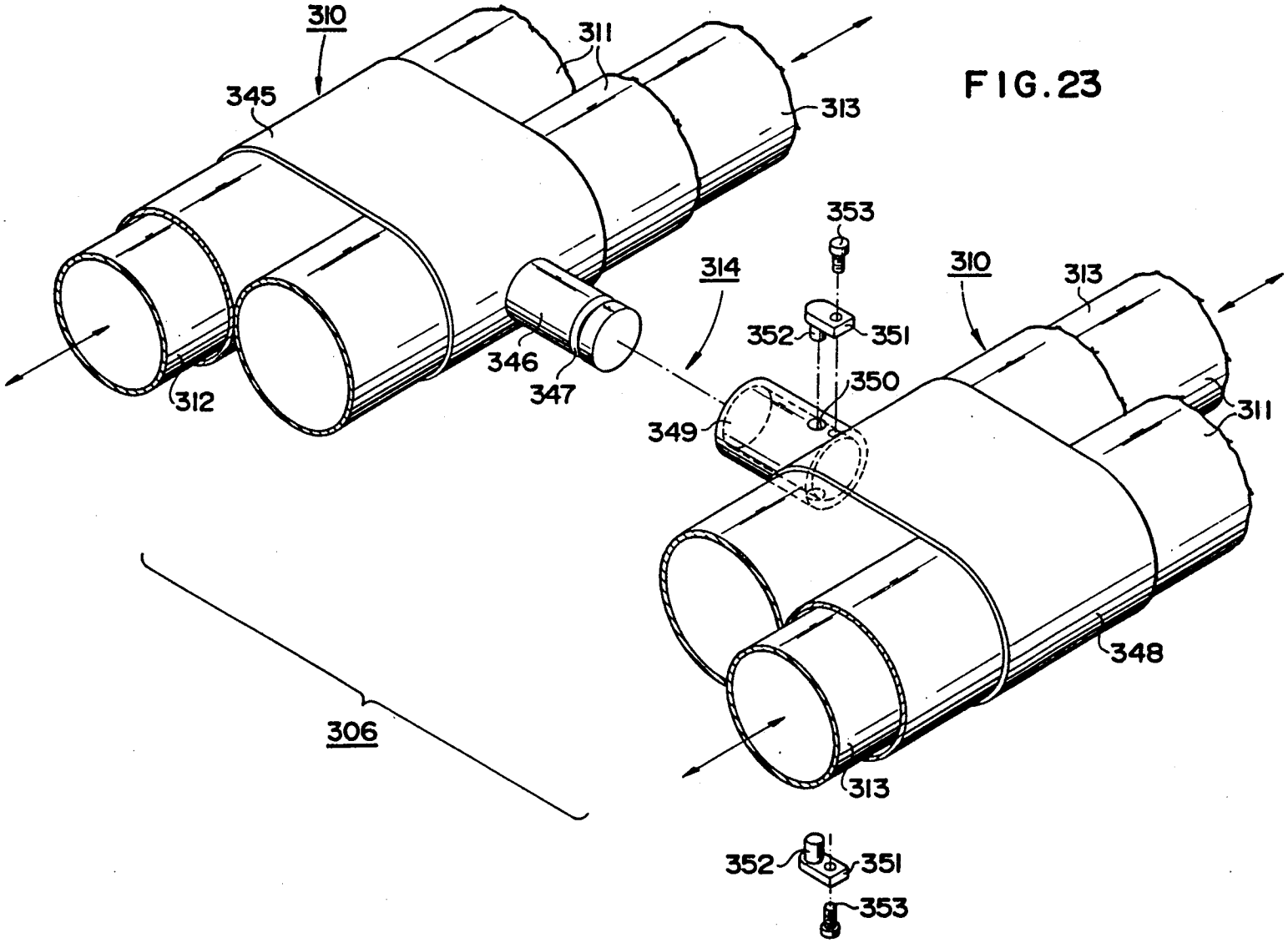
FIG. 23 is an exploded perspective view showing a connection mechanism for connecting two paired operation units.

The connection mechanism 314 will be described more in detail with reference to FIG. 23.

The connection mechanism 314 can connect two operation units 310 at the central portions thereof in order to turn them freely and comprises two mechanisms which are paired and opposed with each other.

In one operation unit 310, two cylinder bodies 311 and 311 are combined and arranged in parallel and a fixing band 45 is wound around a periphery of the combined cylinder bodies 311 at the central portion thereof whereby two cylinder bodies 311 are connected like a pair of spectacles. A cylindrical rotary shaft 346 is fixed at the side surface of the fixing band 345 which protrudes from the fixing band 345 and extends at a right angle relative to the axial direction of the cylinder body 310. The rotary shaft 346 has an engaging groove 347 defined by cutting and encircling a tip end of the rotary shaft 346.

In another operation unit 310, two cylinder bodies 311 and 311 are combined and arranged in parallel and a fixing band 348 is wound around a periphery of the combined cylinder bodies 311 at the central portion thereof. A cylindrical rotary shaft 349 is fixed at the side surface of the fixing band 348 which protrudes from the fixing band 348 and extends at a right angle relative to the axial direction of the cylinder body 310. The rotary shaft 349 has an inner diameter substantially same as that of an outer diameter of the rotary shaft 346 wherein the two operation units 310 are rotatable relative to each other by inserting the rotary shaft 346 into the rotary shaft 349.

The rotary shaft 349 has pin holes 350 at the upper and lower portions adjacent to the root thereof. Pins 352 fixed to engaging bodies 351 are inserted into the pin holes 350 and engageable in the engaging groove 347. The engaging bodies 351 are fixed to the rotary shaft 349 by screws 353.

Figure 24:
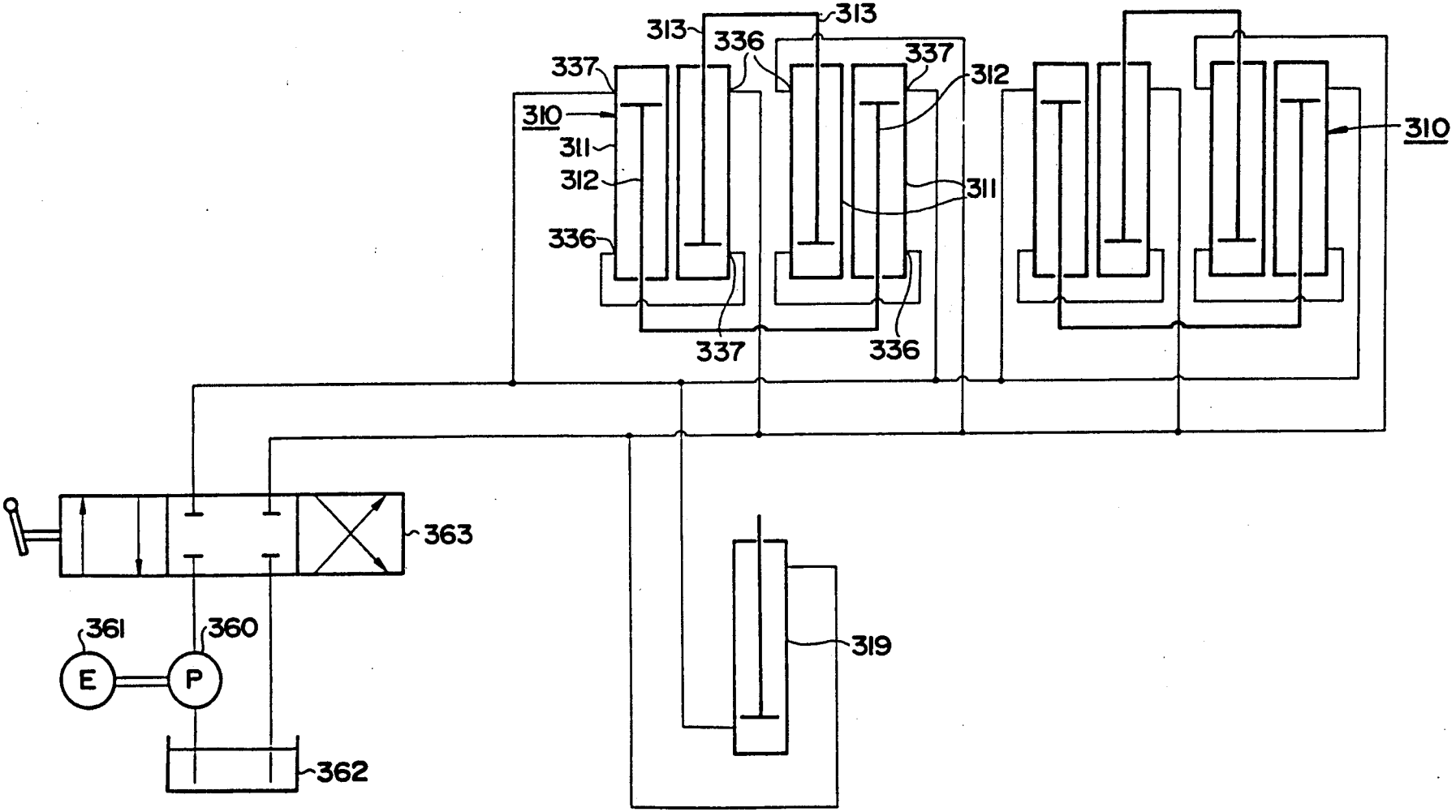
FIG. 24 is a piping diagram showing a hydraulic circuit according to the third embodiment of the present invention.

The hydraulic circuit will be described with reference to FIG. 24.

A hydraulic pump 360 is driven by an engine 361 and has a suction side communicating with an oil tank 362 and a discharge side connected to a three-directional switchable selector valve 363. The selector valve 363 has an output connected to one oil passage 337 and also to the hydraulic cylinder 319. The selector valve 363 has another output connected to another oil passage 336 and also to the discharge side of the hydraulic cylinder 319. The oil passage holes 336 and 337 in each pair of operation units 310 are connected to be in series.

An operation of the lifting apparatus according to the third embodiment of the present invention will be described hereinafter.

Figure 20:
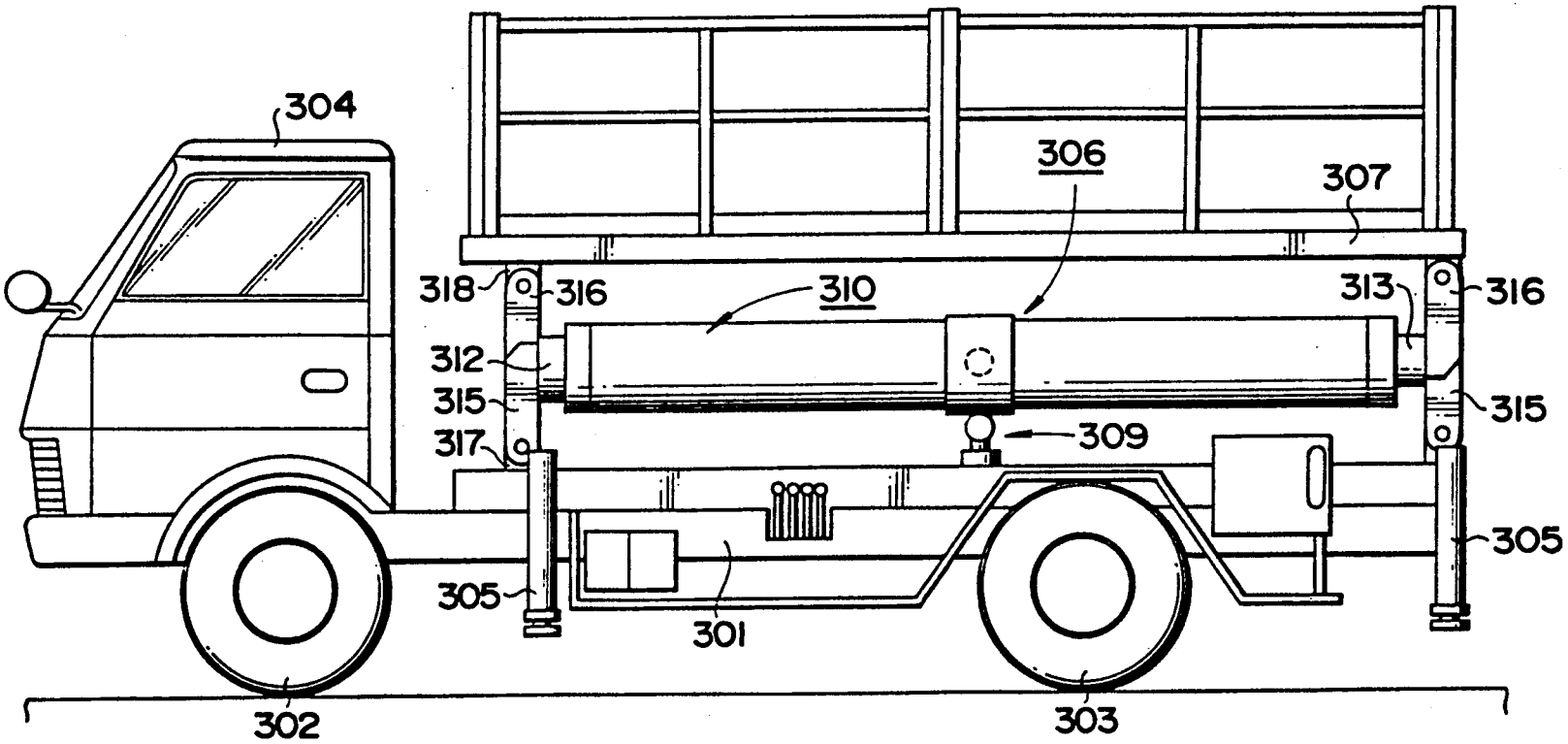
FIG. 20 is a side showing the lifting apparatus wherein the platform is lowered at its lowermost position.

An engine 361 attached to the mobile chassis 301 is actuated so as to raise the platform 307 so that the oil pump 362 is driven to suck the oil for generating oil under pressure. Thereafter, the selector valve 363 is operated for supplying the oil under pressure to the oil passage hole 337. The oil under pressure supplied to the oil passage 337 is then supplied to a ring shaped cylinder chamber C defined between the outer case 325 and the inner case 326. The oil under pressure supplied to the cylinder chamber C increases the pressure in the cylinder chamber C so that the piston ring 334 is pulled out leftward in FIG. 21 and the lower cylinder rod 312 is pulled out leftward from the cylinder body 311. However, when the platform 307 is positioned at the lowermost position as illustrated in FIG. 20, the cylinder body 311, the lower cylinder rod 312 and the upper cylinder rod 313 are respectively arranged in parallel with each other and in the straight line. Hence, no component force is generated in the direction to turn in the X-shape about the connection mechanism 314 whereby the platform 307 is not raised. Since the oil under pressure is also supplied to the hydraulic cylinder 319 by the operation of the selector valve 363 so that the hydraulic cylinder 319 is operated to raise the pushing body 320 upward. The pushing body 320 contacts the central lower surfaces of the cylinder bodies 311 and raise the cylinder bodies 311 to vary them to be formed slightly in the X-shape. With the operation of the kick mechanism 309, the lifting mechanism 306 is varied from the state where the four cylinder bodies 311 are parallel with each other to the slightly collapsed X-shape.

In succession to the operations set forth above, the oil under pressure supplied into the cylinder chamber C pushes the piston ring 334 for thereby pushing down the lower cylinder rod 312 from the left end of the slide ring 328 so that the length of the unit 310 is gradually lengthened. Accompanied by the movement of the piston ring 334, the oil under pressure supplied to cylinder chamber D defined between the outer case 325 and the middle case 326 flows through the fluid hole 335 and is discharged outside from the oil passage hole 336. The oil under pressure enters into the oil passage hole 337 of another cylinder body 311 constituting the same operation unit 310 to increase the pressure in the cylinder chamber at the same time so that the upper cylinder rod 313 is moved and the upper cylinder rod 313 is pulled out from the cylinder body 311. With the operation of the upper cylinder rod 313, the oil under pressure flown from the oil passage hole 336 flows in the direction of the selector valve 363 and collected in the oil tank 362.

The flowing operation of the oil under pressure in the thus airtightly closed two cylinder bodies 311 is effected at the same time in any of the four operation units 310. Hence, the lower cylinder rod 312 and the upper cylinder rod 313 are extended in the opposite direction from the both ends of the two cylinder bodies 311. At this time, each of the cross sectional area of the cylinder chamber defined inside the cylinder bodies 311 is the same, hence the amount of movement of the lower cylinder rod 312 relative to the cylinder body 311 is the same as that of the upper cylinder rod 313.

With the extension operation of the lower cylinder rod 312 and the upper cylinder rod 313, the lifting mechanism composed of a combination of three members is lengthened at the entire length thereof. However, the tip ends of the lower cylinder rod 312 and the upper cylinder rod 313 are connected to the fixing pieces 317 and 318 at the pins and the fixing pieces 317 and 318 are connected to the mobile chassis 301 and the platform 307. Hence, when the entire length of the lifting mechanism 306 is lengthened the direction extended in the longitudinal direction thereof is decomposed to direct upward whereby the platform 307 is raised upward gradually. At this time, since a pair of operation units 310 are connected by the rotary shaft 346 and 349, both the operation units 310 are rotated relative with each other about the central axis of the rotary shaft 346 to be formed in the X-shape so that the platform 306 is raised.

When the platform 307 is raised at a given position, the selector valve 363 is switched to "middle position" so that the oil under pressure is stopped to be supplied to the oil passage hole 337 and the piston ring 334 is kept positioned where the oil under pressure is stopped, hence the platform 307 is kept positioned at the same level.

When the platform is lowered, the selector valve 363 is switched to "backward position". Then, the oil under pressure is supplied to the oil passage hole 336 from the pump 360, the piston ring 334 is pulled out leftward in FIG. 21. Successively, the lower cylinder rod 312, the upper cylinder rod 313 are moved in the direction of the inside of the cylinder body 311 and at the same time the oil under pressure is filled in the cylinder chamber D through the fluid hole 336 so that the oil under pressure in the cylinder chamber C is discharged through the oil passage hole 337. The discharged oil under pressure is returned to the oil tank 362. With the movement of the piston ring 334, the lower cylinder rod 312 and the upper cylinder rod 313 are respectively pulled inside the cylinder body 311. Accordingly, the interval between the lower end of the lower cylinder rod 312 and the upper end of the upper cylinder rod 313 is decreased so that the platform 307 is gradually lowered.

Figure 25:
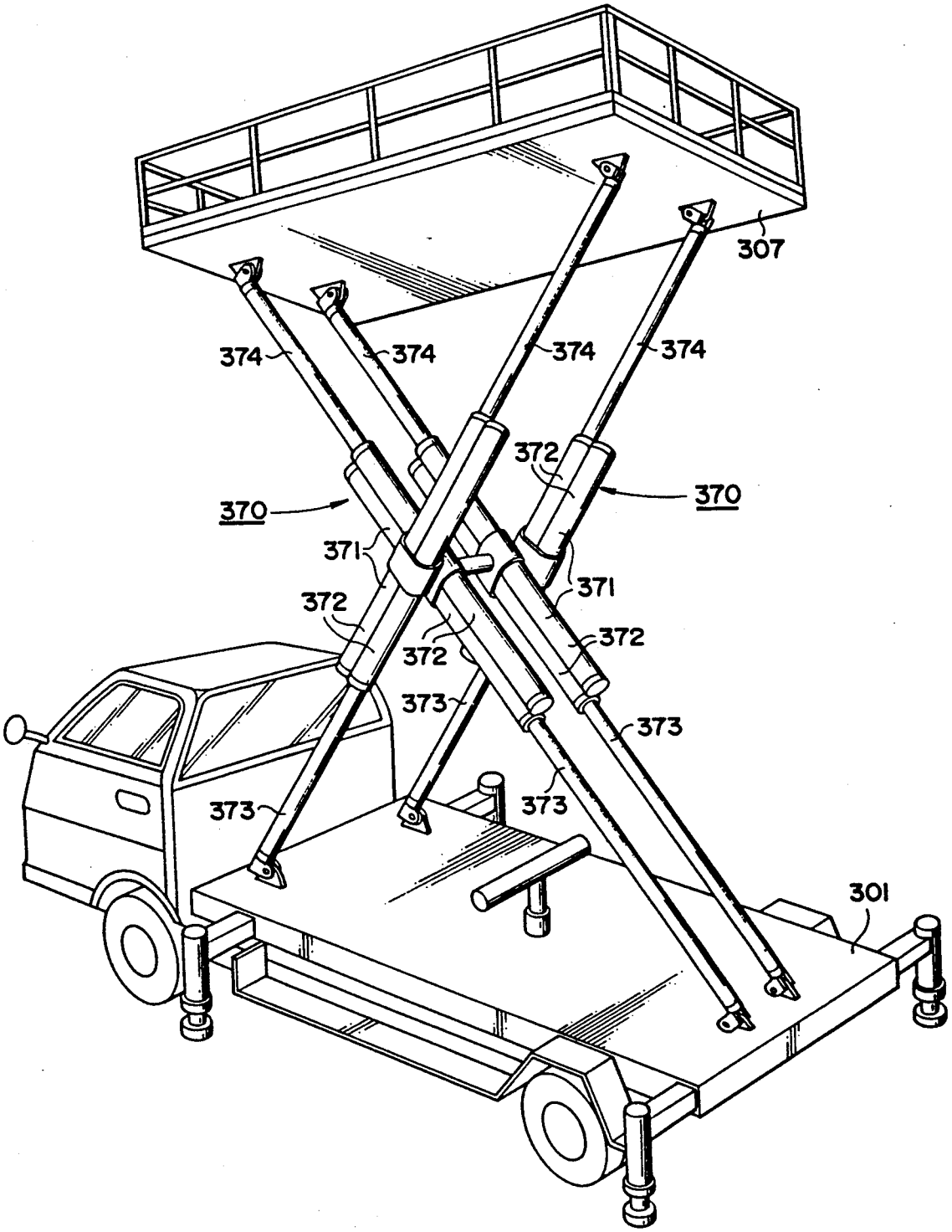
FIG. 25 is a perspective view showing a lifting apparatus according to a modified example of the third embodiment of the present invention, wherein a platform, a constituent of the modified example, is raised at its uppermost position.
Figure 26:
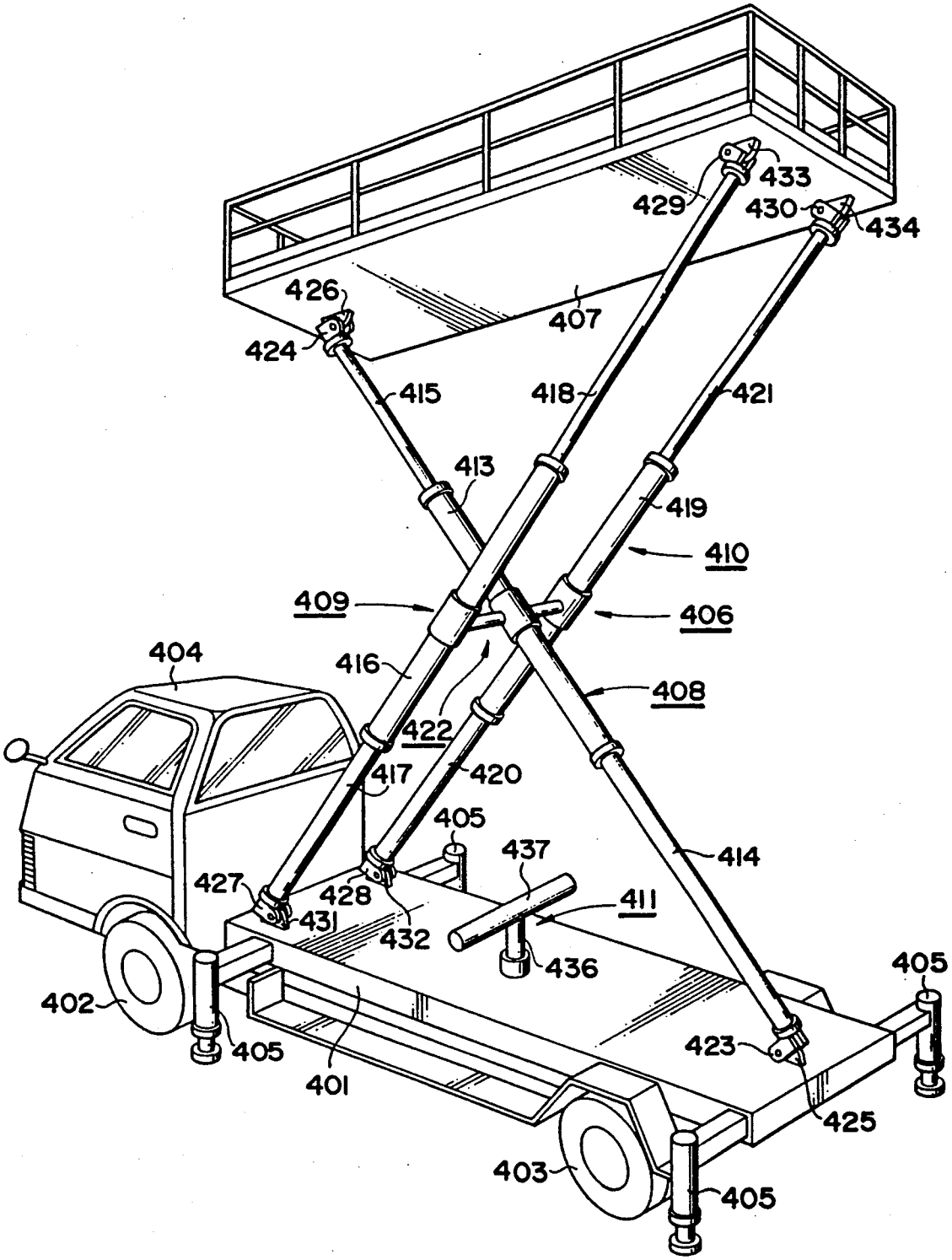
FIG. 26 is a perspective view showing a lifting apparatus according to a fourth embodiment of the present invention, wherein a platform, a constituent of the fourth embodiment of the present invention, is raised at its uppermost position.
Figure 27:
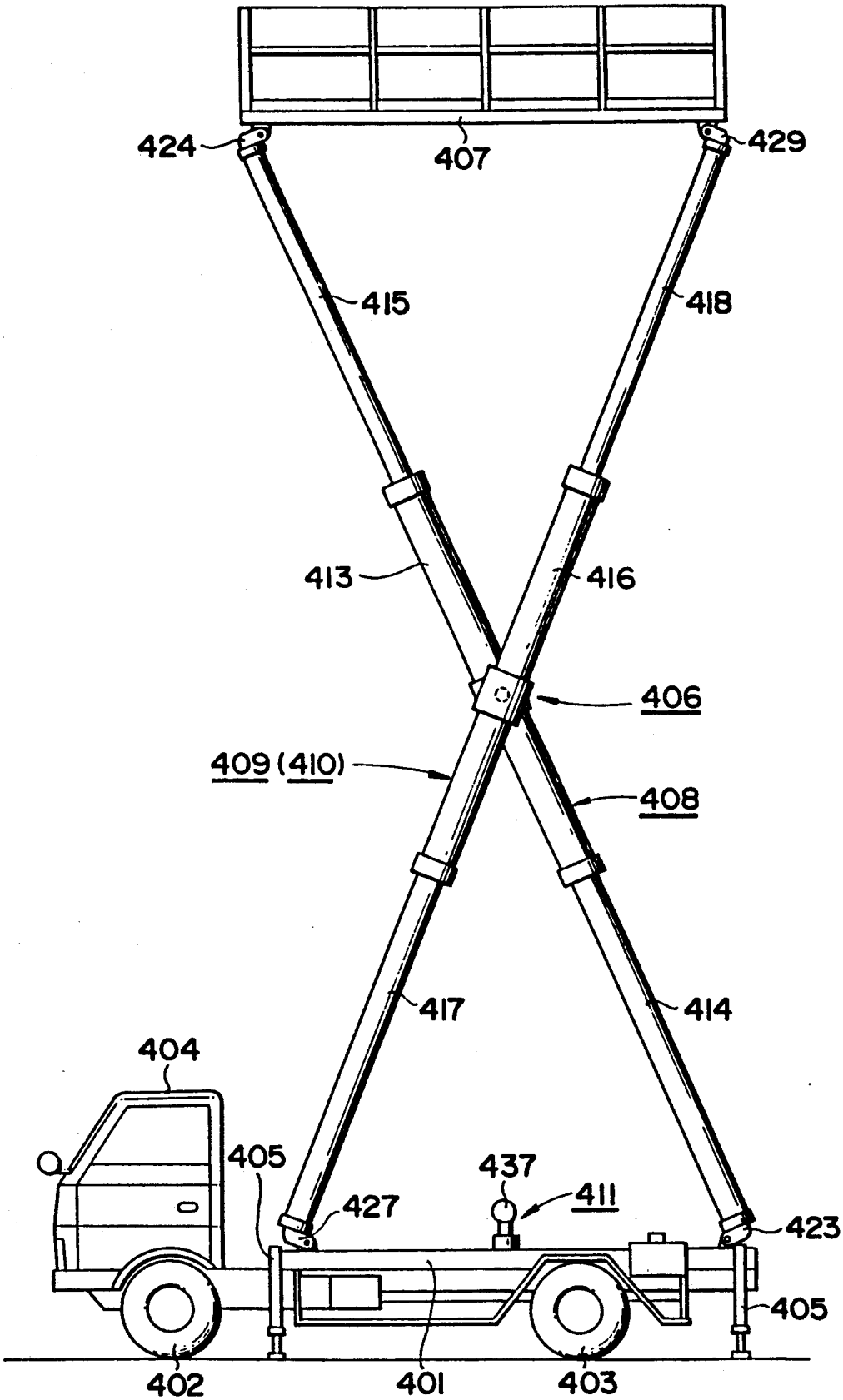
FIG. 27 is a side view of the lifting apparatus of FIG. 26.
Figure 28:
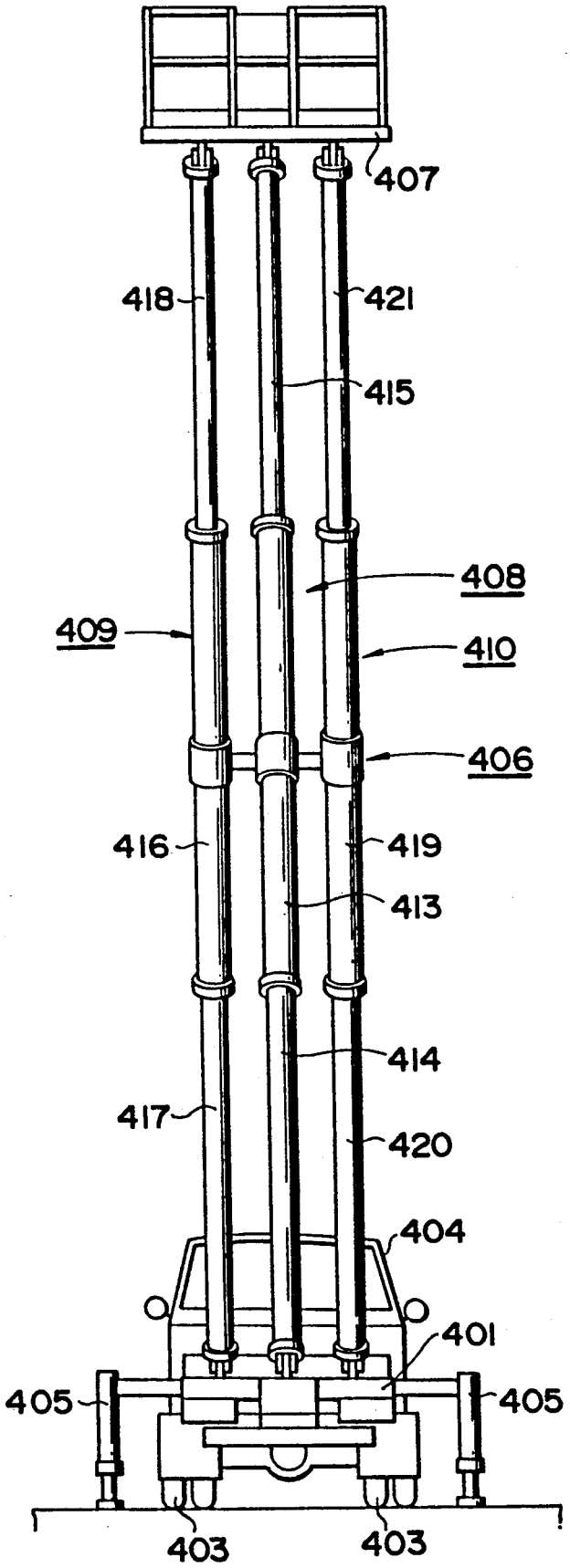
FIG. 28 is a rear view of the lifting apparatus of FIG. 26.

Modified Example (FIG. 25)

A lifting apparatus according to a modified example of the third embodiment will be described with reference to FIG. 25.

An operation unit 371 constituting a lifting mechanism 370 comprises two cylinder bodies 372. One cylinder body is laid vertically over the other cylinder body and coupled in parallel with each other. An internal structure of the lifting apparatus in the modified example is same as that as illustrated in FIG. 21, i.e. a lower cylinder rod 373 is stretchable from the lower end of one cylinder body 372 while an upper cylinder body 374 is stretchable from the upper end of another cylinder body 372. With the stretchable movement of the lower and upper cylinder rods 373 and 374, the platform 307 can be raised or lowered.

With the arrangement of the lifting apparatus according to the third embodiment of the present invention, the lifting apparatus can be constituted by hydraulic stretchable mechanisms resembling a plurality of hydraulic cylinders, hence the structure of the lifting apparatus is very simple. The lifting mechanism can be raised by synchronizing the large rod with the small rod relative to the hydraulic body when the stretchable speed of the large and small rods is same as the cross sectional area to which the oil under pressure is supplied. Accordingly, the synchronous mechanism such as the chains and the like for synchronizing the large rod with the small rod is unnecessitated, whereby the manufacture of the lifting apparatus can be made with ease and the maintenance thereof is simplified.

Fourth Embodiment (FIGS. 26 to 38)

A lifting apparatus according to a fourth embodiment of the present invention will be described with reference to FIGS. 26 to 38.

An arrangement of the lifting apparatus according to the fourth embodiment is substantially same as that of the first to third embodiments except the lifting mechanism. Hence, the arrangement of the lifting apparatus will be described mainly in respect of the lifting mechanism and a hydraulic circuit for operating the lifting mechanism.

The lifting mechanism 406 comprises three hydraulic stretchable mechanisms 408, 409, 410. The hydraulic stretchable mechanisms 408, 409, 410 comprise cylinder bodies 413, 416, 419 having large diameters, large rods 414, 417, 420 inserted telescopically into and stretchable from one ends of the cylinder bodies 413, 416, 419 and small rods 415, 418, 421 inserted telescopically into and stretchable from the other ends of the cylinder bodes 413, 416, 419 and a connection mechanism 422 for connecting the central portions of the cylinder bodies 413, 416, 419 so as to turn freely. These three hydraulic stretchable mechanisms 408, 409, 410 are disposed in the manner that the cylinder body 413 is positioned centrally and the cylinder bodies 416 and 419 are positioned at right and left of the cylinder body 413 and the cylinder bodies 413, 416, 419 are alternated. The cylinder bodies 413, 416, 419 of these three hydraulic stretchable mechanisms 408, 409, 410 are pivotally connected by the connection mechanism 422 at the inside central portions thereof so as to be turned freely with each other.

A lower end of the large rod 414 of the central hydraulic stretchable mechanism 408 has a connection piece 423 fixed thereto while an upper end thereof has a connection piece 424 fixed thereto. The connection piece 423 of the large rod 414 is pivotally connected to a fixing piece 425 fixed to a rear central portion of a mobile chassis 401 (at the side of rear wheels 403) by pins. The connection piece 424 of the small rod 415 is pivotally connected to a fixing piece 426 fixed to a front central portion of a platform 407 (at the side of front wheels 402) by pins.

Lower ends of the large rods 417 and 420 of the right and left hydraulic stretchable mechanism 409 and 410 have connection pieces 427 and 428 fixed thereto while upper ends thereof have connection pieces 429 and 430 fixed thereto. The connection pieces 427 and 428 of the large rods 417 and 420 are pivotally connected to fixing pieces 431 and 432 fixed to front portion of the upper surface of the mobile chassis 401 at right and left thereof at the spaced interval with (at the side of front wheels 402) by pins. The connection pieces 429 and 430 of the small rods 418 and 421 are pivotally connected to fixing pieces 433 and 434 fixed to a rear portion of the platform 407 (at the side of rear wheels 403) by pins. That is, the hydraulic stretchable mechanism 408 and the two hydraulic stretchable mechanisms 409 and 410 are assembled so that the structures thereof are same (cross sectional shapes thereof, described later, are different). The hydraulic stretchable mechanisms 408, 409, 410 comprise the cylinder bodies 413, 416, 419, large rods 414, 417, 420 and the small rods 415, 418, 421 respectively having same lengths. The central hydraulic stretchable mechanism 408 and both sides of hydraulic stretchable mechanisms 409 and 410 are disposed in the reversed direction on the mobile chassis 401.

The lifting apparatus is formed, as viewed from the side elevation, in an X-shape in the structure thereof by the mobile chassis 401, the platform 407 and the lifting mechanism 406. Furthermore, the intervals between the fixing piece 425 fixed to the rear portion on the upper surface of the mobile chassis 401 and the fixing pieces 431 and 432 fixed to the front portion on the upper surface of the mobile chassis 401 are set to be equal to those between the pieces 426 and 433 fixed to the front portion of the lower surface of the platform 407 and the fixing piece 434 fixed to the rear portion of the lower surface of the platform 407. Accordingly, if the hydraulic stretchable mechanisms 408, 409 and 410 are synchronized and extended for the same lengths, the lifting mechanism 406 is turned in the X-shape so that the mobile chassis 401 and the platform 407 are always in parallel with each other.

An internal structure of the hydraulic stretchable mechanism 409 constituting the lifting mechanism 406 will be described more in detail with reference to FIG. 30. An internal structure of the hydraulic stretchable mechanism 410 constituting the lifting mechanism 406 is same as that of the hydraulic stretchable mechanism 409.

Figure 32:
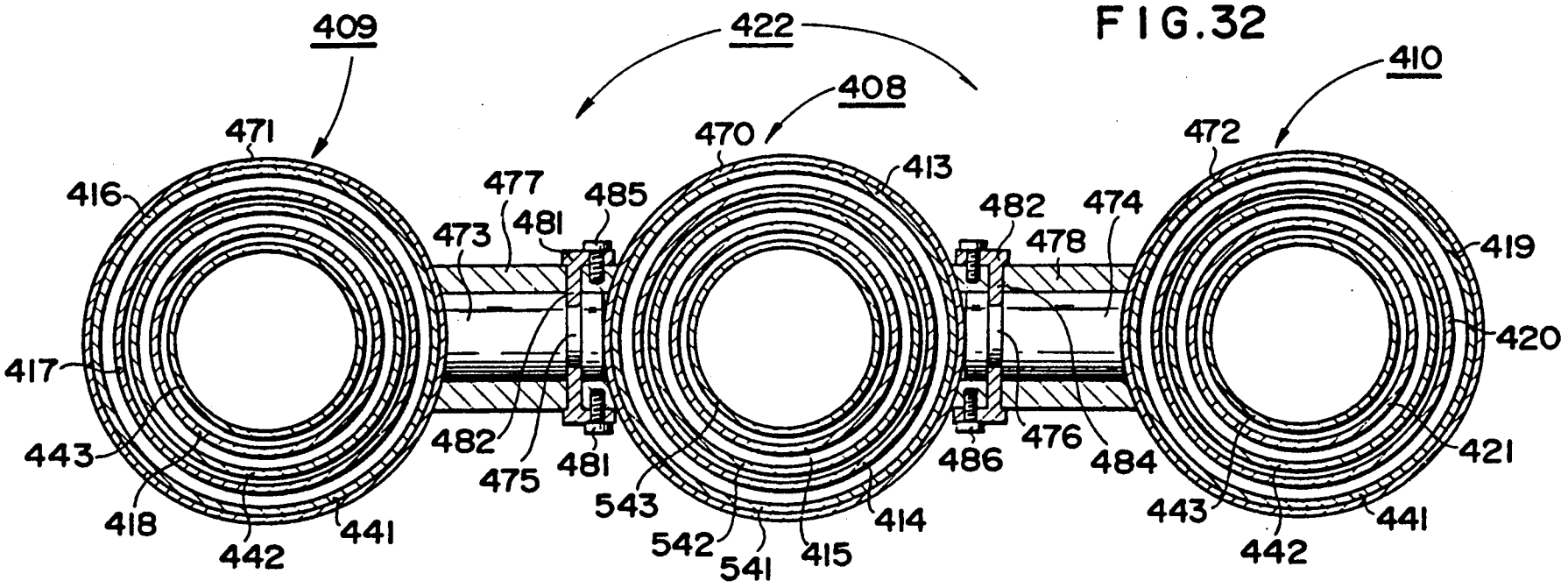
FIG. 32 is a longitudinal cross sectional view showing an internal structure of combined three hydraulic stretchable mechanisms.

The cylinder body 416 (419) in the stretchable mechanism 409 comprises an outer case 441, a middle case 442, and an inner case 443. The outer case 441 has an inner diameter greater than an outer diameter of the large rod 417 (420) while the middle case 442 has an outer diameter less than an inner diameter of the large rod 417 (420). The small rod 418 (421) has an outer diameter slightly less than an inner diameter of the middle case 442 while the inner case 443 has an outer diameter less than an inner diameter of the small rod 418 (421). Accordingly, in the hydraulic stretchable mechanisms 409 and 410 as illustrated in FIG. 32, the outer case 441, the large rod 417 (420), the middle case 442, the small rod 418 (421) and the inner case 443 are arranged concentrically and the outer and inner diameters thereof can be varied little by little. There are defined gaps between the intervals between the elements.

A disk shaped end ring 444 is fixed to a left end of the outer case 441 (left side in FIG. 30) and a slide ring 445 is brought into contact with the left side of the end ring 444 and both the end ring 444 and the slide ring 445 are fixed to each other by screws 446. The end ring 444 has an inner diameter substantially same as that of the outer case 441 while the slide ring 445 has an inner diameter substantially same as the outer diameter of the large rod 417 (420). The large rod 417 (420) can slide while it is brought into contact airtightly with an inner peripheral surface of the slide ring 445.

A disk shaped end ring 447 is fixed to an upper portion of the outer case 441 (right side in FIG. 30) and a slide ring 448 is brought into contact with the right side of the end ring 447 and both the slide ring 448 and the end ring 447 are brought into contact with and fixed to each other. The end ring 447 has an inner diameter substantially same as that of the middle case 442 while the slide ring 448 has an inner diameter substantially same as the outer diameter of the small rod 418 (421). The small rod 418 (421) can slide while it is brought into contact airtightly with an inner peripheral surface of the slide ring 448.

An end ring 449 having an outer diameter substantially same as that of the middle case 442 and an inner diameter substantially same as that of the inner case 443 is brought into contact airtightly with the left end of the middle case 442. A slide ring 450 is fixed to the left end of the end ring 449 by a screw 451. The slide ring 450 has an outer diameter substantially same as the inner diameter of the large rod 417 (420). The large rod 417 (420) can slide while an inner wall thereof is brought into airtight contact with the outer peripheral surface of the slide ring 450.

An end ring 452 having an outer diameter substantially same as the outer diameter of the inner case 443 is fixed to the right end of the inner case 443. A slide ring 453 is brought into contact with the right side of the end ring 452. The end ring 452 and the slide ring 453 are fixed to each other by screws 454, The slide ring 453 has an outer diameter substantially same as the inner diameter of the small rod 418 (421). The small rod 418 (421) can slide while an inner wall thereof is brought into airtight contact with the slide ring 453.

With such an arrangement, there are defined two spaces concentrically in the cylinder body 416 (419) by the outer case 441, the middle case 442 and the inner case 443. These spaces function same as the pressure chambers in the hydraulic cylinders. A ring shaped piston ring 455 is slidably inserted into the space between the outer case 441 and the middle case 442 while it can slide airtightly into a cylindrical space defined by the outer case 441 and the middle case 442. The large rod 417 (420) is fixed to the left side of the piston ring 455 at the right side thereof.

A ring shaped piston ring 456 is inserted into the space between the middle case 442 and the inner case 443 while it can slide airtightly into a cylindrical space defined by the middle case 442 and the inner case 443. The small rod 418 (421) is fixed to the right side of the piston ring 456 at the left side thereof.

There are defined a plurality of communication holes 457 at the right end of the large rod 417 (420) for flowing oil under pressure therethrough while there are defined a plurality of communication holes 458 at the left end of the small rod 418 (421) for flowing oil under pressure therethrough. There are defined a plurality of communication holes 459 at the periphery of the left end of the middle case 442 for flowing the oil under pressure inside and outside the middle case 442.

There are defined two oil passage holes 460 and 461 around the outer peripheral surface of the end ring 447. One oil passage hole 460 communicates with a cylinder chamber C at the right of a space defined between the outer case 441 and middle case 442 while the other oil passage 461 communicates with a cylinder chamber F-1 at the right of a space defined between the middle case 442 and the inner case 443.

As set forth above, there are airtight spaces in the cylinder body 416 (419) partitioned in two layers defined between the outer and inner peripheral surfaces of the outer case 441, the middle case 442 and the inner case 443. Furthermore, these airtight spaces are partitioned by the piston rings 455 and 456 for forming four pressure chambers in total. These pressure chambers are divided into a cylinder chamber C defined by the outer case 441, the middle case 442 and the piston ring 455, a cylinder chamber D defined by the middle case 442, the inner case 443 and the piston ring 456, a cylinder chamber E1 defined by the outer case 441, the large rod 417 (420) and the piston ring 455, a cylinder chamber E2 defined by the large rod 417 (420), the middle case 442 and the piston ring 455, a cylinder chamber F1 defined by the middle case 442, the small rod 418 (421) and the piston ring 456 and a cylinder chamber F2 defined by the small rod 418 (421), the inner case 443 and the piston ring 456.

An internal structure of the hydraulic stretchable mechanism 408 constituting the lifting mechanism 406 will be described more in detail with reference to FIG. 31.

Figure 33:
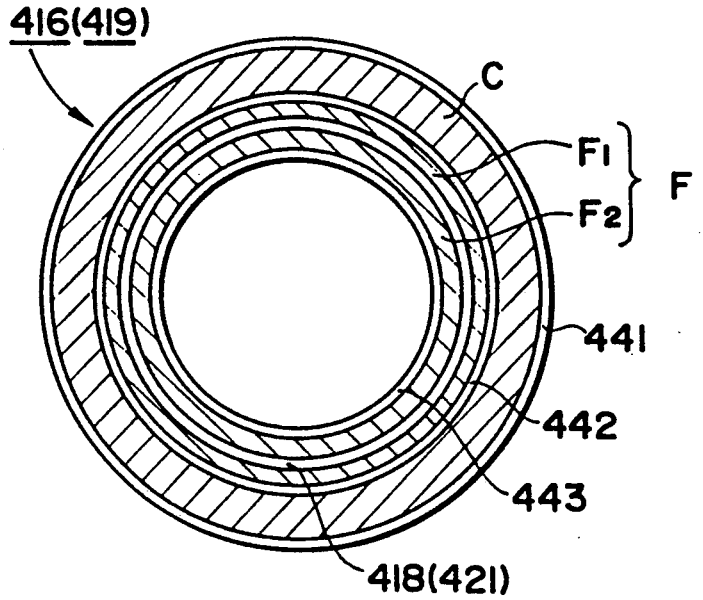
FIG. 33 is a cross sectional view taken along the arrows A—A of FIG. 30.

The cylinder body 413 in the stretchable mechanism 408 comprises an outer case 541, a middle case 542, and an inner case 543. The outer case 541 has an inner diameter greater than an outer diameter of the large rod 414 while the middle case 442 has an outer diameter less than an inner diameter of the large rod 414. The small rod 415 has an outer diameter slightly less than an inner diameter of the middle case 542 while the inner case 543 has an outer diameter less than an inner diameter of the small rod 415. Accordingly, in the hydraulic stretchable mechanism 408 as illustrated in FIG. 33, the outer case 541, the large rod 414, the middle case 542, the small rod 415 and the inner case 543 are arranged concentrically and the outer and inner diameters thereof can be varied little by little. There are defined gaps between the intervals between the elements.

A disk shaped end ring 544 is fixed to a right end of the outer case 541 (right side in FIG. 31) and a slide ring 545 is brought into contact with the right side of the end ring 544 and both the end ring 444 and the slide ring 445 are fixed to each other by screws 546. The end ring 544 has an inner diameter substantially same as that of the outer case 541 while the slide ring 545 has an inner diameter substantially same as the outer diameter of the large rod 414. The large rod 414 can slide while it is brought into contact airtightly with an inner peripheral surface of the slide ring 545.

A disk shaped end ring 447 is fixed to a left end of the outer case 541 (left side in FIG. 31) and a slide ring 548 is brought into contact with the left side of the end ring 547 and both the slide ring 548 and the end ring 547 are brought into contact with and fixed to each other. The end ring 547 has an inner diameter substantially same as that of the middle case 542 while the slide rings 548 has an inner diameter substantially same as the outer diameter of the small rod 415. The small rod 415 can slide while it is brought into contact airtightly with an inner peripheral surface of the slide ring 548.

An end ring 549 having an outer diameter substantially same as that of the middle case 542 and an inner diameter substantially same as that of the inner case 543 is brought into contact airtightly with the left end of the middle case 542. A slide ring 550 is fixed to the right end of the end ring 549 by a screw 551. The slide ring 550 has an outer diameter substantially same as the inner diameter of the large rod 414. The large rod 414 can slide while an inner wall thereof is brought into airtight contact with the outer peripheral surface of the slide ring 550.

An end ring 552 having an outer diameter substantially same as the outer diameter of the inner case 543 is fixed to the left end of the inner case 543. A slide ring 553 is brought into contact with the left side of the end ring 552. The end ring 552 and the slide ring 553 are fixed to each other by screws 554, The slide ring 553 has an outer diameter substantially same as the inner diameter of the small rod 415. The small rod 415 can slide while an inner wall thereof is brought into airtightly contact with the slide ring 553.

With such an arrangement, there are defined two spaces concentrically in the cylinder body 413 by the outer case 541, the middle case 542 and the inner case 543. These spaces function same as the pressure chambers in the hydraulic cylinders. A ring shaped piston ring 555 is slidably inserted into the space between the outer case 541 and the middle case 542 while it can slide airtightly into a cylindrical space defined by the outer case 541 and the middle case 542. The large rod 414 is fixed to the right side of the piston ring 555 at the right side thereof.

A ring shaped piston ring 556 is inserted into the space between the middle case 542 and the inner case 543 while it can slide airtightly into a cylindrical space defined by the middle case 542 and the inner case 543. The small rod 415 is fixed to the left side of the piston ring 556 at the right side thereof.

There are defined a plurality of communication holes 557 at the right end of the large rod 414 for flowing oil under pressure therethrough while there are defined a plurality of communication holes 558 at the periphery of the right end of the small rod 414 for flowing oil under pressure therethrough. There are defined a plurality of communication holes 559 at the periphery of the left end of the middle case 542 for flowing the oil under pressure inside and outside the middle case 542.

There are defined two oil passage holes 560 and 561 around the outer peripheral surface of the end ring 547. One oil passage hole 560 communicates with a cylinder chamber L at the left of a space defined between the outer case 541 and the middle case 542 while the other oil passage 561 communicates with a cylinder chamber P-1 at the left of a space defined between the middle case 542 and the inner case 543.

As set forth above, there are airtight spaces in the cylinder body 413 partitioned in two layers defined between the outer and inner peripheral surfaces of the outer case 541, the middle case 542 and the inner case 543. Furthermore, these airtight spaces are partitioned by the piston rings 555 and 556 for forming four pressure chambers in total. These pressure chambers are divided into a cylinder chamber L defined by the outer case 541, the middle case 542 and the piston ring 555, a cylinder chamber M defined by the middle case 542, the inner case 543 and the piston ring 556, a cylinder chamber N-1 defined by the outer case 541, the large rod 414 and the piston ring 555, a cylinder chamber N-2 defined by the large rod 414, the middle case 542 and the piston ring 455, a cylinder chamber P-1 defined by the middle case 542, the small rod 415 and the piston ring 556 and a cylinder chamber P-2 defined by the small rod 415, the inner case 543 and the piston ring 556.

Figure 30:
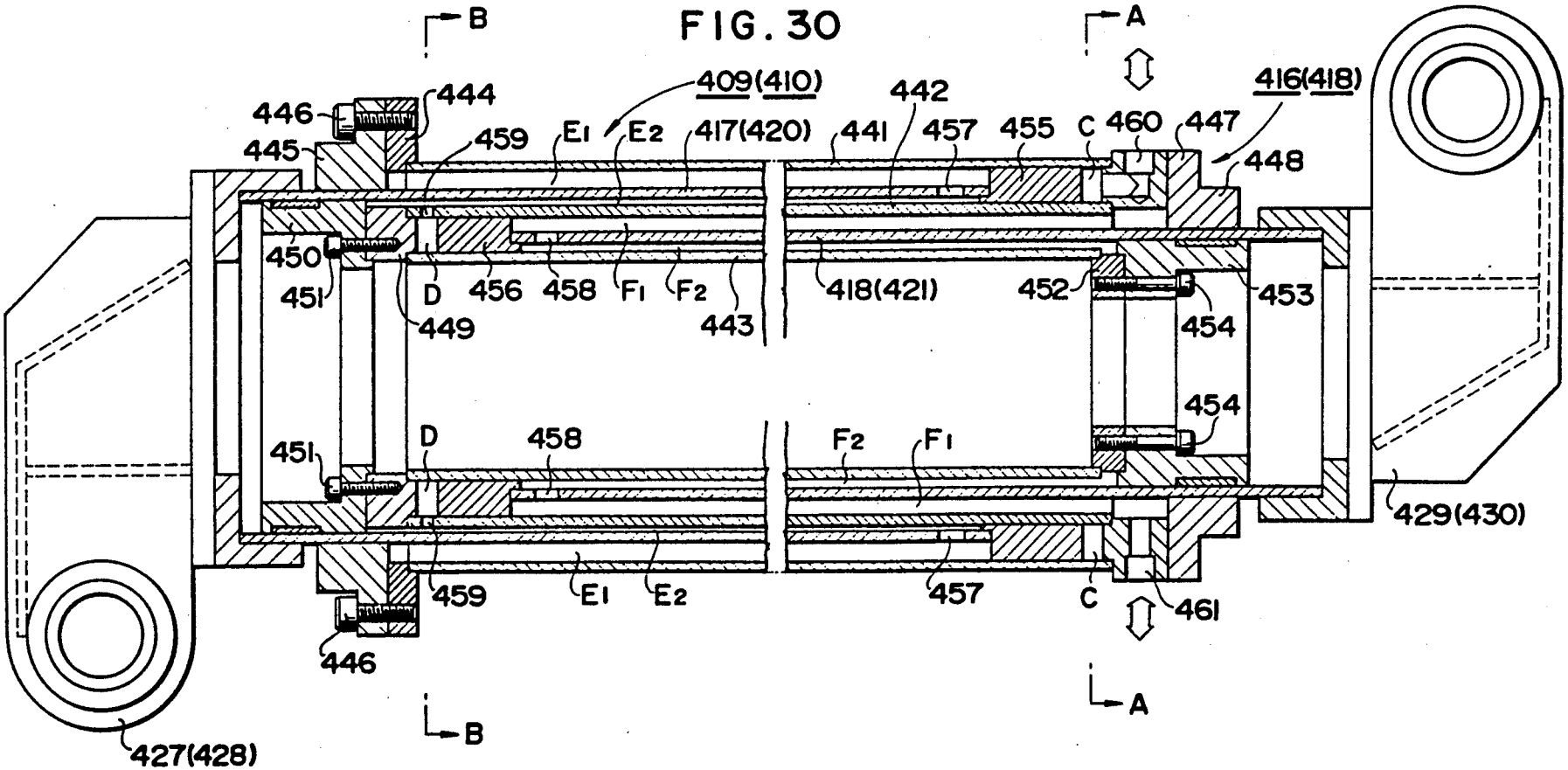
FIG. 30 is a side cross sectional view showing internal structures of right and left hydraulic stretchable mechanisms.
Figure 34:
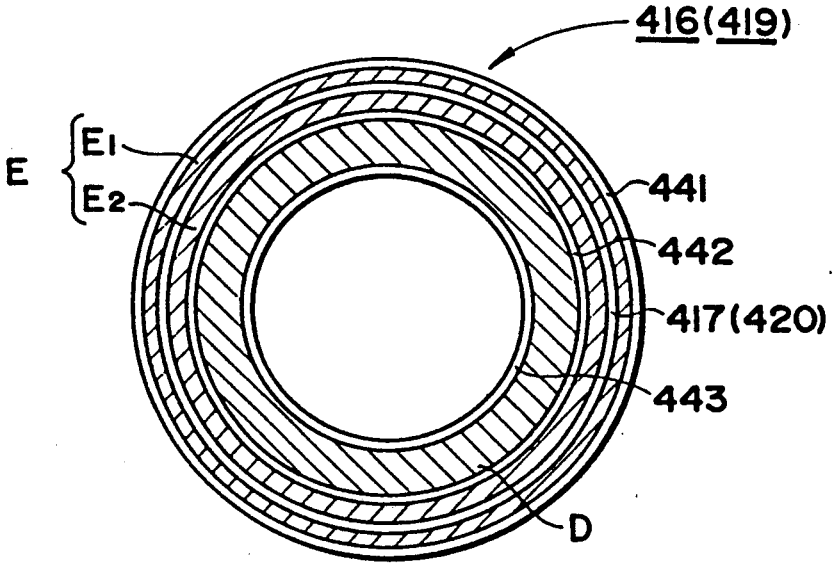
FIG. 34 is a cross sectional view taken along the arrows B—B of FIG. 30.

FIGS. 33 and 34 show cross sectional views of the hydraulic stretchable mechanism 409 (410) wherein FIG. 33 is a cross sectional view taken along the lines A—A of FIG. 30 and FIG. 34 is a cross sectional view taken along the lines B—B of FIG. 30.

Inasmuch as the cylinder chambers E-1 and E-2 are communicated with each other by the communication hole 457, the cross sectional area to which the oil under pressure is applied is equal to the sum E of the cross sectional areas of both the cylinders E-1 and E-2. Similarly, since the cylinder chambers F-1 and F-2 are communicated with each other by the communication hole 458, the cross sectional area to which the oil under pressure is applied is equal to the sum F of the cross sectional areas of both the cylinders F-1 and F-2. These cross sectional areas are designed to be same, i.e. the cross sectional area E being the sum of those of the cylinder chambers E-1 and E-2 is same as the cross sectional area of the cylinder chamber D, whereby the amount of the stretchable movement of the large rod 417 (420) is synchronous with that of the small rod 418 (421).

Described hereinafter is the shapes of each element of the hydraulic stretchable mechanism 408.

Figure 35:
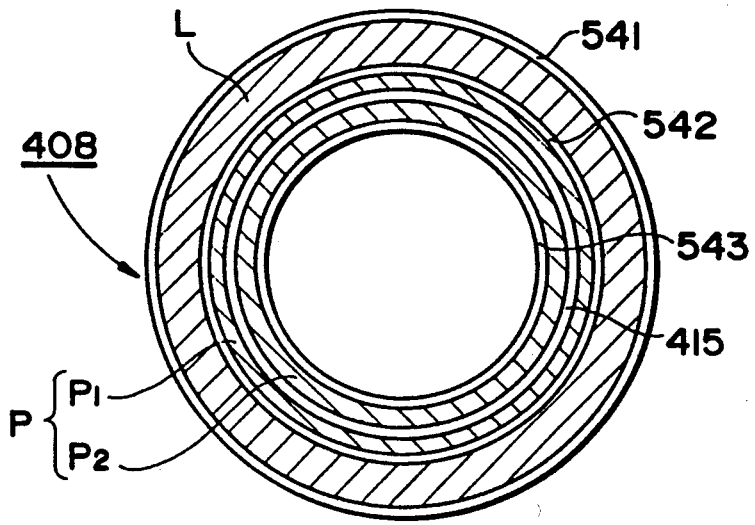
FIG. 35 is a cross sectional view taken along the arrows J—J of FIG. 31.
Figure 36:
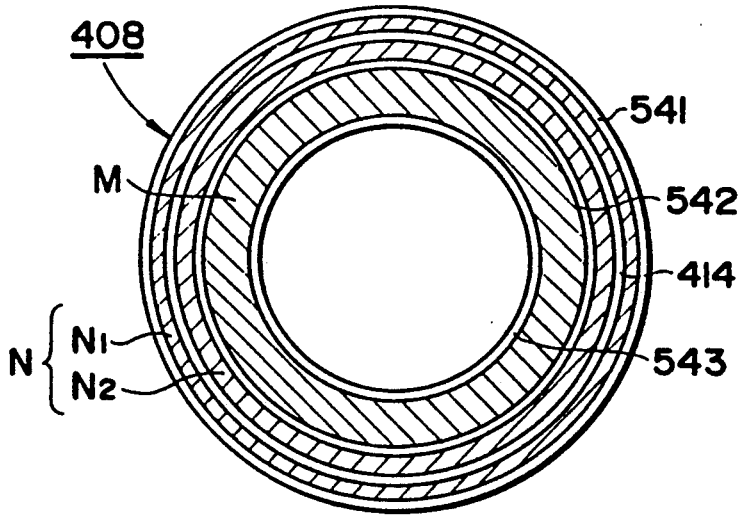
FIG. 36 is a cross sectional view taken along the arrows K—K of FIG. 31.
Figure 37:
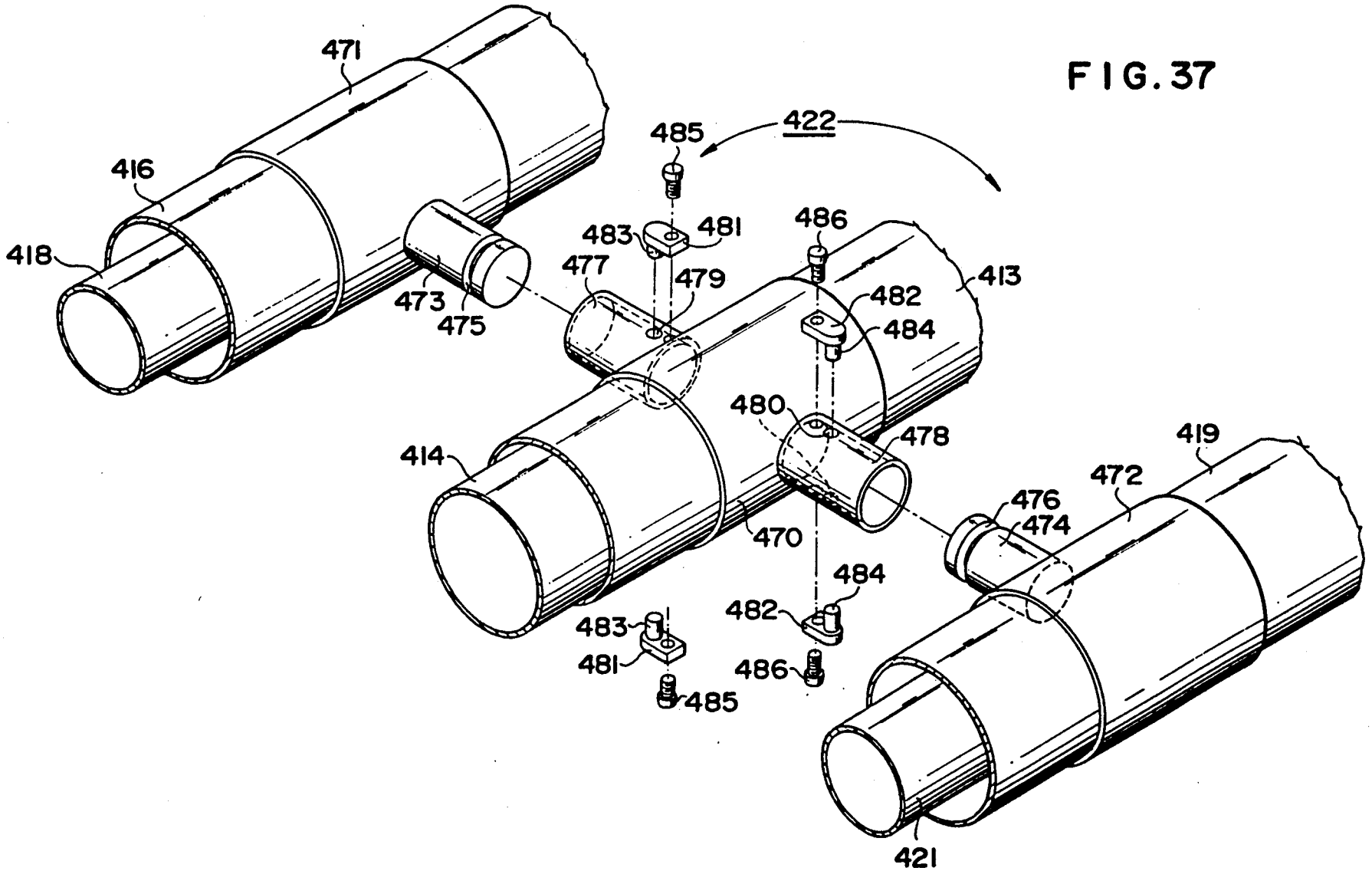
FIG. 37 is an exploded perspective view showing a connection mechanism for connecting three hydraulic stretchable mechanisms so as to be turned.

There are partitioned in the hydraulic stretchable mechanism 408 the cylinder chambers L, M, N-1, N-2, P-1, P-2 by the large rod 414, the small rod 415, the outer case 541, the middle case 542 and the inner case 543. Cross sections of these elements are illustrated in FIGS. 35 and 36 wherein FIG. 35 is a cross sectional view taken along the lines lines J-J of FIG. 31 and FIG. 36 is a cross sectional view taken along the lines K-K of FIG. 31.

Inasmuch as the cylinder chambers N 1 and N-2 are communicated with each other by the communication hole 457, the cross sectional area to which the oil under pressure is applied is equal to the sum N of the cross sectional areas of both the cylinders N-1 and N 2. Similarly, since the cylinder chambers P-1 and P-2 are communicated with each other by the communication hole 458, the cross sectional area to which the oil under pressure is applied is equal to the sum P of the cross sectional areas of both the cylinders P-1 and P-2. These cross sectional areas are designed to be same, i.e. the cross sectional area N being the sum of those of the cylinder chambers N-1 and N-2 is same as the cross sectional area of the cylinder chamber M, whereby the amount of the stretchable movement of the large rod 414 is synchronous with that of the small rod 415.

The shape of the central hydraulic stretchable mechanism 408 is somewhat different from the shapes of the hydraulic stretchable mechanisms 409 and 410 at both sides of the central hydraulic stretchable mechanism 408. The inner and outer diameters between the hydraulic stretchable mechanisms 408, 409 and 410 and the large rods 414, 417 and 420 and the small rods 415, 418 and 421 are respectively same with each other. However, the inner and outer diameters between the outer cases 414 and 514, the middle cases 442 and 542 and the inner case 443 and 543 are different from each other.

Corresponding to the cross section taken along the arrows A—A of FIG. 30, in the hydraulic stretchable mechanism 409 (410), there are defined the cylinder chambers F-1 and F 2 by the outer case 441, the large rod 417 (420), the middle case 442 wherein the effective cross sectional areas thereof become the cross sectional area F which is sum of these cross sectional areas.

Figure 31:
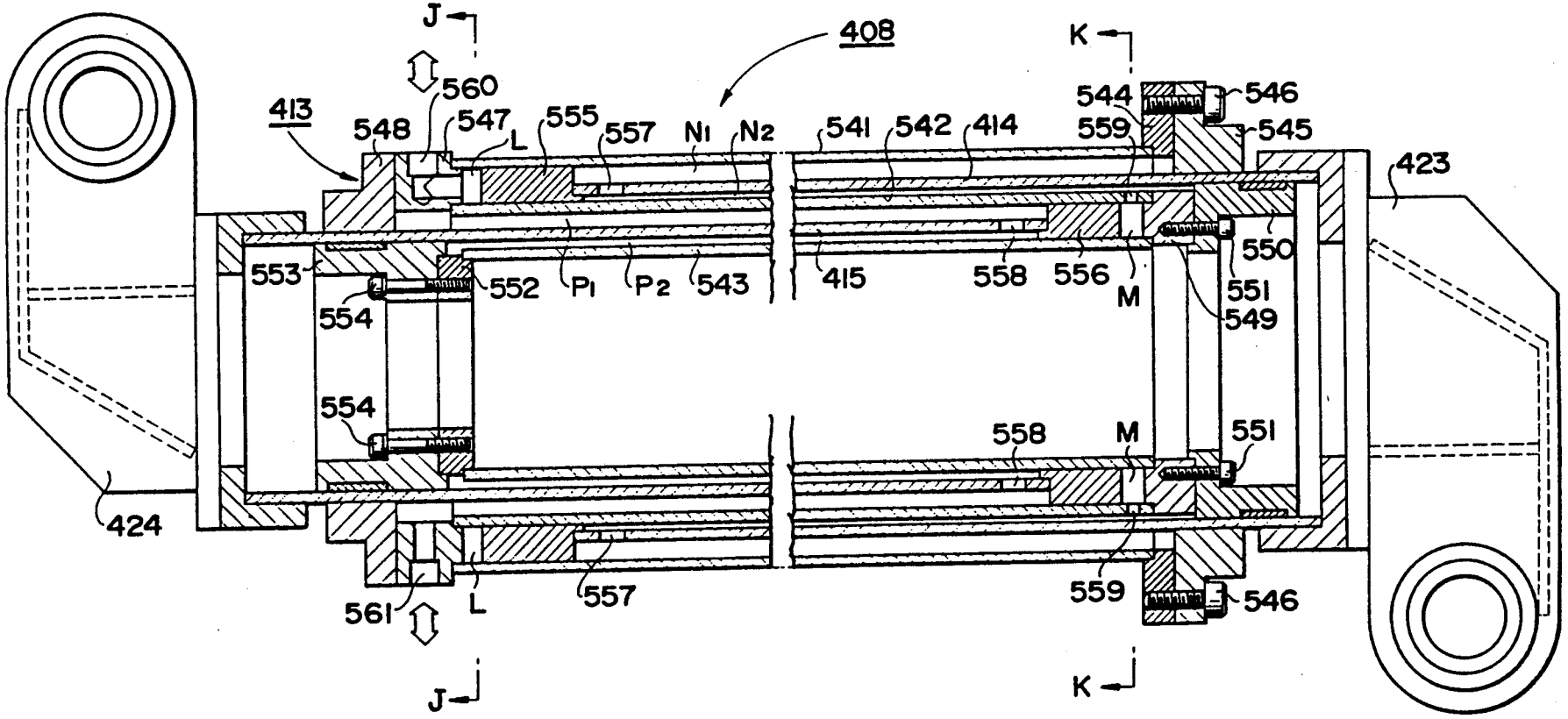
FIG. 31 is a side cross sectional view showing an internal structure of a central hydraulic stretchable mechanism.

Corresponding to the cross section taken along the lines J—J of FIG. 31, in the hydraulic stretchable mechanism 408, there are defined the cylinder chamber L by the outer case 541 and the middle case 542. In the relationship between the cylinder chambers F-1, F-2 and L, the cross sectional area F which is the sum of the cross sectional areas of the cylinder chambers F-1 and F 2 is set to be equal to the cross sectional area of the single cylinder chamber L (i.e. the expression $2 \times F = L$ is established). By setting the sectional areas as set forth above, the shapes of the outer case 441 and 541, the middle case 442 and 542 and the inner case 443 and 543 are respectively determined, whereby the amount of stretchable movement of the central stretchable mechanism 408 is synchronous with that of the large rods 414, 417, 420 and the small rods 415, 418, 421 of both the hydraulic stretchable mechanisms 409 and 410.

The connection mechanism 422 is substantially same as those of the first and second embodiments except that the former connects three cylinder bodies while the latter connects two cylinder bodies.

Figure 38:
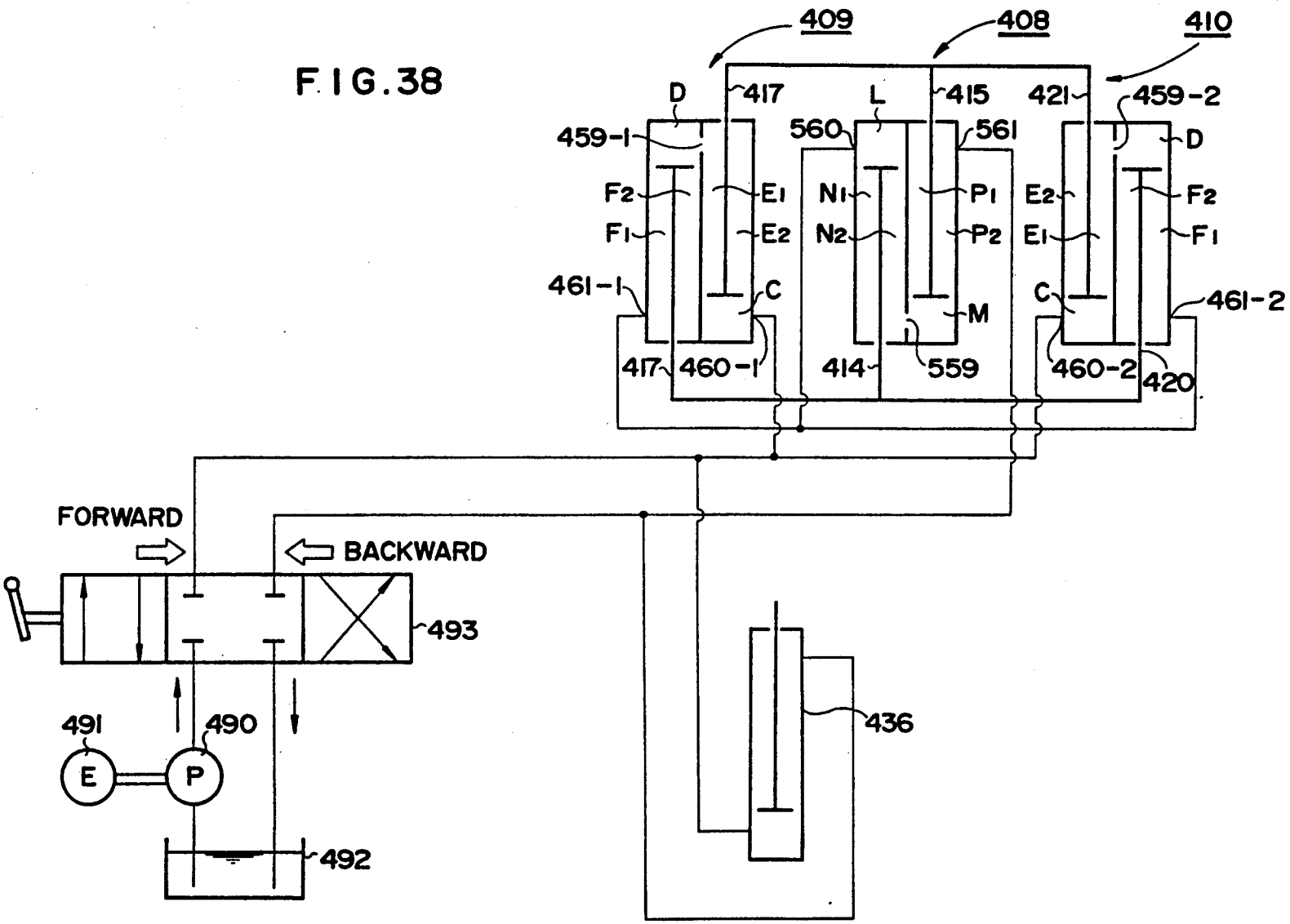
FIG. 38 is a piping diagram showing a hydraulic circuit according to the fourth embodiment of the present invention.

The hydraulic circuit will be described with reference to FIG. 38.

A hydraulic pump 490 is driven by an engine 491 and has a suction side communicating with an oil tank 492 and a discharge side connected to a three-directional selector valve 493. The selector valve 493 is connected to one oil passage hole 460-1 and 460-2 and to the hydraulic cylinder 436 at the output thereof while the selector valve 493 is connected to another oil passage hole 561 and to the hydraulic cylinder 436 at the return passage thereof.

An operation of the lifting apparatus according to the fourth embodiment of the present invention will be described hereinafter.

An engine 491 attached to the chassis 401 is actuated so as to raise the platform 407 so that the oil pump 490 is driven to suck the oil for generating oil under pressure.

When the platform 407 is raised, the selector valve 493 is operated to switch to "normal position". Then, the oil under pressure is supplied to the oil passage holes 460-1 and 460-2 of the right and left hydraulic mechanisms 409 and 410. The oil under pressure supplied to the oil passage hole 460-1 and 460-2 is then supplied to a ring shaped cylinder chamber C defined between the outer case 441 and the middle case 442. The oil under pressure supplied to the cylinder chamber C increases the pressure in the cylinder chamber C so that the piston ring 455 is pulled out leftward in FIG. 30 and the large rods 417 and 420 are pulled out leftward from the cylinder bodies 416 and 417.

Figure 29:
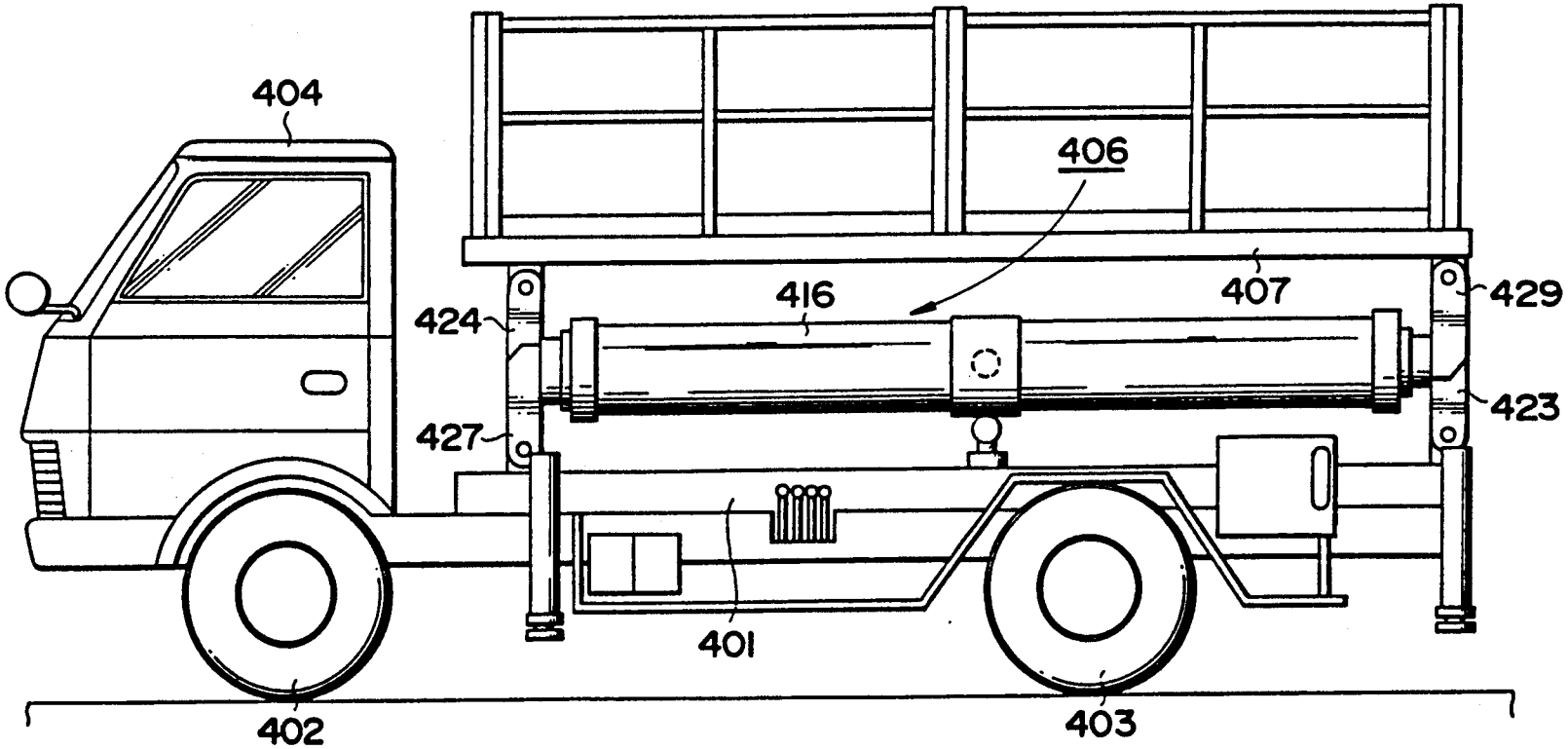
FIG. 29 is a side view showing the lifting apparatus wherein the platform is lowered at its lowermost position.

However, when the platform 407 is positioned at the lowermost position as illustrated in FIG. 29, the cylinder bodies 416 and 419, the large rods 417 and 420 and the small rods 418 and 421 are respectively arranged in parallel with each other in the straight line, hence no component force is generated in the direction to turn in the X-shape about the connection mechanism 422 whereby the platform 407 is not raised. Since the oil under pressure is also supplied to the hydraulic cylinder 436 by the operation of the selector valve 493, the hydraulic cylinder 436 is operated to raise a pushing body 437 upward. The pushing body 437 contacts the central lower surfaces of the cylinder bodies and raises the cylinder bodies 413, 416 and 419 to cause them to be formed slightly in the X-shape. With the operation of a kick mechanism 411, the lifting mechanism 406 is varied from the state where the three cylinder bodies 413, 416 and 419 are parallel with each other to the slightly collapsed X-shape. In the initial deformation, since the oil under pressure is supplied to the right and left cylinder bodies 416 and 419, there is generated a component in the direction to turn in the X-shape about the connection mechanism 422.

In succession to the operations set forth above, the oil under pressure supplied to the cylinder chamber C pushes the piston ring 455 for thereby pushing down the large rods 417 and 420 from the left end of the slide ring 455 so that the lengths of the cylinder bodies 409 and 410 are gradually lengthened. Accompanied by the movement of the piston ring 455, the oil under pressure residue in the cylinder chamber E-1 and E-2 defined between the outer case 441 and the middle case 442 flows through the fluid hole 459 and enters into a cylinder chamber D. At this time the oil under pressure in the cylinder chamber E-1 flows through the fluid hole 457 and enters into the cylinder chamber E-2, hence, the oil under pressure does not remain therein.

The oil under pressure entered into the cylinder chamber D pushes the piston ring 456 rightward in FIG. 30 so that the small rods 418 and 421 are pulled out from the right side of the slide rings 448 and 453. In such a manner, the large rods 417 and 420 and small rods 418 and 421 are extended from the right and left ends of the cylinder bodies 416 and 419, thereby operating to extend the entire lengths of the hydraulic stretchable mechanisms 409 and 410.

In the relationship between the cylinder chambers E-1, E-2 and D, insamuch as the cross sectional area which is the sum of the cross sectional areas of the cylinder chamber E-1 and E-2 is equal to that of the cylinder chamber D, the stretching speed of the large rods 417 and 420 from the cylinder bodes 416 and 419 is same as that of the small rods 418 and 421. As a result, when the oil under pressure is supplied to the cylinder chamber D to thereby move the piston ring 456 rightward in FIG. 30, the piston ring 456 moves between the middle case 442 and the inner case 443, whereby the oil under pressure residue in the cylinder chambers F-1 and F-2 is discharged from the oil passage holes 461-1 and 462-2 to the outside.

The oil under pressure discharged from both the cylinder chambers F 1 and F-2 enters into the cylinder chamber L through the oil passage hole 560 of the central hydraulic stretchable mechanism 408. Inasmuch as the pressure in the cylinder chamber L is increased in such a manner, the piston ring 555 moves between the outer case 541 and the middle case 542, thereby operating to push the large rod 414 connected to the piston ring 555 rightward in FIG. 31.

With the movement of the piston ring 555, the oil under pressure in the cylinder chamber N-1 and N-2 flows from the fluid hole 559 to increase the pressure in the cylinder chamber M. Hence, the piston ring 556 defined between the middle case 542 and the inner case 543 is moved leftward in FIG. 31, thereby operating to pushing the small rod 415 connected to the piston ring 556 from the cylinder body 413 to the outside. At the time of movement, since the cross sectional area in total of the cylinder chambers N 1 and N-2 is same as the cross sectional area of the cylinder chamber D, the stretchable speed of the large rod 414 is same as that of the small rod 415. When the piston ring 556 is moved, the oil under pressure in the cylinder chambers P-1 and P-2 is discharged from the oil passage hole 561 to the outside and collected in the oil tank 492 through the selector valve 493.

With the circulation of the oil under pressure, the stretchable speeds between the large rods 414, 417, 420 and the small rods 415, 418 and 421 of the hydraulic stretchable bodies 408, 409, 410 are same with each other so that the amount of stretchable movement of the hydraulic stretchable mechanisms 408, 409 and 410 become same. Accordingly, the lifting mechanism 406 is turned in the X-shape so that the platform 407 is raised while it is kept horizontal.

In such a manner, the large rods 414, 417, 420 and the small rods 415, 418, 421 are extended leftward and rightward from the both ends of the cylinder bodies 413, 416, 419 which gradually enlarge the intervals between the connection pieces 420 and 426, 427 and 429, 428 and 430. With such an extension of the hydraulic stretchable mechanisms 408, 409, 410, although the lifting mechanism composed of the combination of three stages is lengthened at its entire length, since the large rods 414, 417, 420 and the small rods 414, 418, 421 are pivotally connected by the pins to the fixing pieces 425, 426, 431, 432, 433, 434 fixed to the mobile chassis 40 and the platform 407 when the entire length is lengthened, the direction of extension is decomposed to be directed upward, hence the platform is gradually raised upward. At this time, when three cylinder bodies 413, 416, 419 are connected with each other by rotary shafts 473, 474 and rotary shafts 477 and 478, the three cylinder bodies 413, 416, 419 are respectively turned about the central axis of the rotary shafts 473 and 474 in the X-shape so that the platform is raised.

When the platform 407 is raised at a given position, the selector valve 493 is switched to "middle position" so that the oil under pressure is stopped to be supplied to the oil passage holes 460-1 and 460-2 and the piston rings 455 and 456 are kept positioned where the oil under pressure is stopped, hence the platform 407 is kept positioned at the same level.

When the platform 407 is lowered, the selector valve 493 is switched to "backward position" so that the oil under pressure is supplied to the oil passage hole 561 of the central stretchable mechanism 408, thereby increasing the pressure in the cylinder chambers P-1 and P-2. Accordingly, the piston ring 556 is pushed rightward in FIG. 31 so that the small rods 415 is moved inside the cylinder body 413, whereby the oil under pressure in the cylinder chamber M flows through the fluid hole 559 to increase the pressure in the cylinder chambers N-1 and N-2. As a result, the piston ring 555 is pushed leftward in FIG. 31 and the large rod 414 is pulled inside the cylinder body 413. In such a manner, the interval between the lower end of the large rod 414 and the upper end of the small rod 415 is decreased.

The oil under pressure residue in the cylinder chamber L is discharged from the oil passage hole 560 and the discharge oil under pressure is supplied to the oil passage holes 461-1 and 461-2 of the left and right hydraulic stretchable mechanisms 409 and 410 to operate to pull the large rods 417 and 420 and the small rods 418 and 421 inside the cylinder bodies 416 and 419. Accordingly, the entire lengths of the hydraulic stretchable mechanisms 408, 409 and 410 are shortened so that the platform 407 is gradually lowered. At this time, since the cross sectional area of the cylinder chamber M is same as the cross sectional area in total of the cylinder chamber N-1 and N-2, the pulling speed of the large rod 414 inside the cylinder body is same as that of the small rod 415. Furthermore, the cross sectional area in total of the cylinder chambers F 1 and F-2 is same as the cross sectional area of the cylinder chamber D, the pulling speed of the large rod 417 and 420 inside the cylinder bodies 416 and 419 is same as that of the small rod 418 and 421. Still furthermore, since the cross sectional area of the cylinder chamber L is same as the cross sectional area in total of the cylinder chambers F-1 and F-2 of the cylinder bodies 416 and 419, the pulling speed of the large rod 414 in the hydraulic stretchable mechanism 408 is same as that of the large rods 417 and 420 of the left and right hydraulic stretchable mechanism as 409 and 410. Accordingly, the pulling speed of the large rods 414, 417, 420 of three hydraulic stretchable mechanisms is same as that of the small rods 415, 418, 421 so that the platform 407 is lowered while it is kept horizontal.

When the platform 407 is lowered, the oil under pressure in the cylinder chamber C is returned to the oil tank 492 through the selector valve 493.

With the arrangement of the lifting apparatus according to the fourth embodiment of the present invention, the lifting mechanism can be composed of a hydraulic stretchable mechanism resembling a plurality of hydraulic cylinder bodies which entails the very simple structure. According to the present embodiment, since only three hydraulic stretchable mechanisms are employed, the manufacturing cost of the lifting mechanism is low with minimum numbers of the elements. The stretchable speed of three hydraulic stretchable mechanisms is always synchronous with each other by setting the cross sectional area in the cylinder chamber to which the oil under pressure is applied when three hydraulic stretchable mechanisms are synchronous with each other, whereby the synchronous mechanism becomes very simple and the operation thereof can be stabilized.

Although the invention has been described in its preferred form with a certain degree of particularity, it is to be understood that many variations and changes are possible in the invention without departing from the scope thereof.

What is claimed is:

1. A lifting apparatus comprising an elongated mobile chassis, an elongated platform disposed over the mobile chassis and capable of raising and lowering vertically, a lifting mechanism disposed between the mobile chassis and the platform and composed of two side hydraulic stretchable mechanisms and one central hydraulic stretchable mechanism which are stretchable in three stages and connected to each other at the central portions thereof so as to be arranged in an X-shape with said side stretchable mechanisms being inclined in one longitudinal direction and said central stretchable mechanisms being inclined in the opposite longitudinal direction, each hydraulic stretchable mechanism being composed of a hydraulic cylinder body having a large diameter, a large rod inserted into the hydraulic cylinder body and a small rod inserted into the hydraulic cylinder body, said small rod being telescopically slidably received in said large rod so as to be extendable therefrom or retractable thereinto, wherein the central stretchable mechanism has the large rod connected to one longitudinal end of the surface of the mobile chassis and the small rod connected to the opposite longitudinal end of the lower surface of the platform, and wherein the side stretchable mechanisms have the large rods connected to said opposite longitudinal end of the surface of the mobile chassis and the small rods connected to said one longitudinal end of the lower surface of the platform.

2. A lifting apparatus comprising a mobile chassis, a platform disposed over the mobile chassis and capable of raising and lowering vertically, a lifting mechanism disposed and connected between the mobile chassis and the platform for effecting raising and lowering of the platform, the lifting mechanism including a pair of hydraulic stretchable mechanisms pivotally connected to each other at central portions thereof and capable of turning in a X-shape about the central portions thereof, each said hydraulic stretchable mechanism including a hydraulic cylinder body having opposite ends which are both open, a lower rod inserted into and extendable outwardly from one open end of said cylinder body and connected at an outer end thereof to the mobile chassis, and an upper rod inserted into and extendable outwardly from the other open end of said cylinder body and connected at an outer end thereof to the platform, said upper and lower rods being telescopically slidably received one within the other so as to be relatively extendable and retractable; and the pair of hydraulic stretchable mechanisms including airtight pressure fluid spaces defined in the hydraulic cylinder bodies and containing fluid under pressure for controlling and causing synchronous movement of the upper and lower rods relative to the respective cylinder body, the spaces including substantially equal cross-sectional areas to that fluid under pressure simultaneously acts against a first said area for moving one of said rods in one direction while the fluid under pressure reacts against a second said area for causing corresponding movement of said other rod in the opposite direction.

3. An apparatus according to claim 2, wherein the hydraulic cylinder body includes first, second and third elongate and generally concentric tubular casings fixedly connected together, said airtight spaces including a first elongate annular chamber defined between said first and second casings and a second elongate chamber defined between said second and third casings, said lower rod having a first annular piston mounted thereon and slidably and sealingly supported within said first annular chamber, said upper rod having a second annular piston thereon which is slidably and sealingly supported with said second chamber.

4. An apparatus according to claim 3, wherein said first piston divides said first chamber into upper and lower subchambers disposed on opposite sides of said first piston, said second piston divides said second chamber into upper and lower subchambers disposed on opposite sides of said second piston, a first fluid passage communicating with one of the subchambers of said first chamber for permitting pressure fluid to be supplied thereto or withdrawn therefrom, a second fluid passage communicating with one of subchambers of said second chamber for permitting pressure fluid to be supplied thereto or withdrawn therefrom, and an internal passage providing communication between the remaining subchambers of said first and second chambers so that fluid within said remaining subchambers is equally pressurized to cause synchronous controlled movement of said first and second pistons in opposite directions.

5. An apparatus according to claim 4, wherein said first and second pistons respectfully define thereon first and second pressure faces of substantially equal areas and which face axially in the same direction.

6. An apparatus according to claim 5, wherein said first and second passages both communicate with the respective first and second chambers in the vicinity of the same end of the cylinder body.

7. An apparatus according to claim 2, wherein said cylinder body includes first and second body parts which are fixedly joined together in adjacent and parallel relationship, one open end of said cylinder body being defined solely on said one body part, and the other open end of said cylinder body being defined solely on the other body part.

8. An apparatus according to claim 7, wherein said first and second rods respectively have first and second pistons mounted on inner ends thereof, said first and second body parts respectively defining therein first and second said spaces and respectively having said first and second pistons slidably and sealingly supported therein.

9. An apparatus according to claim 8, wherein said first space is divided by said first piston into first and second chambers disposed on opposite sides of said first piston, said second space is divided by said second piston into first and second chambers defined on opposite sides of said second piston, said first chambers being located adjacent one end of said cylinder body, said second chambers being located adjacent the other end of said cylinder body, a supply passage formed in said cylinder body and communicating with one of said first chambers for permitting pressure fluid to be supplied thereto or withdrawn therefrom, a second passage formed in said cylinder body and communicating with the other of said first chambers for permitting pressure fluid to be supplied thereto or withdrawn therefrom, and said second chambers being closed except for being in open communication with one another so that movement of one piston in one direction causes transfer of pressure fluid between said second chambers to cause corresponding movement of the other piston in an opposite direction, said second pressure chambers having equal cross-sectional areas for causing corresponding and equal movements of said first and second pistons in opposite directions.

10. A lifting apparatus comprising a mobile chassis, a platform disposed over the mobile chassis and capable of raising and lowering vertically, a pair of lifting mechanisms disposed and connected between the mobile chassis and the platform for effectively raising and lowering of the platform, each lifting mechanism including first and second hydraulic stretchable mechanisms pivotally connected to each other at central portions thereof and capable of turning in an X-shape about the central portions thereof, characterized in that:

one pair of said hydraulic stretchable mechanisms are composed of a pair of hydraulic cylinder bodies having large diameters, a pair of large diameter rods having inner ends respectively inserted into the hydraulic cylinder bodies and connected adjacent outer ends thereof to the mobile chassis, and a pair of small diameter rods having inner ends respectively inserted into the hydraulic cylinder bodies and connected adjacent outer ends thereof to the platform;

another pair of said hydraulic stretchable mechanisms are composed of a pair of hydraulic cylinder bodies having large diameters, a pair of large diameter rods having inner ends respectively inserted into the hydraulic cylinder bodies and connected adjacent outer ends thereof to the platform, and a pair of small diameter rods having inner ends respectively inserted into the hydraulic cylinder bodies and connected adjacent outer ends thereof to the mobile chassis;

each said hydraulic cylinder body and the inner ends of the respectively large and small rods cooperating to define a plurality of interior chambers for containing pressure fluid and including a first fluid-containing pressure chamber cooperating with one of said large and small rods and connected in fluid communication with a second fluid-containing chamber with cooperates with the other of said large and small rods, said first and second chambers being of substantially equal cross-sectional areas so that when one of the rods is extended relative to the respective cylinder body the other respective rod is also simultaneously extended by an amount equal to the extension of the first rod.

11. An apparatus according to claim 10, wherein the cylinder body includes first, second and third tubular casings which are fixedly joint together in surrounding and substantially concentric relationship with respect to one another so as to define a first annular space between said first and second casings and a second annular space concentrically surrounding said first space and defined between said second and third casings, said small rod having a first piston on the inner end thereof and disposed in slidable and sealed relationship within the first space, the large rod having a second piston on the inner end thereof and disposed in slidable and sealed relationship within the second space, each said piston dividing said space into first and second said chambers disposed on axially opposite sides of the respective piston, and the chamber on one axially side of said first piston being in open communication with the chamber disposed on the same axial side of said second piston with these latter two chambers having substantially equal cross-sectional areas so that movement of one piston along its space causes a corresponding and equal movement of the other piston in the opposite direction along its space.

12. A lifting apparatus comprising a mobile chassis, a platform disposed over the mobile chassis and capable of raising and lowering vertically, a lifting mechanism disposed and connected between the mobile chassis and the platform for effecting raising and lowering of the platform, the lifting mechanism including a pair of hydraulic stretchable mechanisms pivotally connected to each other at central portions thereof and capable of turning in an X-shape about the central portions, each hydraulic stretchable mechanism of said pair including a hydraulic cylinder body arrangement composed of two hydraulic cylinder bodies which are fixedly coupled together in axially overlapping, side-by-side, adjacent, parallel relationship, each of said bodies having an open end, the open ends on the bodies being disposed at opposite ends of the cylinder body arrangement and opening outwardly in opposite directions, a first rod slidably supported on one said body and having an inner end slidably insertable into said one body and an outer end connected to the mobile chassis, and a second rod slidably supported on the other body in generally parallel relationship to said first rod, said second rod having and inner end slidably inserted into said other body and an outer end connected to said platform, said first and second rods being movable into axially overlapping relationship when said rods are retracted in their respective cylinders.

13. An apparatus according to claim 12, wherein each said cylinder body of said body arrangement defines therein a pressure chamber in which is slidably supported a piston which is mounted on the inner end of the respective rod, each said cylinder body and its respective piston cooperating to define a subchamber containing a pressure fluid, each piston defining thereon a pressure face which defines one of the boundaries of the respective subchamber, the pressure faces on the pistons being of substantially equal area, and said subchambers being in continuous flow communication so that movement of one piston due to extension of its rod causes the fluid in the respective subchamber to flow into the subchamber of the other cylinder body to cause a corresponding and equal movement of the piston coupled to the other rod to effect extension thereof.

14. An arrangement according to claim 13, wherein the pair of cylinder bodies defining said cylinder arrangement and the cooperating pistons have the same diametral relationships to define identical pressure areas.

15. A lifting apparatus comprising: a mobile chassis;

a platform disposed above and substantially parallel with said chassis and arranged for vertical movement with respect to said chassis;

at least one lifting mechanism disposed between and being connected to said chassis and said platform for raising and lowering said platform, said lifting mechanism comprising first and second elongated hydraulic cylinder means having elongated internal chamber means, said first and second hydraulic cylinder means being connected to each other between the longitudinal ends of said cylinder means so as to angularly movable into an X-shape, each of said first and second cylinder means having upper and lower rod means supported in said internal chamber means for lengthwise sliding movement between extended and retracted positions, said upper and lower rod means being slidable receivable within their associated cylinder means in axially overlapping relationship with one another when said rod means are in said retracted positions;

actuation means for simultaneously moving said upper rod means and said lower rod means of each of said cylinder means equal distances but in opposite directions to extend same from or retract same within said cylinder means, said actuation means comprising separate piston head means on the inner ends of each of said upper and lower rod means, respectively, within said cylinder means and slidingly and sealingly contacting internal walls of said cylinder means, and means for supplying pressurized hydraulic fluid to said cylinder means for simultaneously moving said piston head means and thereby moving said upper and lower rod means in opposite directions, the areas of said piston head means on said upper and lower rod means effective for extending said upper and lower rod means being equal and the areas of said piston head means on said upper and lower rod means effective for retracting said upper and lower rod means being equal.

16. A lifting apparatus as claimed in claim 15 in which said lifting apparatus has two laterally spaced-apart lifting mechanisms, said first and second cylinder means for each lifting mechanism each is a single cylinder defined by three, concentric, axially overlapping casings which define two concentric, axially overlapping, annular chambers, said upper rod means is a first annular rod having an outer end pivotally connected to said platform and having a first piston head on its inner end and slidably and sealingly disposed in one of said chambers, said lower rod means is a second annular rod having an outer end pivotally connected to said chassis and having a second piston head on its inner end and slidably and sealingly disposed in the other of said chambers, and said means for supplying hydraulic fluid to each of said first and second cylinder means comprises means for selectively and alternatively supplying pressurized hydraulic fluid to corresponding one ends of one or the other of said chambers, and passages connecting the opposite ends of said chambers so that hydraulic fluid can flow between them whereby said first and second rods simultaneously move longitudinally in opposite directions in said chambers.

17. A lifting apparatus as claimed in claim 15 in which said lifting apparatus has two laterally spaced-apart lifting mechanisms, said first and second cylinder means for each lifting mechanism each is a single cylinder defined by three concentric, axially overlapping casings which define two concentric, axially overlapping annular chambers, said upper rod means is a first annular rod having an outer end pivotally connected to said platform and having a first piston head on its inner end and slidably and sealingly disposed in one of said chambers, said lower rod means is a second annular rod having an outer end pivotally connected to said chassis and having a second piston head on its inner end and slidably and sealingly disposed in the other of said chambers and said means for supplying hydraulic fluid to each of said first and second cylinder means comprises means for selectively and alternatively supplying pressurized hydraulic fluid to one end of one or the other of said chambers and first passage means connecting the opposite ends of said chambers so that hydraulic fluid can flow between them whereby said first and second rods move longitudinally in opposite directions in said chambers, and including second passages means connecting the opposite end of said one chamber of one of said first and second cylinder means to the opposite end of said other chamber of the other of said first and second cylinder means, and third passage means connecting the opposite end of said other chamber of said one of said first and second cylinder means to the opposite end of said one chamber of said other of said first and second cylinder means whereby said rods of said first and second cylinder means are moved simultaneously.

18. A lifting apparatus as claimed in claim 15 in which said lifting apparatus has two laterally spaced-apart lifting mechanisms, said cylinder means for each lifting mechanism comprises is first and second cylinders attached together in axially overlapping, side-by-side, adjacent, parallel relationship and defining first and second axially, overlapping, side-by-side, adjacent, parallel chambers, said upper rod means is a first rod extending upwardly from said first cylinder, having an upper end pivotally connected to said platform and having a first piston head on its lower end and slidably and sealingly disposed in said first chamber, said lower rod means is a second rod extending downwardly from said second cylinder, having a lower end pivotally connected to said chassis and having a second piston head on its upper end and slidably and sealingly disposed in said second chamber, and said means for supplying hydraulic fluid comprises means for selectively and alternatively supplying pressurized fluid to opposite ends of said first and second cylinders of each lifting apparatus.

19. A lifting apparatus as claimed in claim 15 in which said lifting apparatus comprises first and second laterally spaced-apart cylinders, a third cylinder disposed between said first and second cylinders, each said cylinder being defined by three concentric, axially overlapping casings, which define two concentric, axially overlapping, annular chambers, said upper rod means is a first annular rod having an outer end pivotally connected to said platform and having a first piston head on its inner end and slidably and sealingly disposed in one of said chambers, said lower rod means is a second annular rod having an outer end pivotally connected to said chassis and having a second piston head on its inner end and slidably and sealingly disposed in the other of said chambers and said means for supplying hydraulic fluid comprises means for selectively and alternatively supplying pressurized hydraulic fluid to (1) the lower ends of corresponding first chambers of said first and second cylinders, and (2) to the upper end of a first chamber of said third cylinder, and including first passage means connecting the upper ends of the first and second chambers of each of said first and second cylinders so that hydraulic liquid can flow between them, second passage means connecting the lower ends of the first and second chambers of said third cylinder whereby said first and second rods move longitudinally in opposite directions in said first and second chambers of said first, second and third cylinders.

* * * * *